US007557727B2

(12) United States Patent
Michida

(10) Patent No.: US 7,557,727 B2
(45) Date of Patent: Jul. 7, 2009

(54) ALERT APPARATUS FOR USE WITH FASTENERS

(76) Inventor: Taizo Michida, 2-24-20-102 Shioe, Amagasaki-shi, Hyogo (JP)

( * ) Notice: Subject to any disclaimer, the term of this patent is extended or adjusted under 35 U.S.C. 154(b) by 126 days.

(21) Appl. No.: 10/564,504

(22) PCT Filed: Jul. 16, 2004

(86) PCT No.: PCT/IB2004/002309

§ 371 (c)(1),
(2), (4) Date: Jul. 17, 2006

(87) PCT Pub. No.: WO2005/006913

PCT Pub. Date: Jan. 27, 2005

(65) Prior Publication Data

US 2007/0107652 A1 May 17, 2007

(30) Foreign Application Priority Data

Jul. 16, 2003 (JP) ..... 2003-275062
Jun. 7, 2004 (JP) ..... 2004-168115

(51) Int. Cl.
*G08B 3/00* (2006.01)

(52) U.S. Cl. ..... 340/691.1; 340/407.1; 340/815.4; 116/84; 116/85; 116/99; 116/100; 116/148

(58) Field of Classification Search ..... 340/691.1; 116/84, 85, 99, 100, 148
See application file for complete search history.

(56) References Cited

U.S. PATENT DOCUMENTS 4,466,329 A * 8/1984 Hayward ..... 84/406
4,755,802 A * 7/1988 Urbanczyk ..... 340/571
4,882,815 A 11/1989 Nilsen
5,022,340 A * 6/1991 Caraba ..... 116/77

FOREIGN PATENT DOCUMENTS

DE 297 15 996 U 10/1997
GB 2284698 6/1995
GB 2390206 12/2003

* cited by examiner

*Primary Examiner*—Benjamin C Lee
*Assistant Examiner*—Ojiako Nwugo
(74) *Attorney, Agent, or Firm*—Lowe Hauptman Ham & Berner, LLP

(57) ABSTRACT

To provide alert apparatus for use with fastener equipment, fasteners, wearable and portable items (for example, clothing and bags) including fasteners. The alert apparatus having a signal source (for example, a pull tab having a bell made of soft iron) that is helpful in alerting a user that a fastener has not been closed or connected, and a modifier (for example, a pull tab provided with a magnet) that can be connected to the signal source. The signal source and modifier each being attached to part(s) (for example, slider(s) of a slide fastener) of a fastener or to the cloth surrounding an opening in clothing, opening of a bag, or the like. When the opening is closed by means of the fastener and the signal source and the signal modifier are connected to each other, the operating condition of the signal source is modified.

15 Claims, 43 Drawing Sheets

【Fig. 1 A】
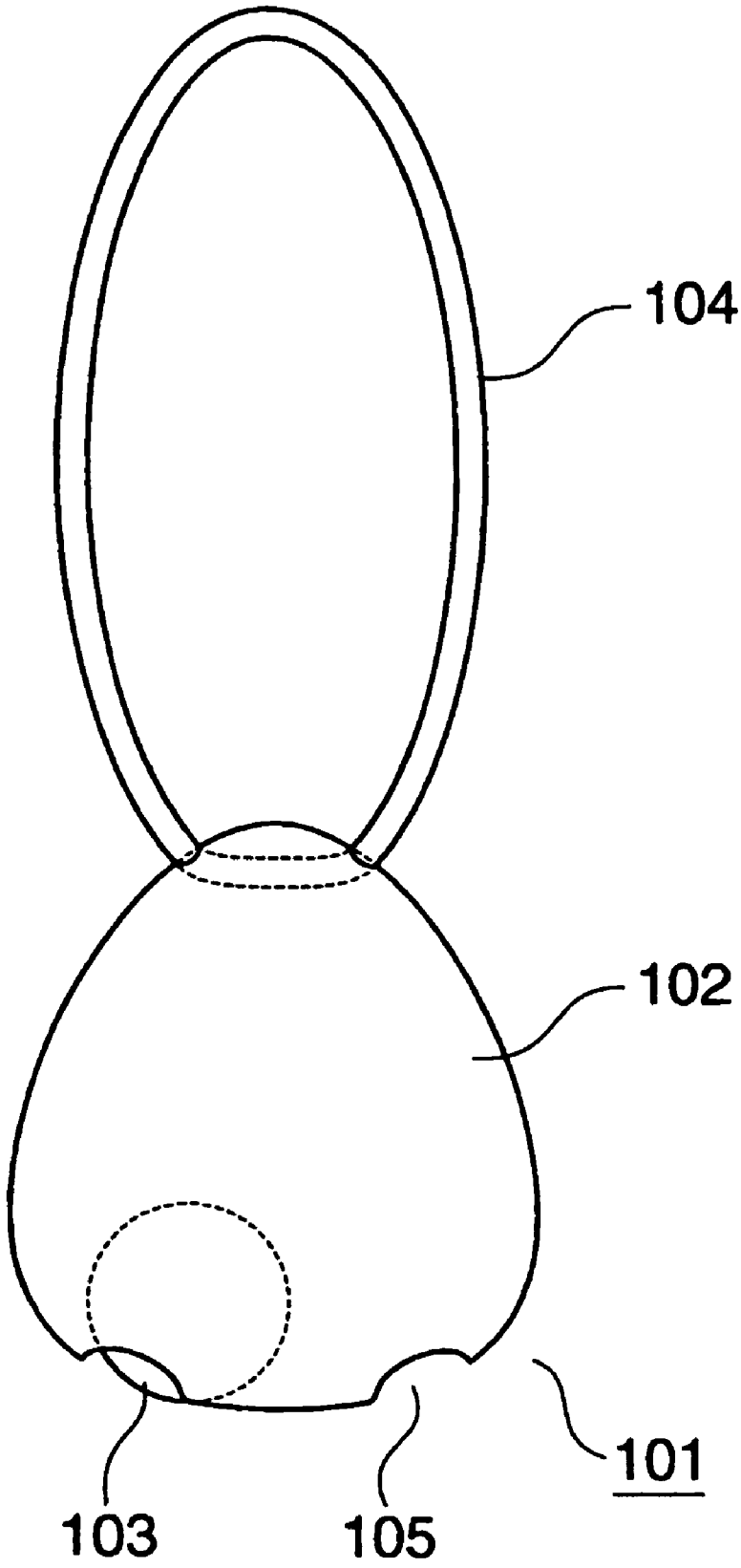

【Fig. 1 B】
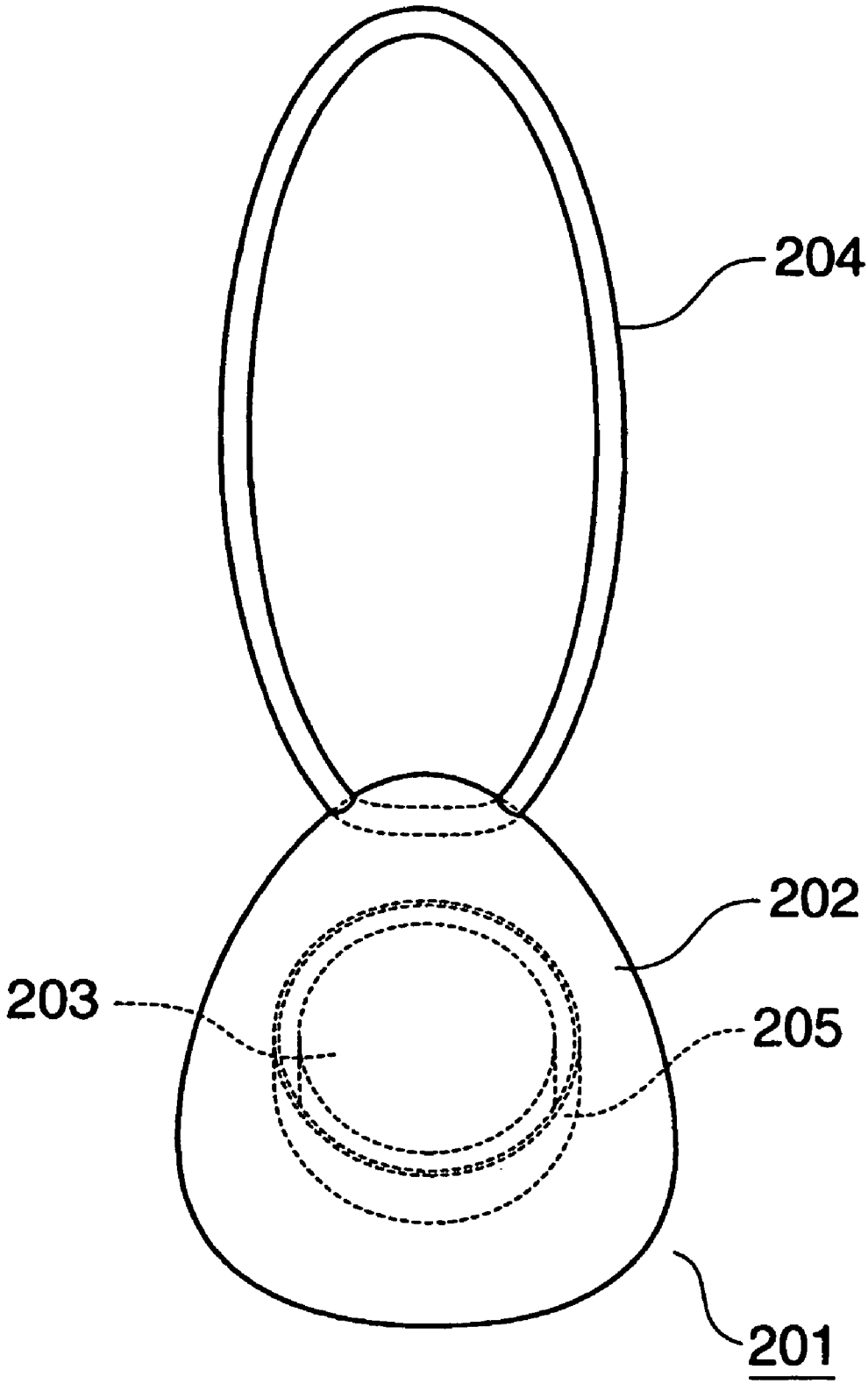

【Fig. 2 A】
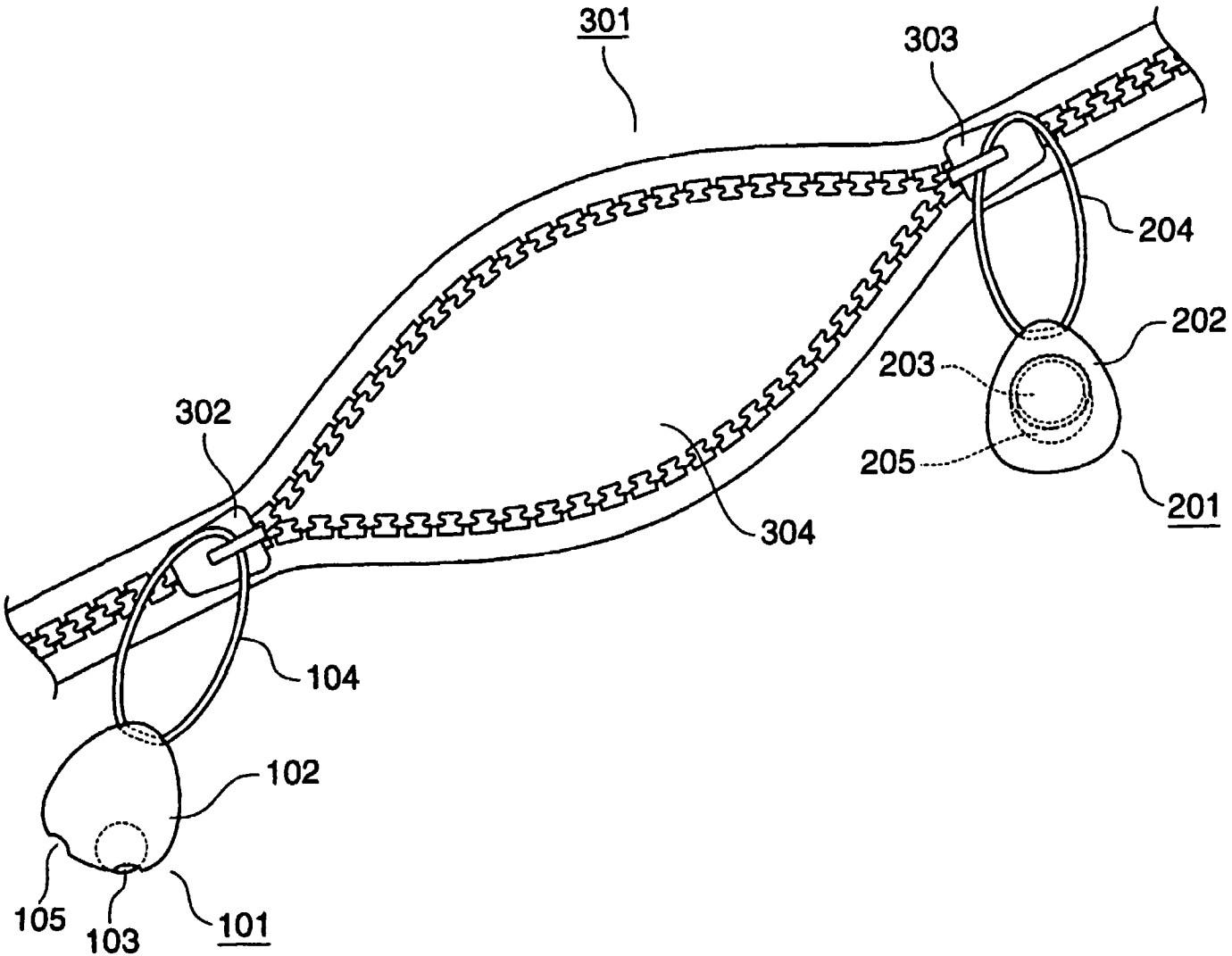

【Fig. 2 B】
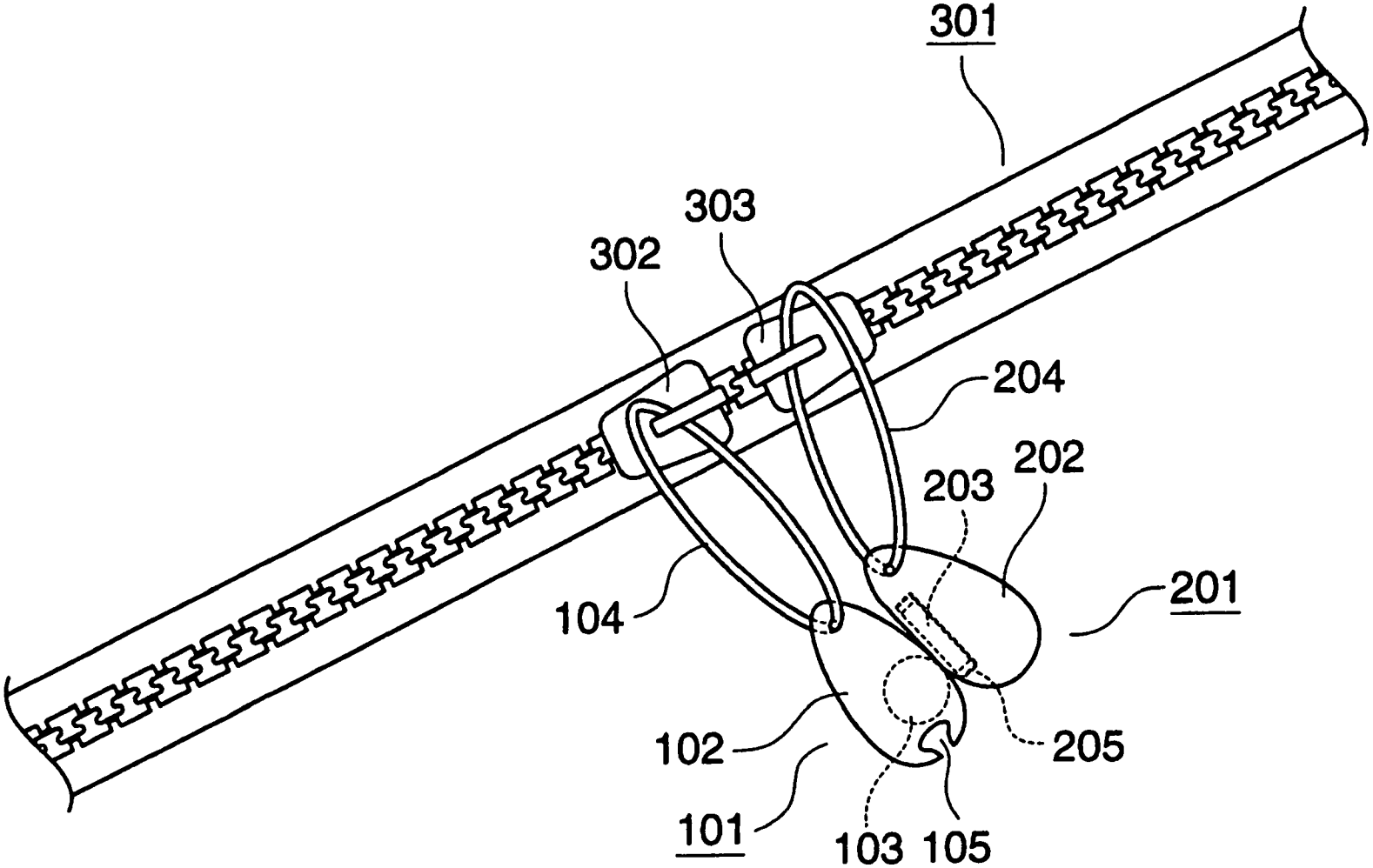

【Fig. 3】
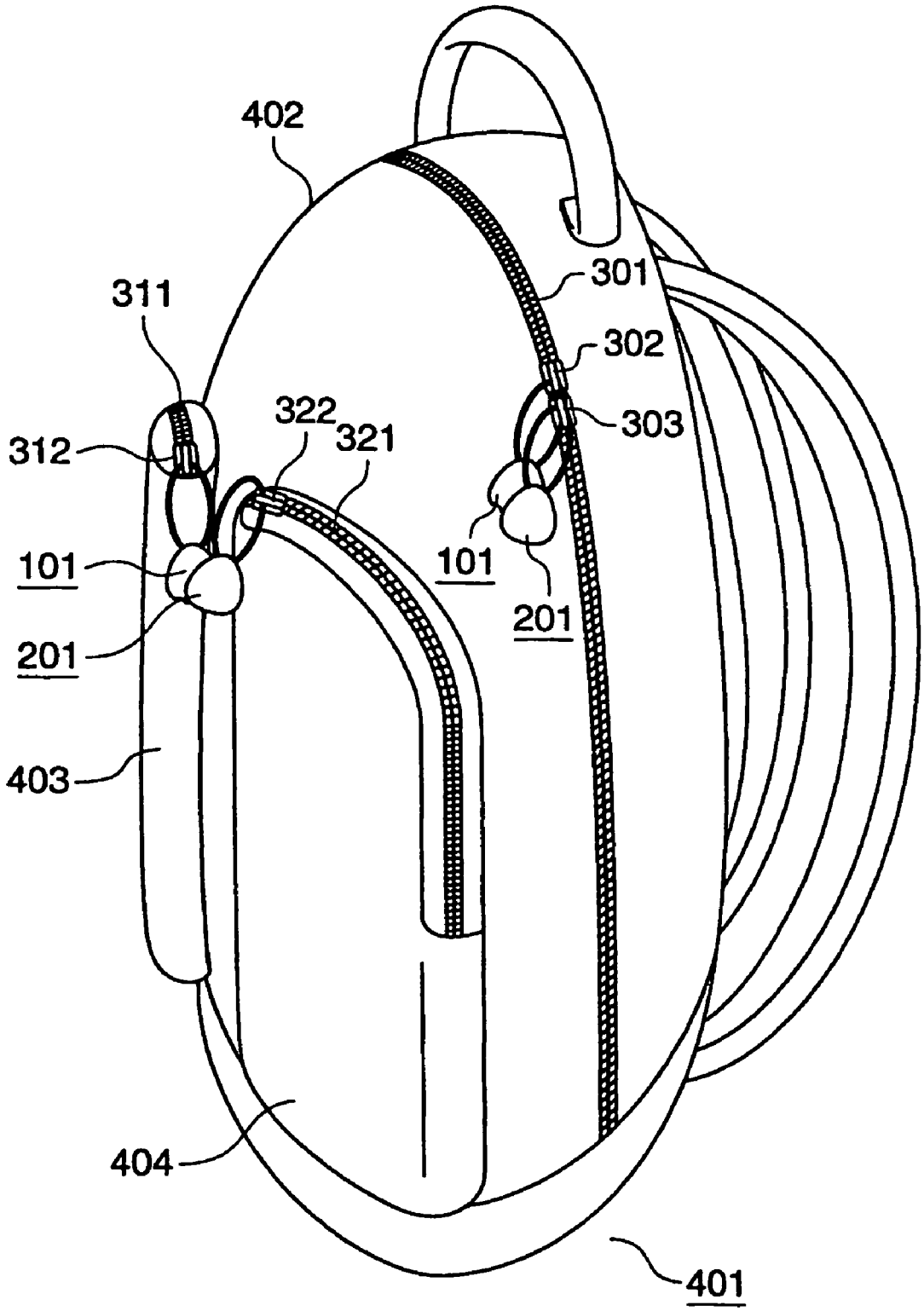

【Fig. 4】
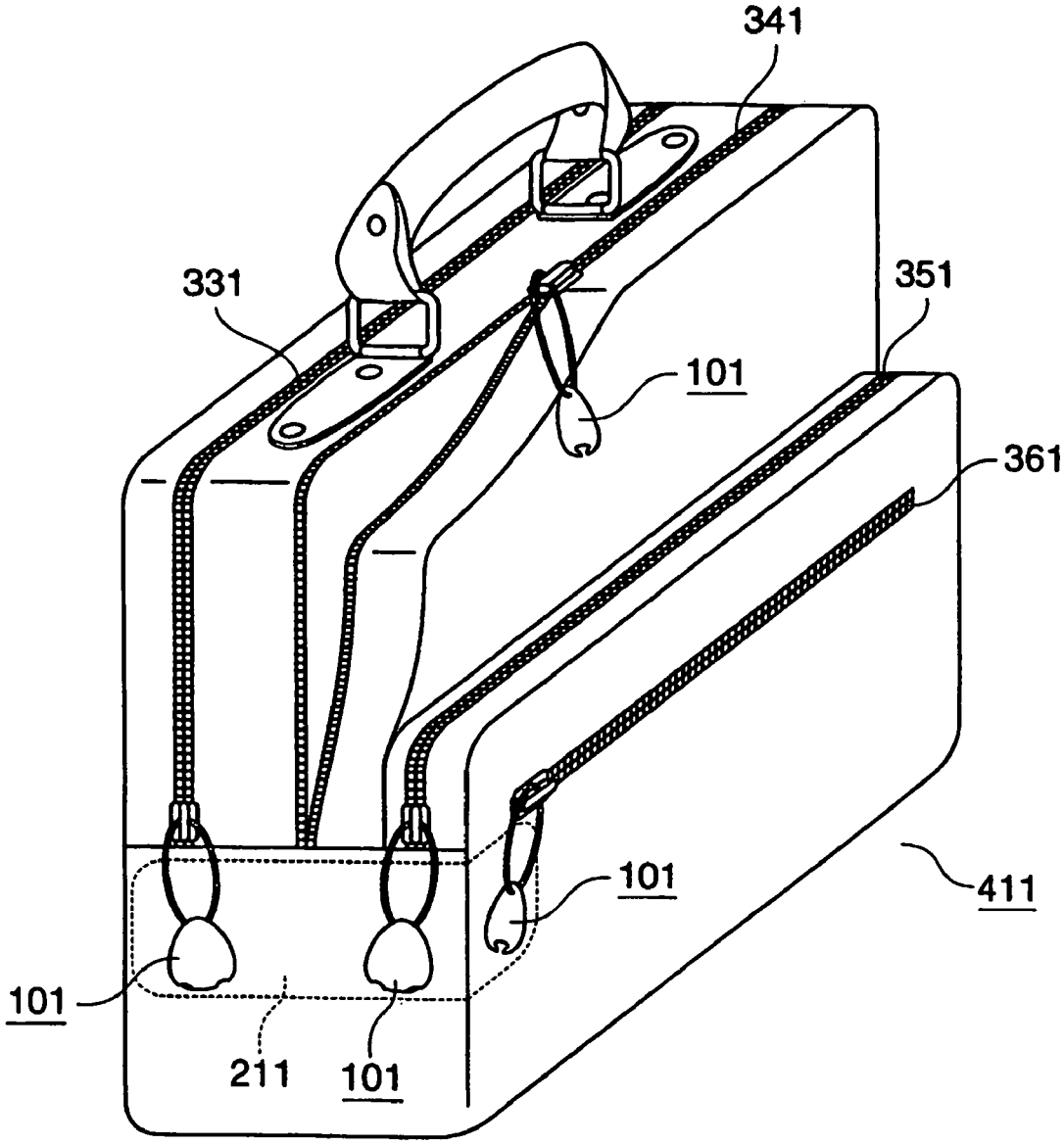

【Fig. 5 A】
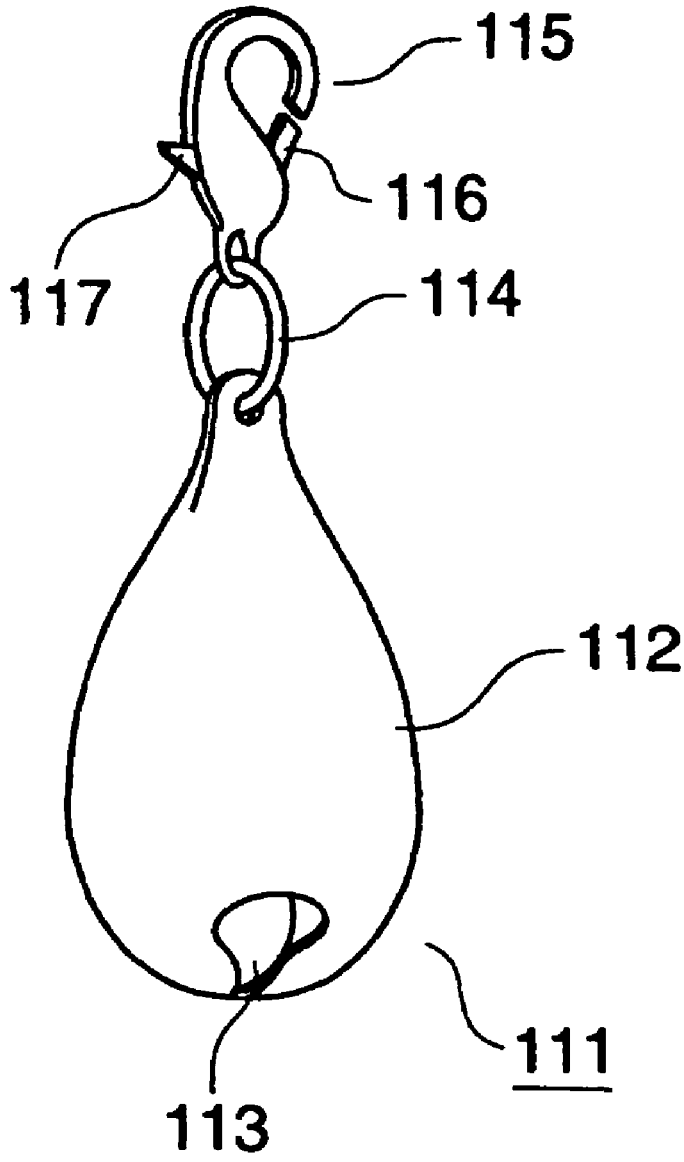

【Fig. 5 B】
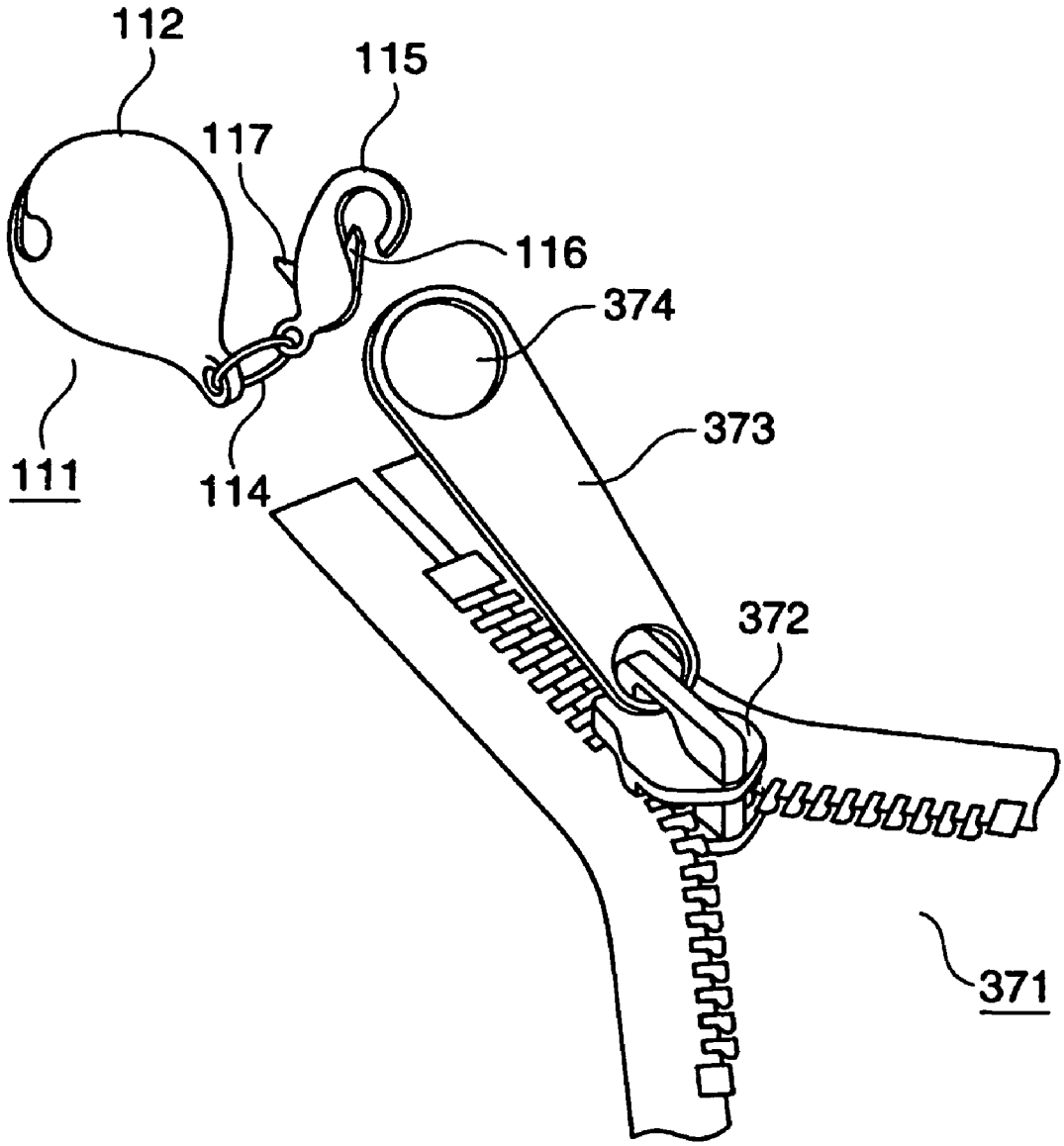

【Fig. 5 C】
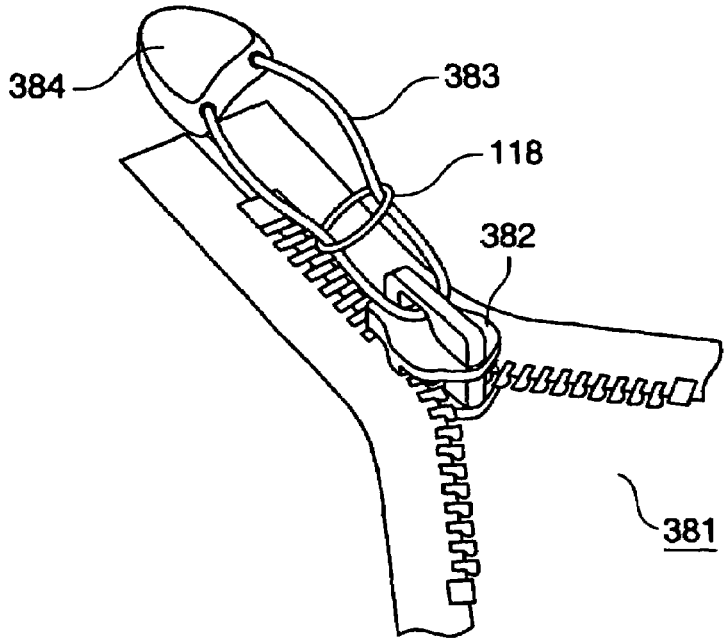
【Fig. 5 D】
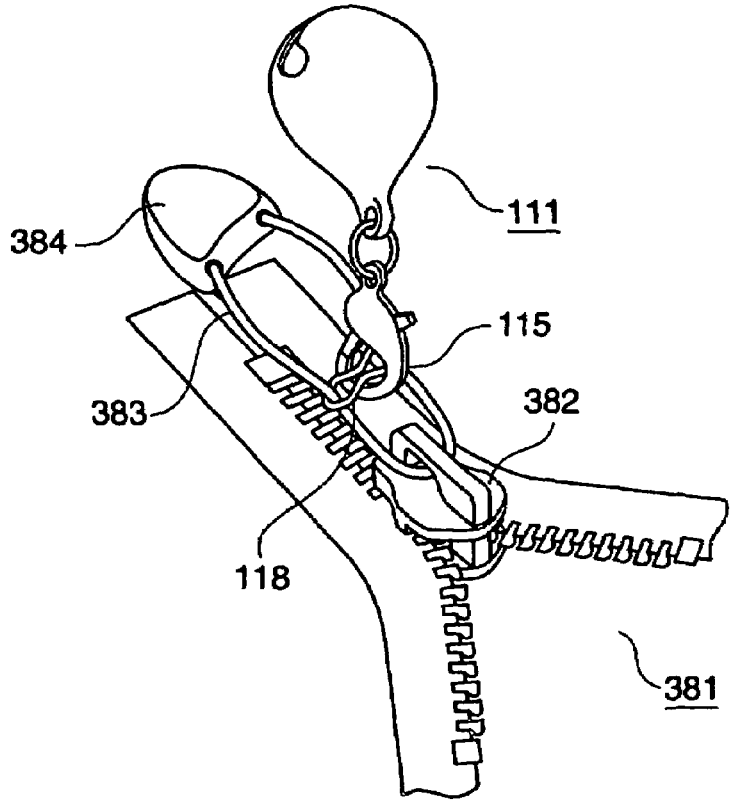

【Fig. 6 A】
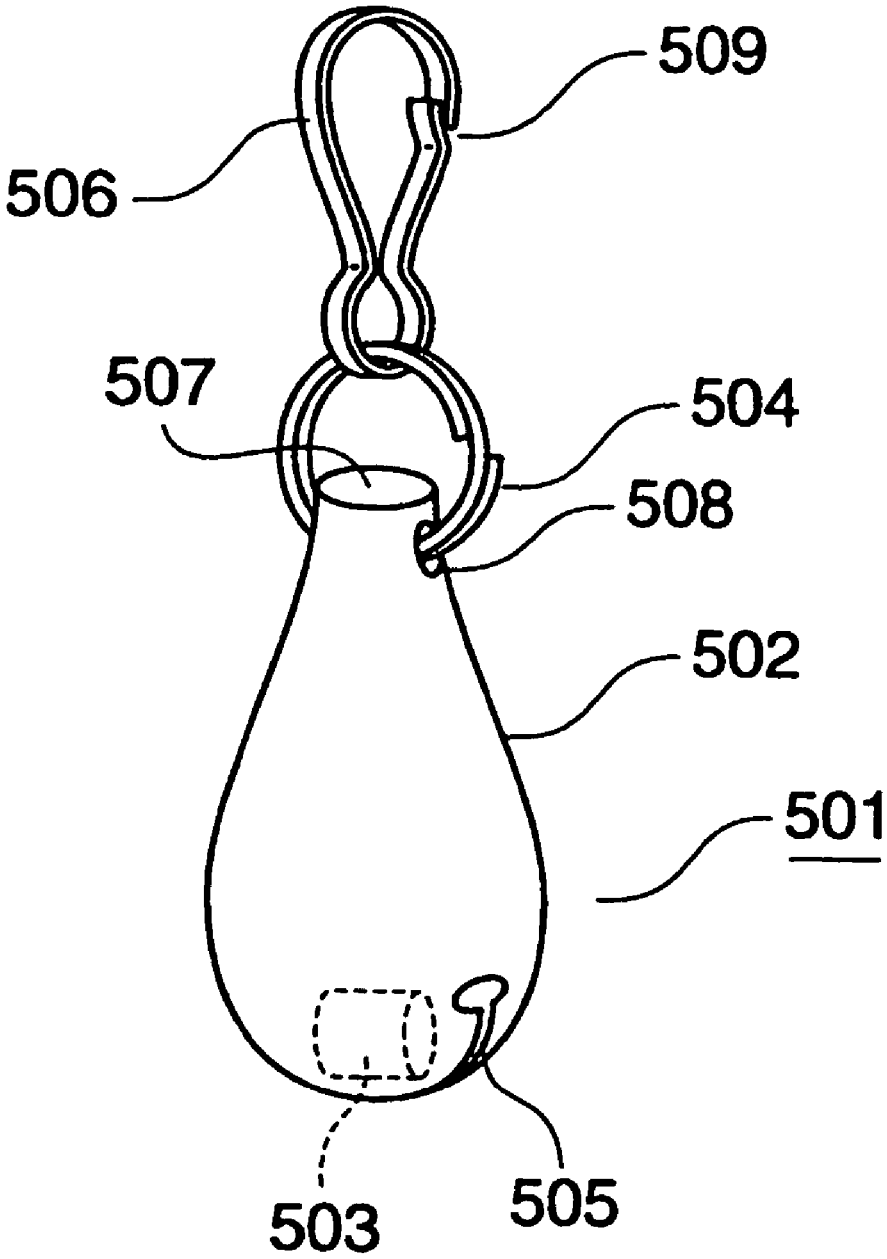

【Fig. 6 B】
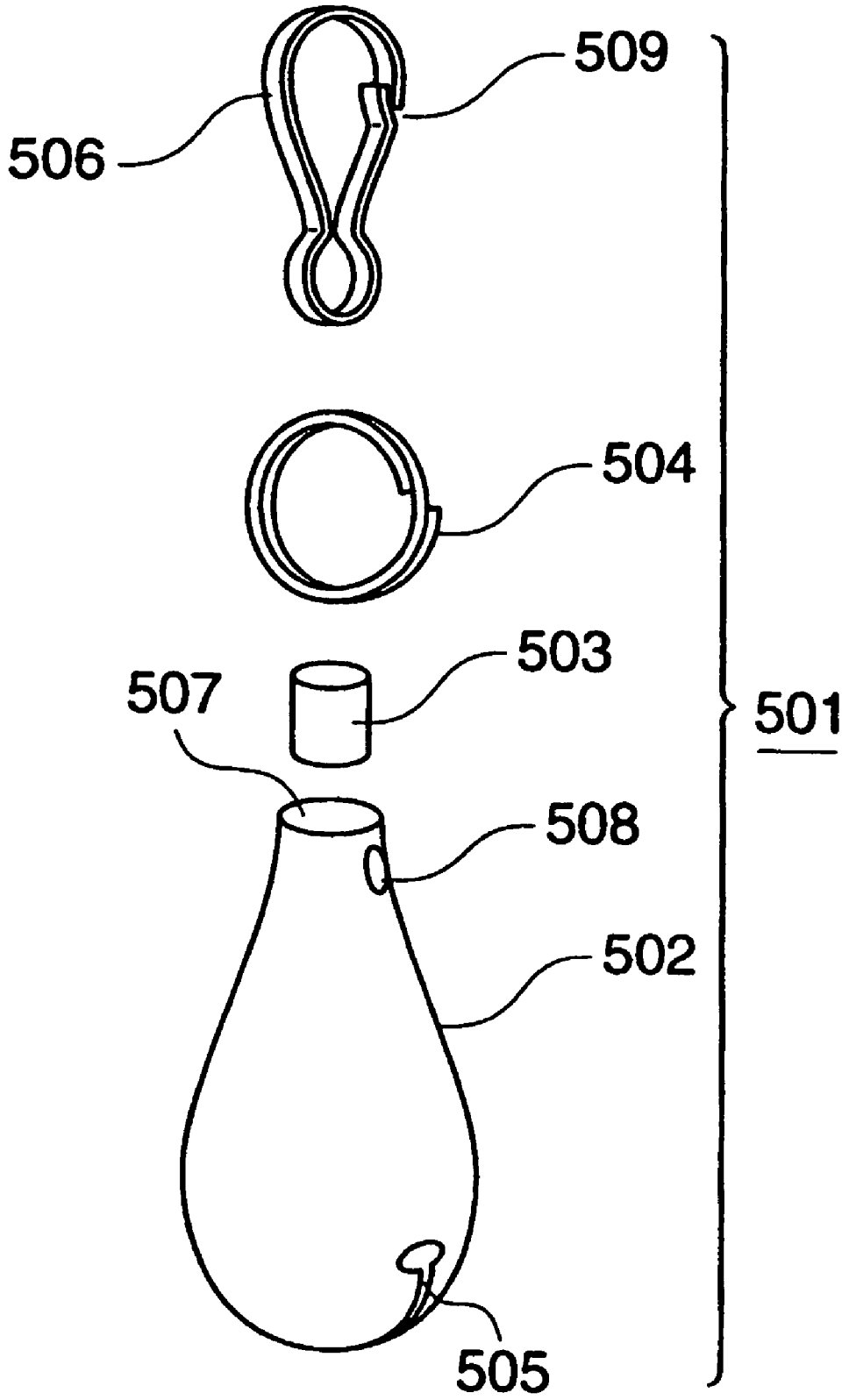

【Fig. 7 A】
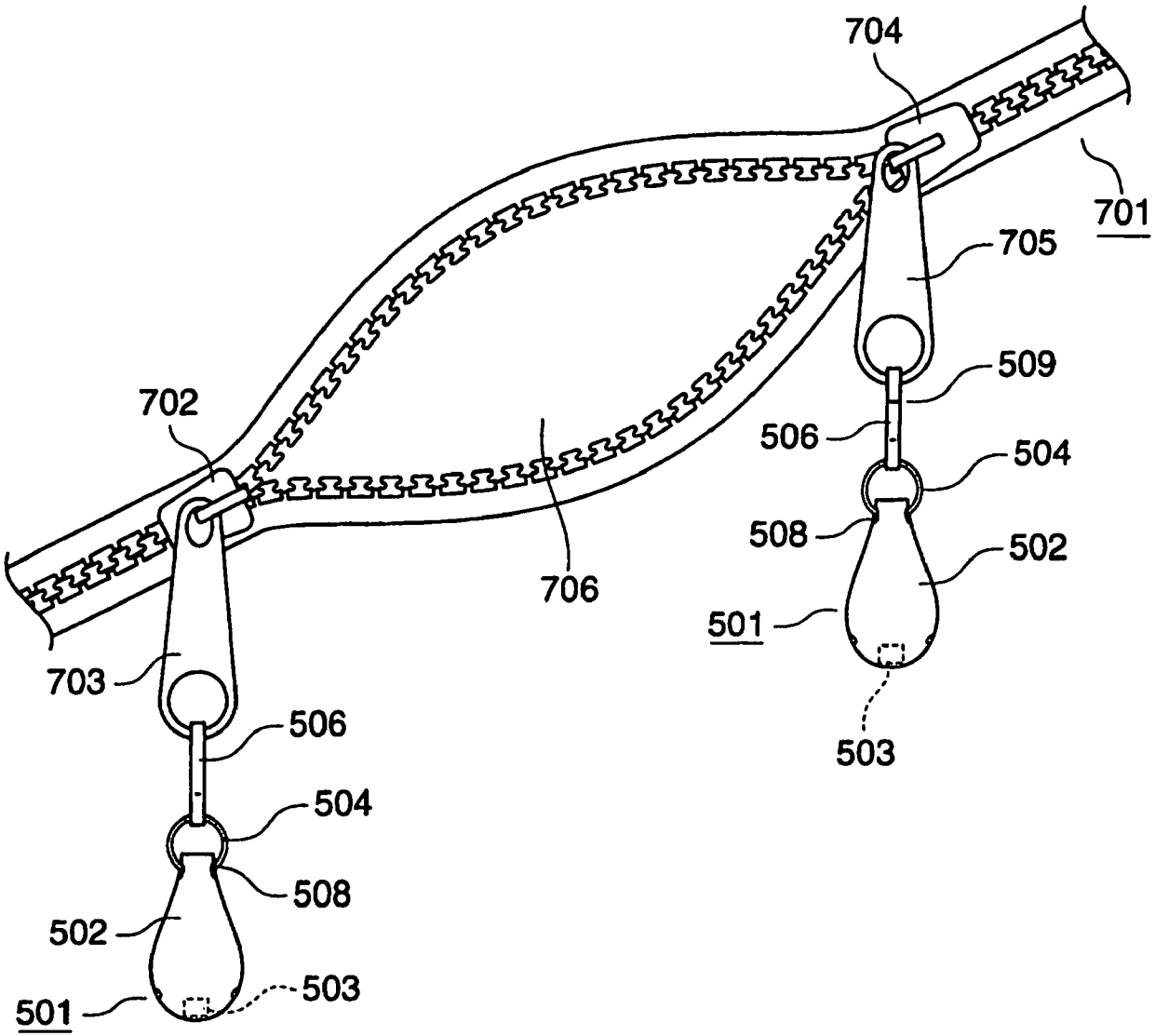

【Fig. 7 B】
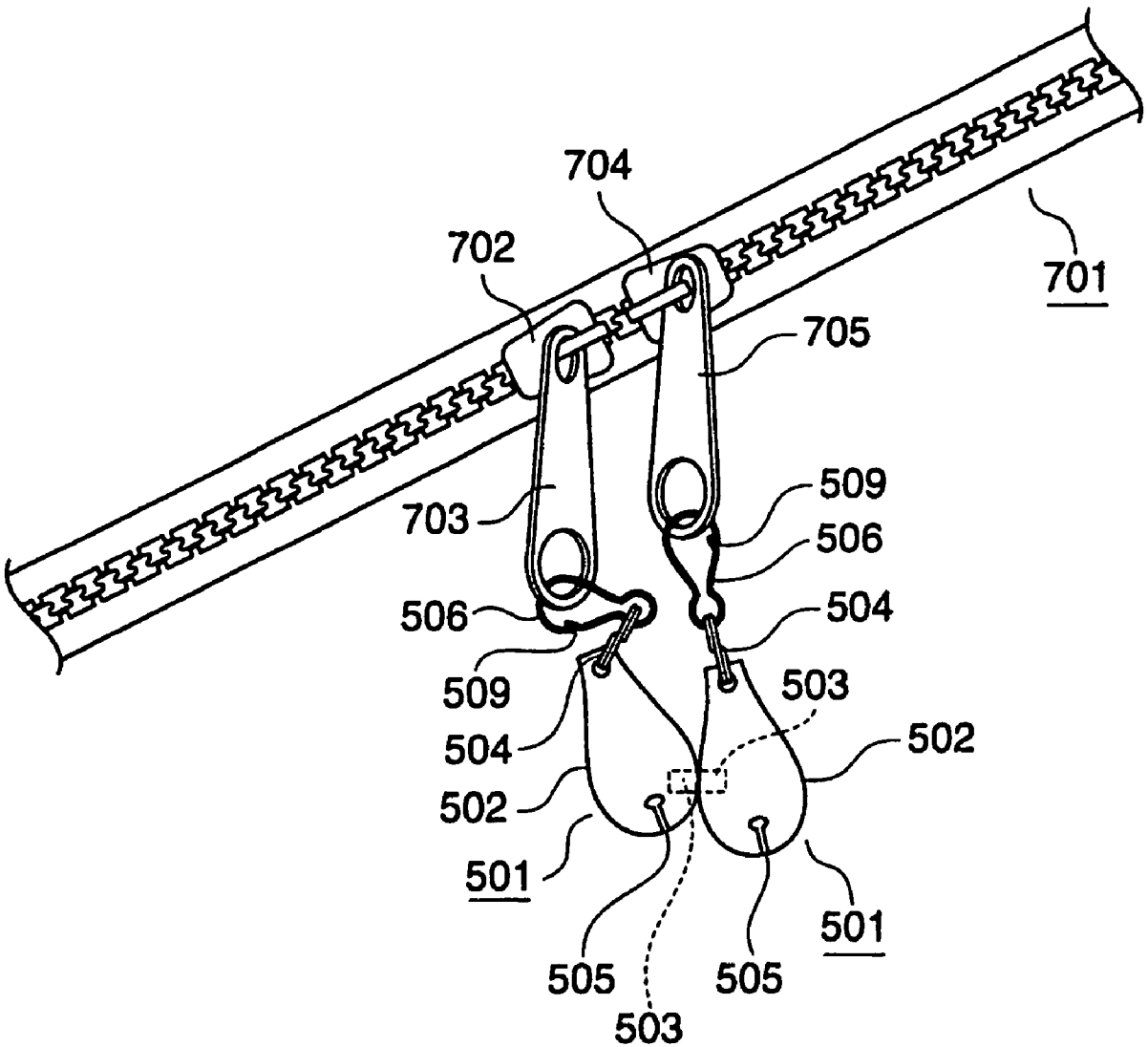

【Fig. 8 A】
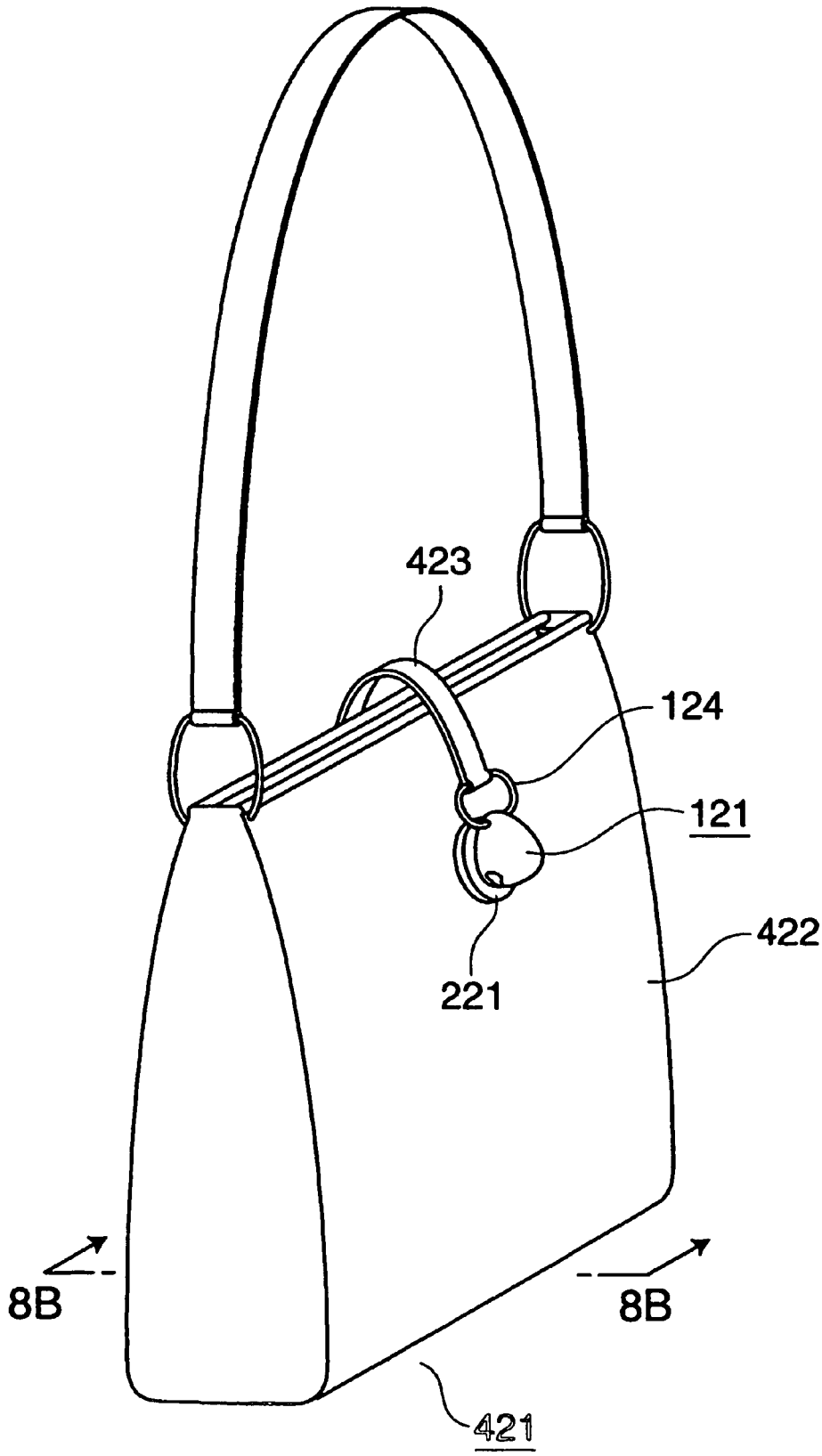

【Fig. 8 B】
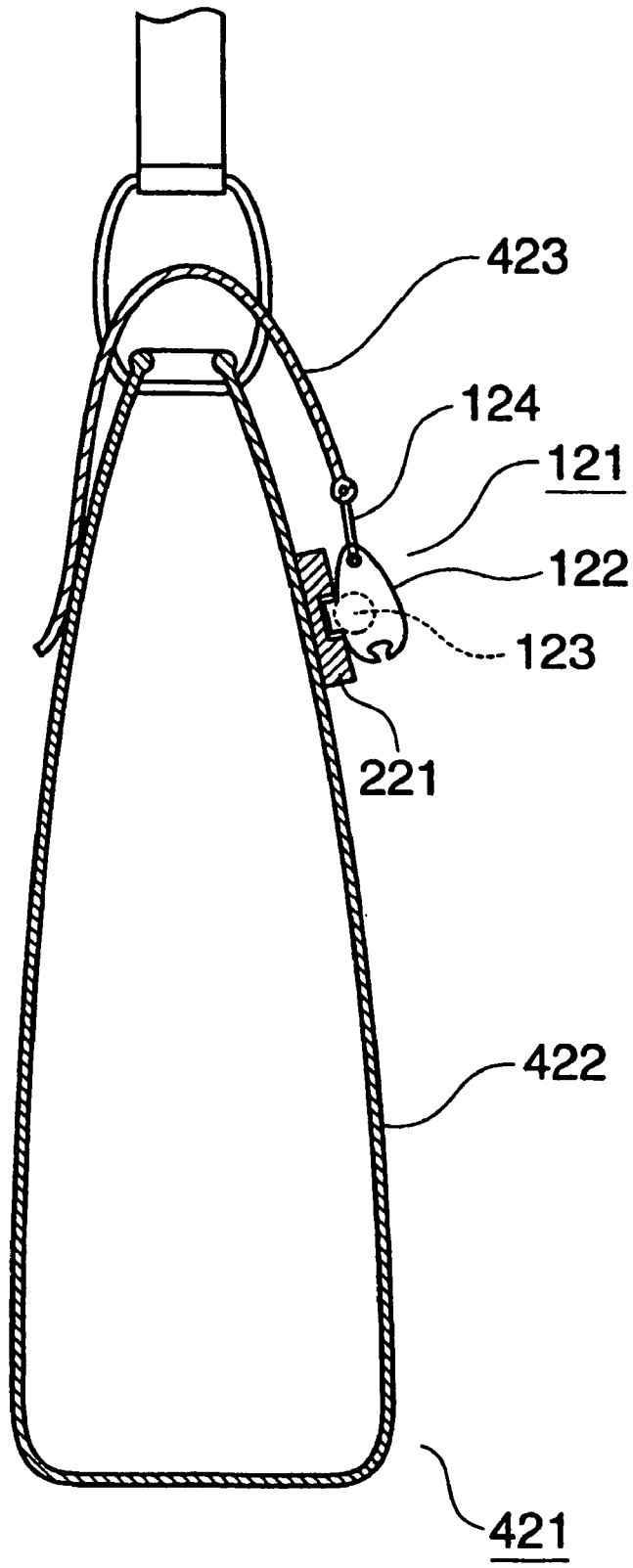

【Fig. 9 A】
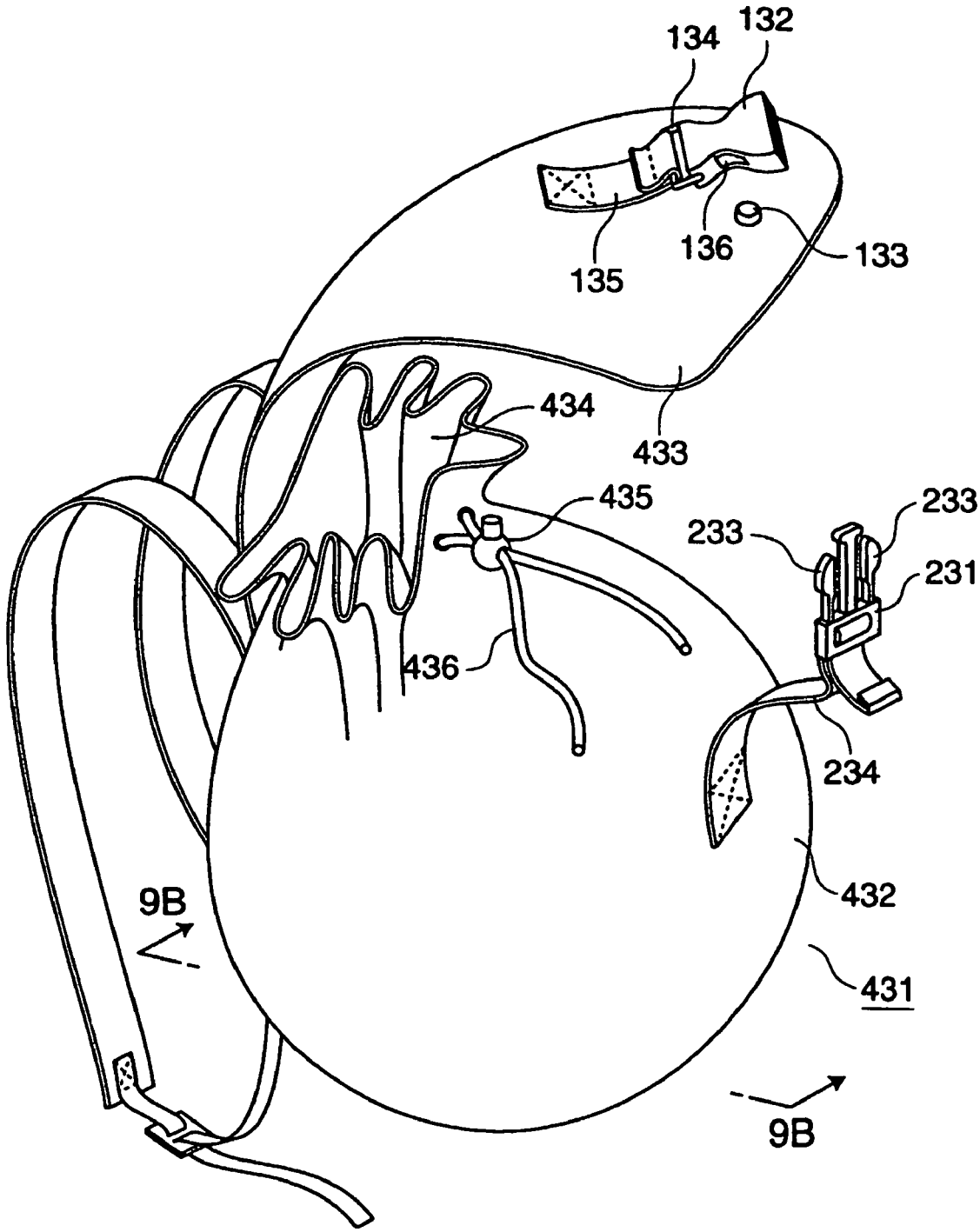

【Fig. 9 B】
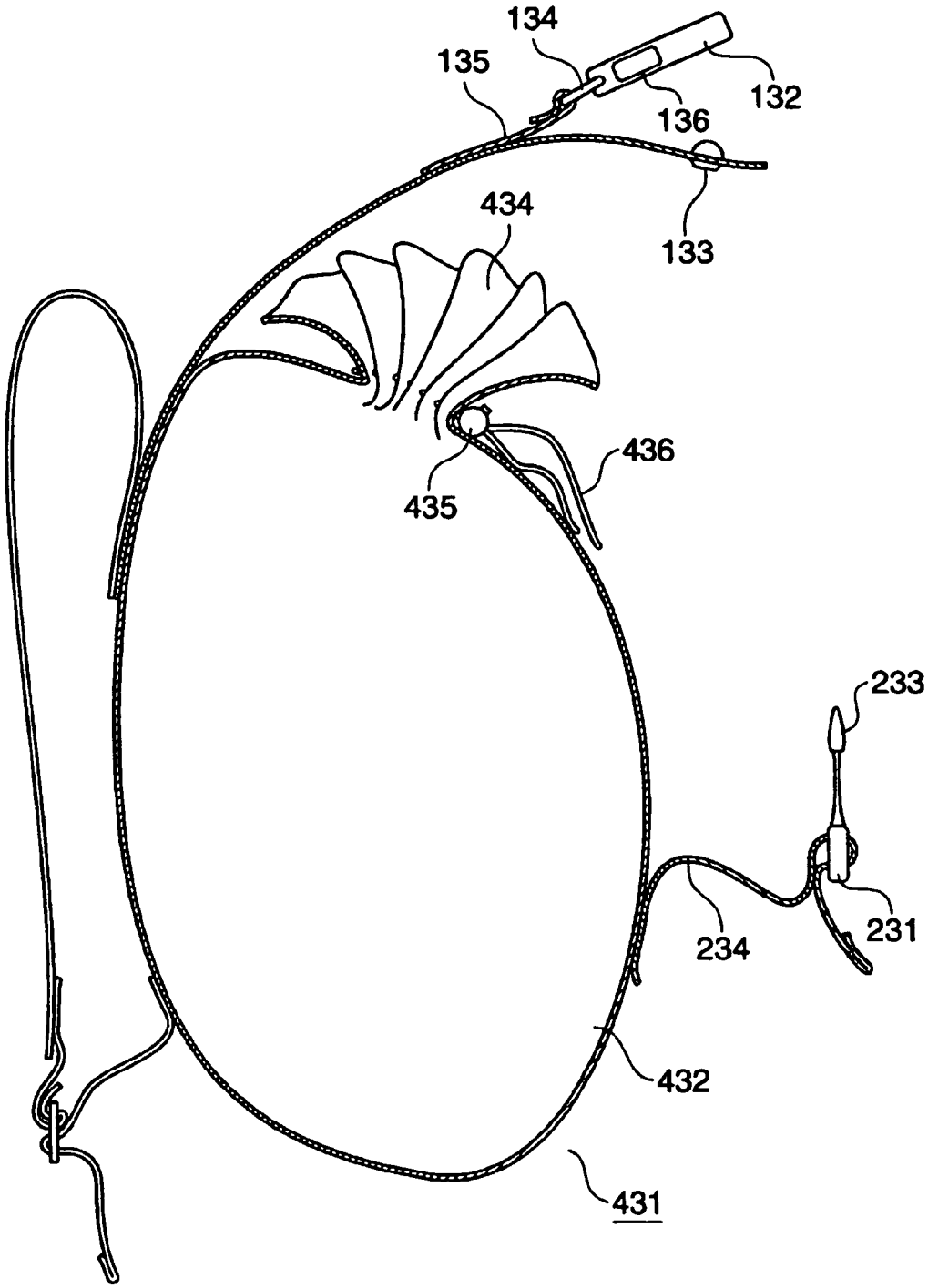

【Fig. 9 C】
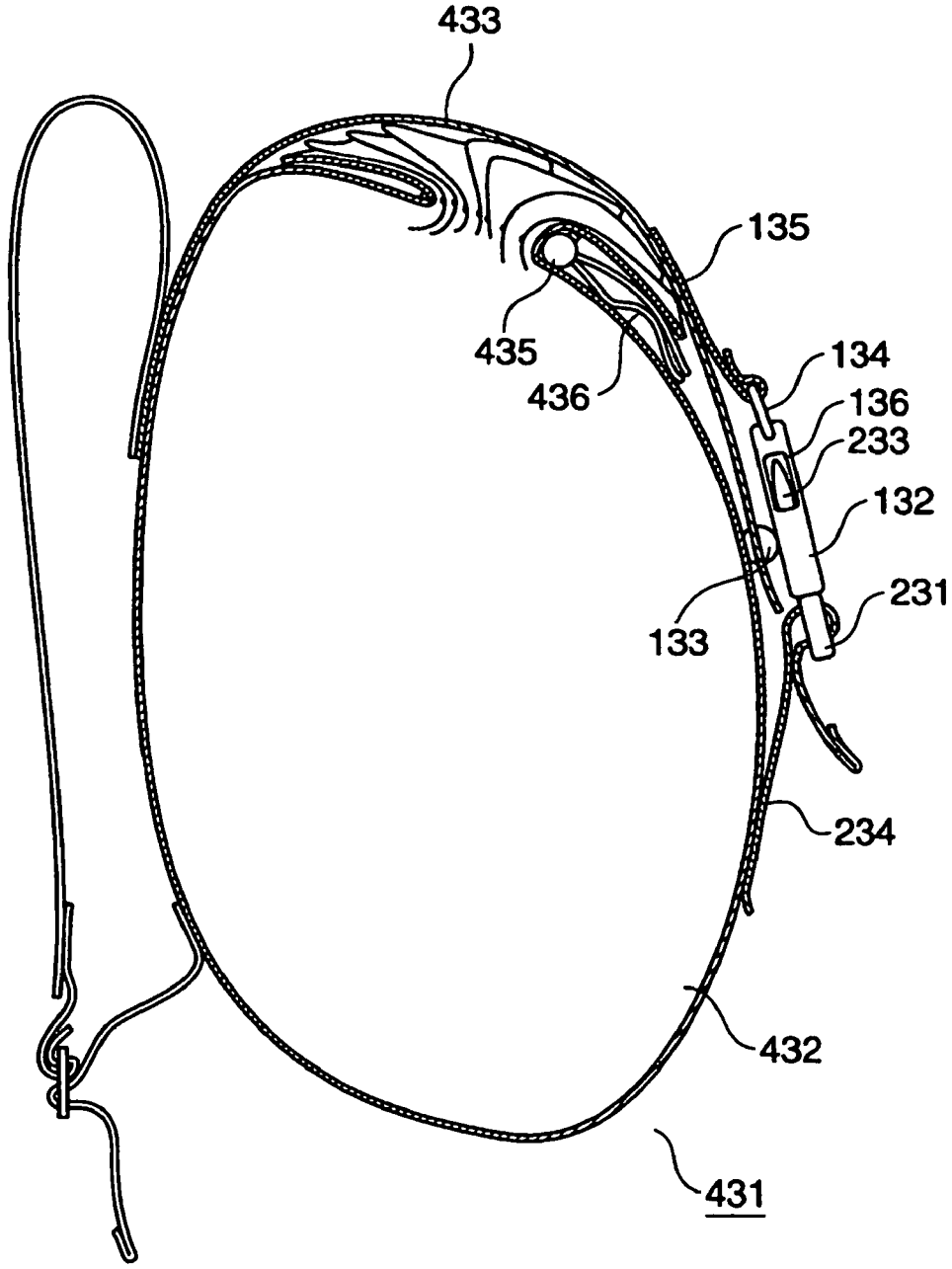

【Fig. 10A】
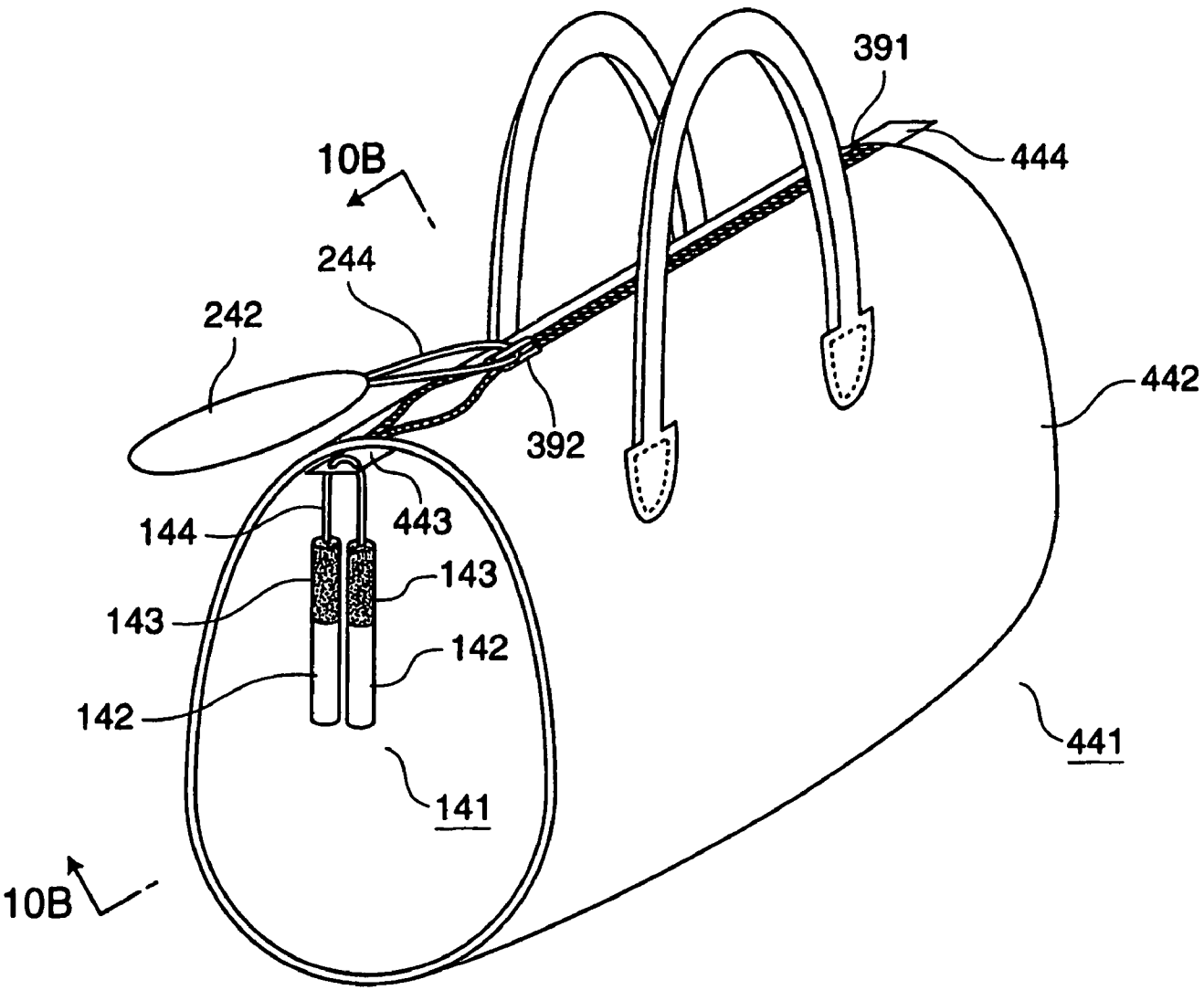

【Fig. 10B】
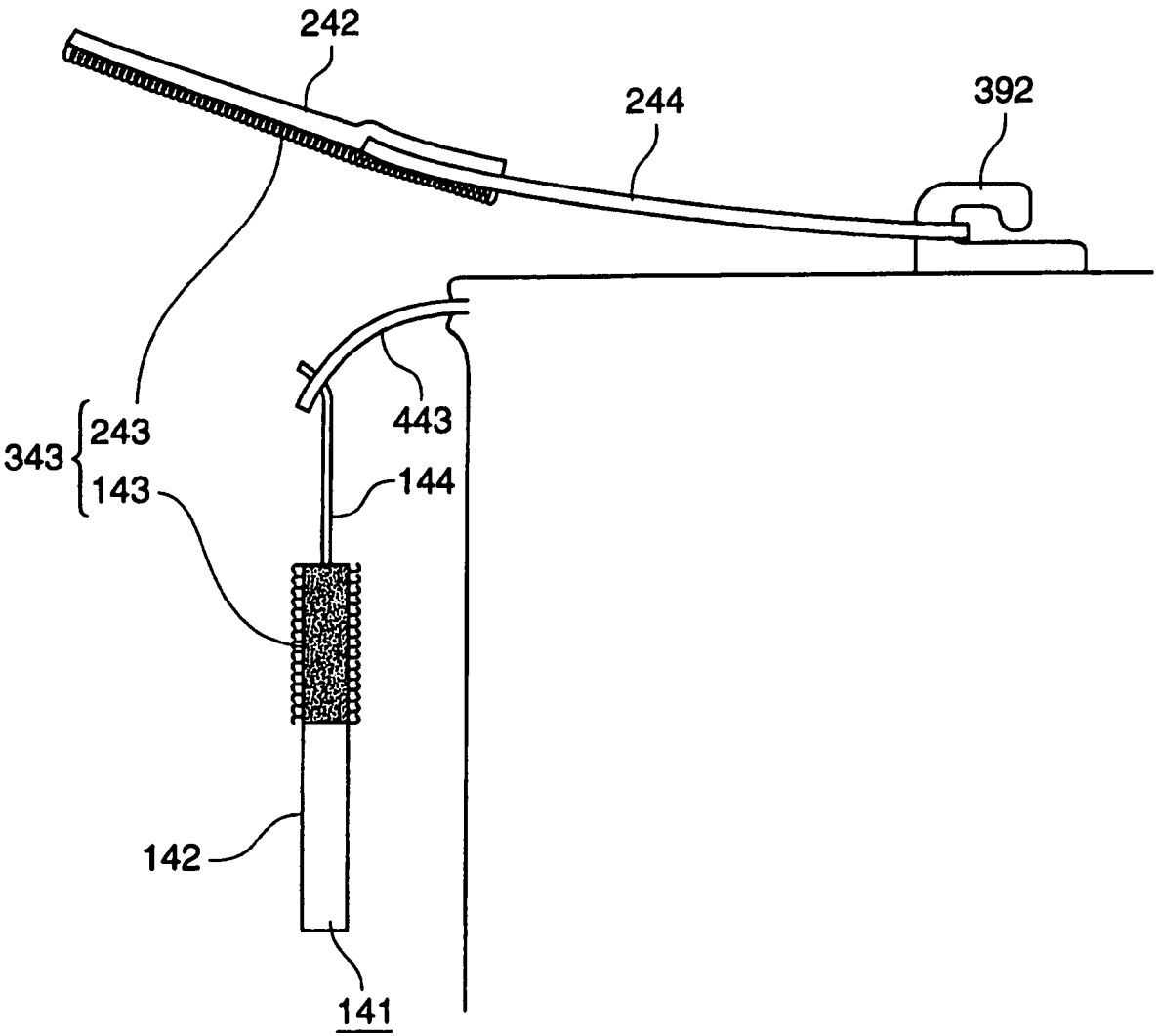

【Fig. 10C】
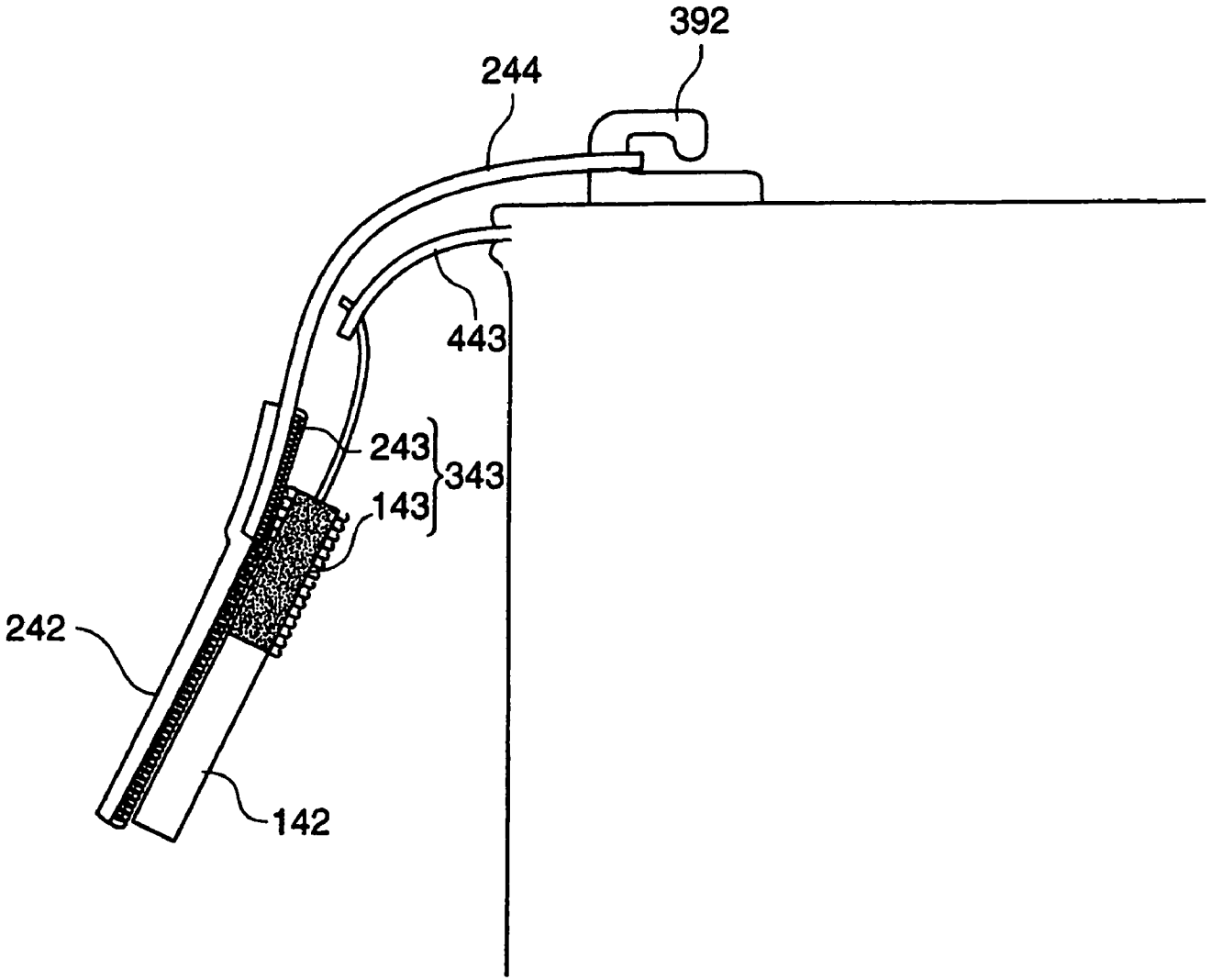

【Fig. 1 1 A】
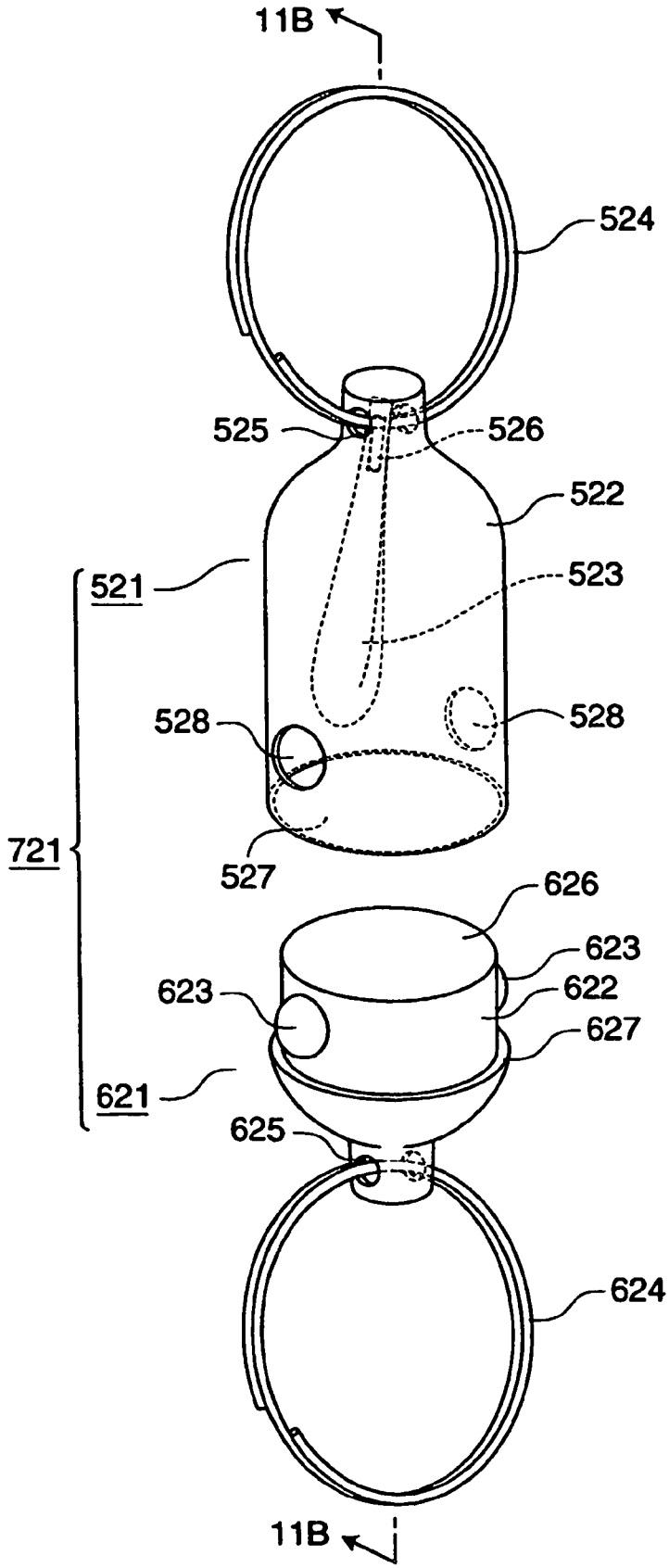

【Fig. 1 1 B】
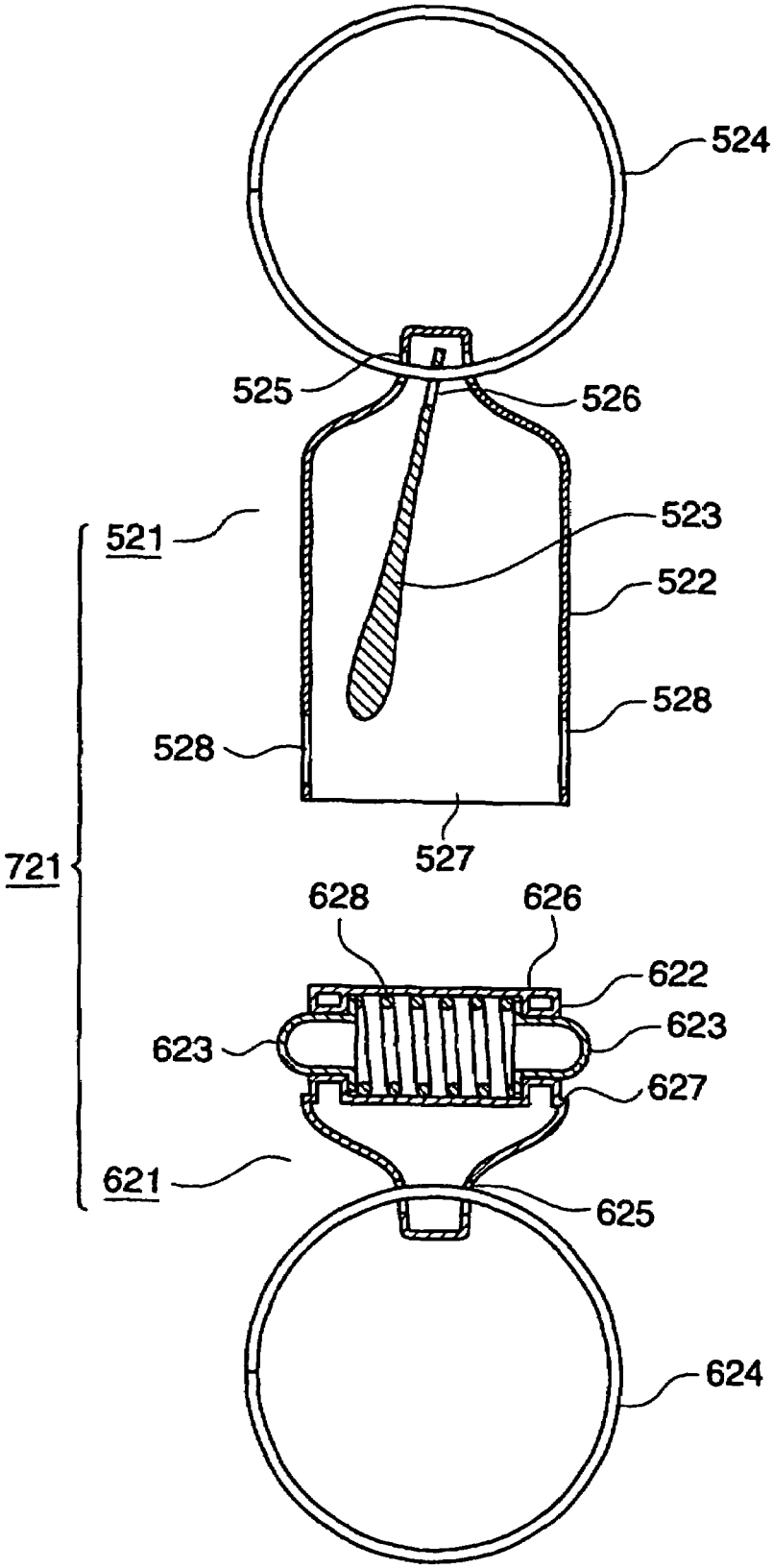

【Fig. 1 1 C】
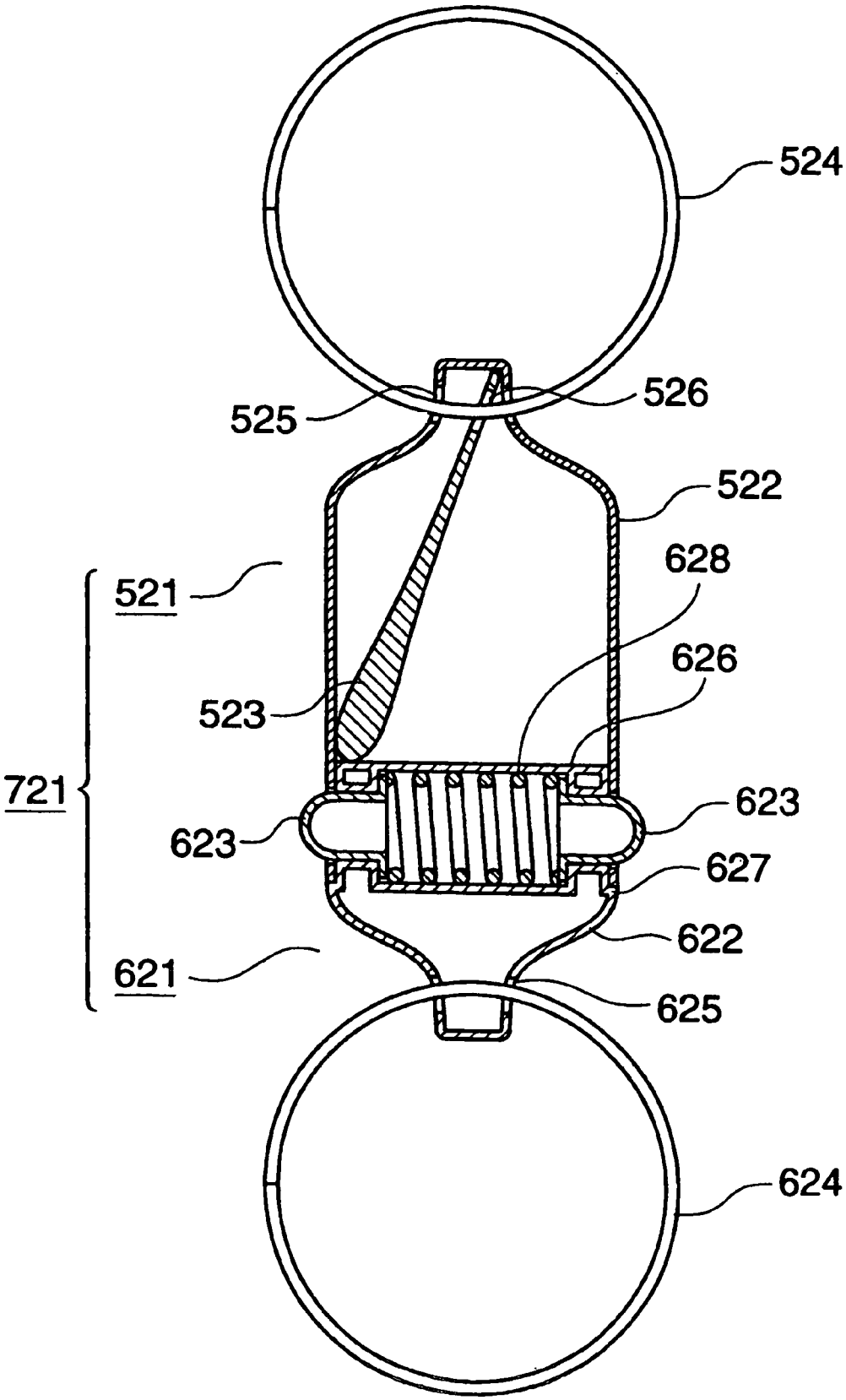

【Fig. 1 2】
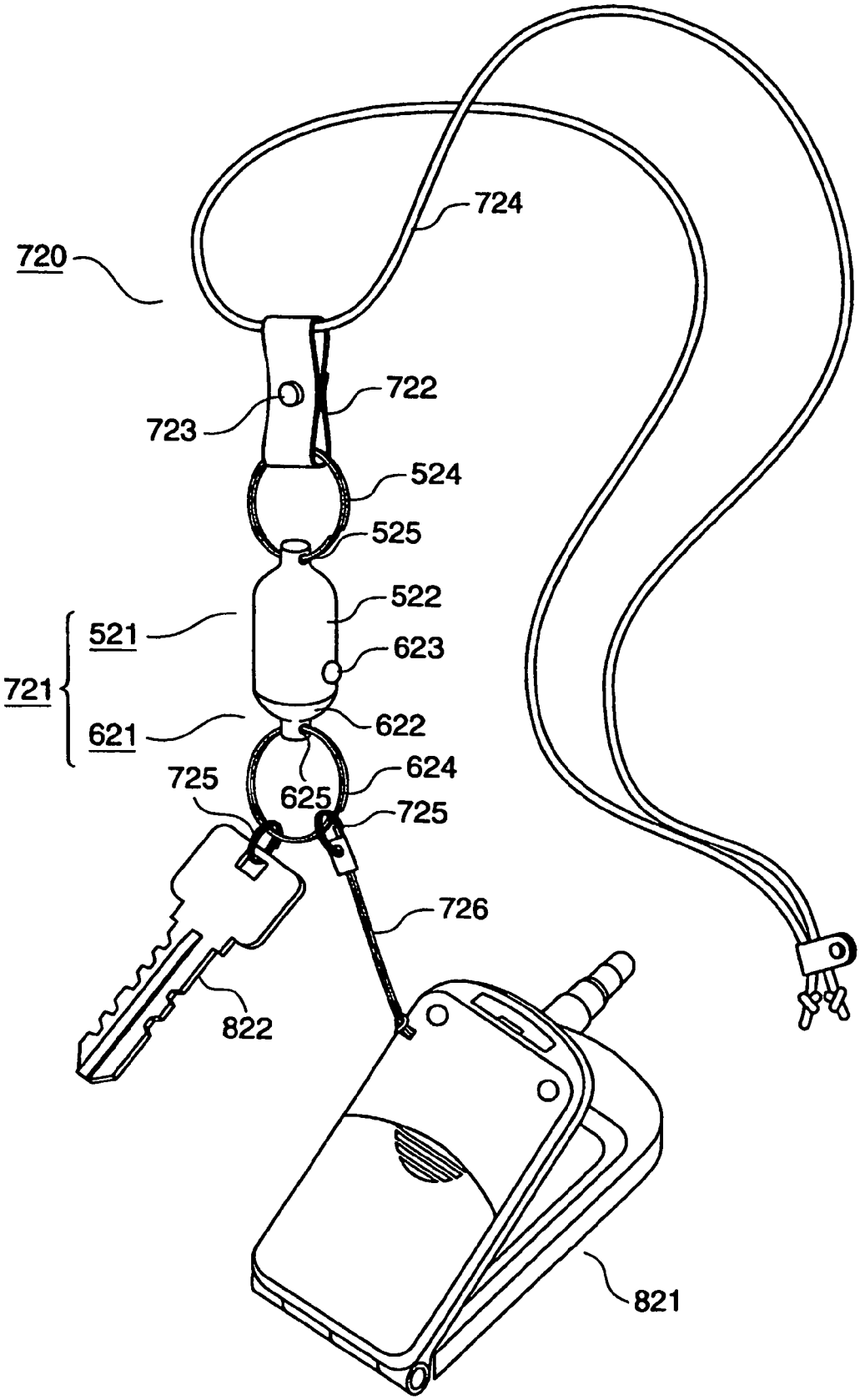

【Fig. 1 3 A】
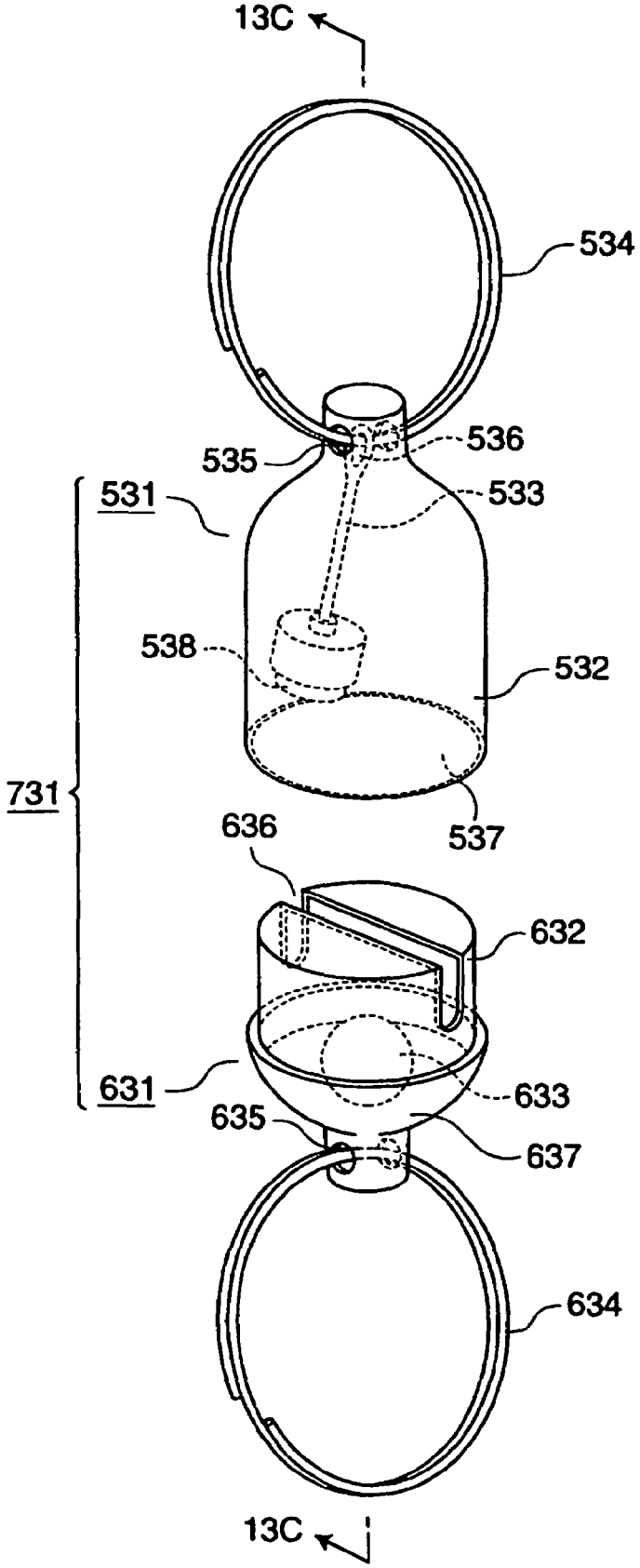

【Fig. 1 3 B】
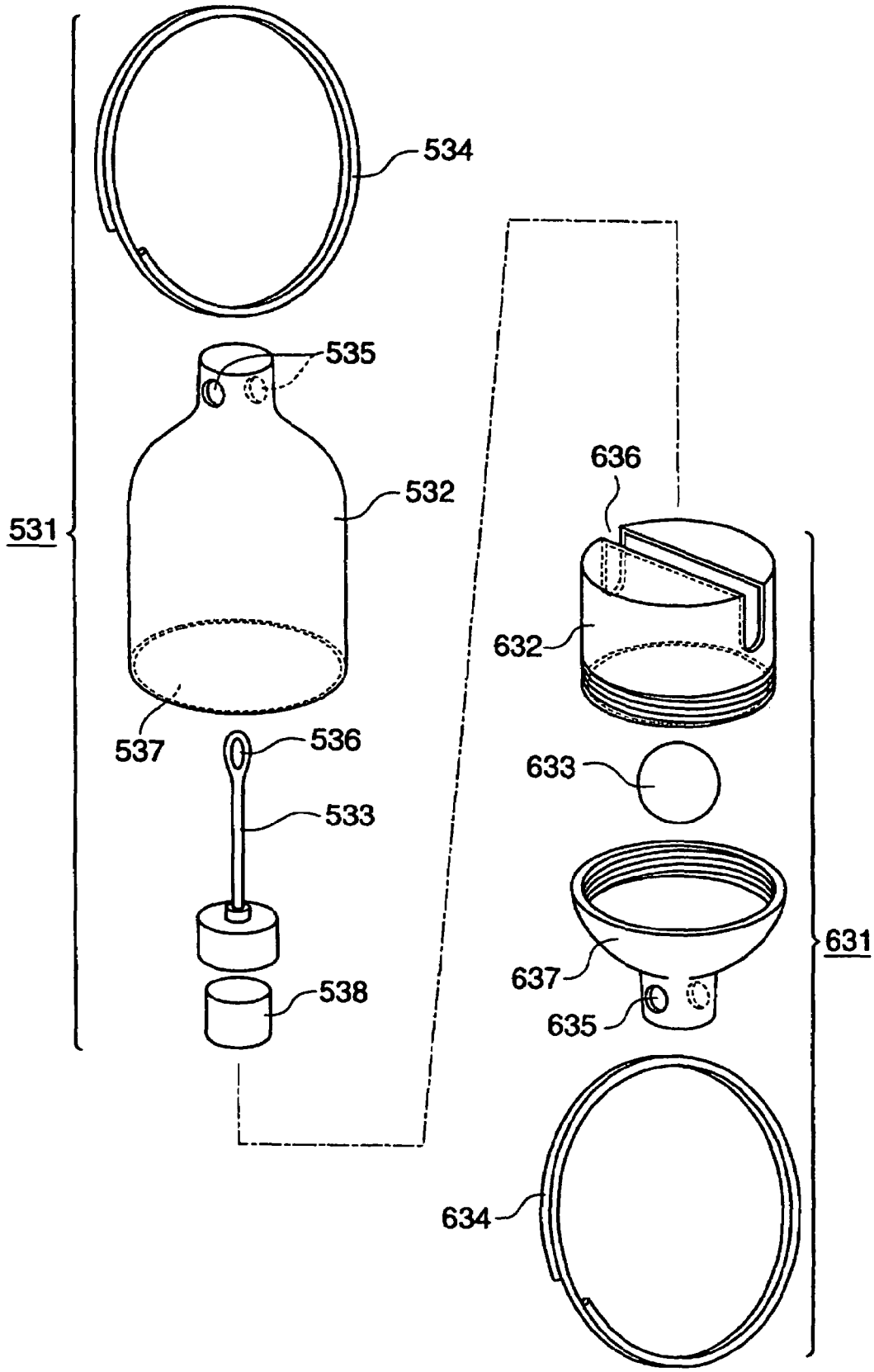

【Fig. 1 3 C】
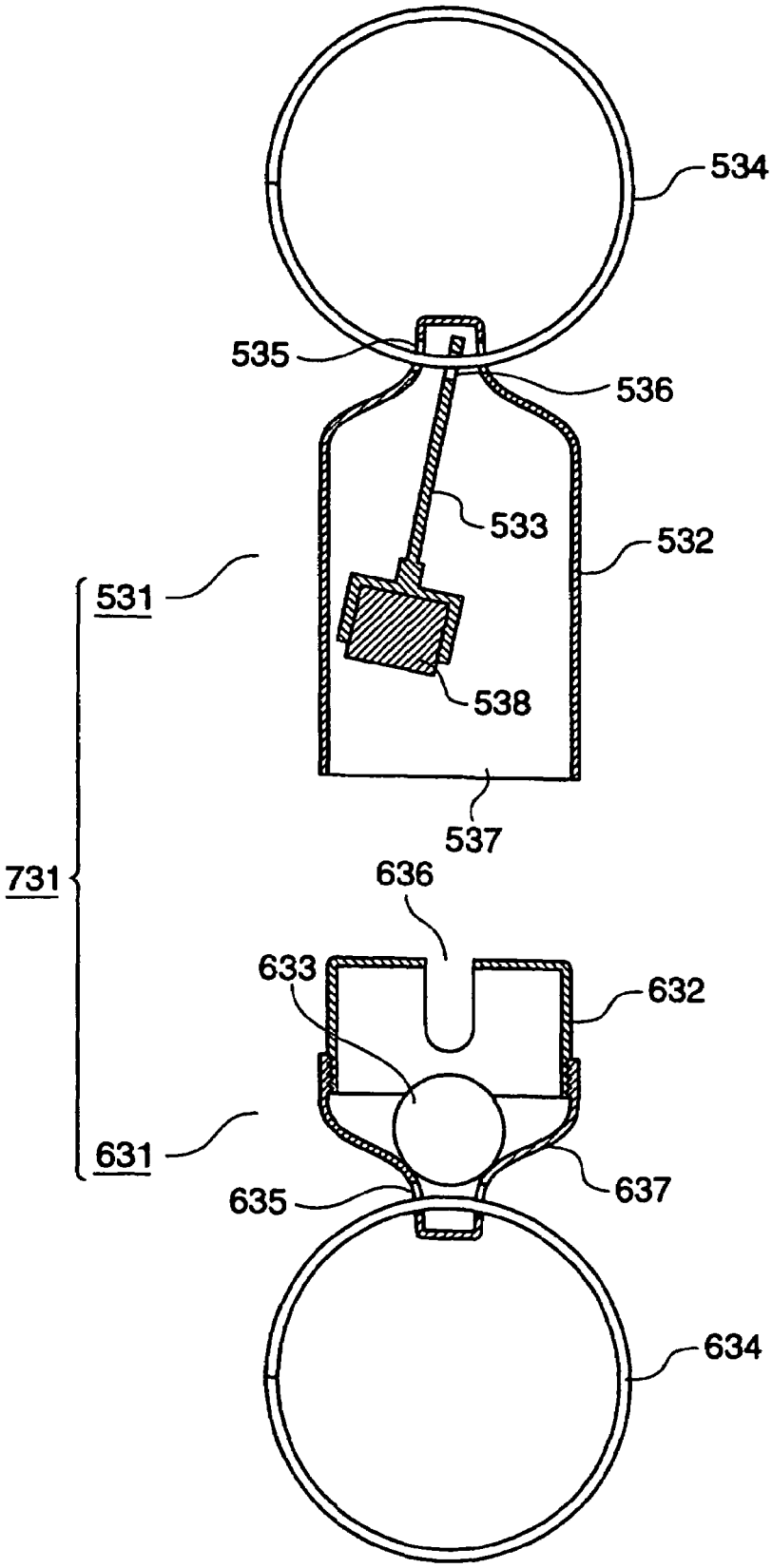

【Fig. 13D】
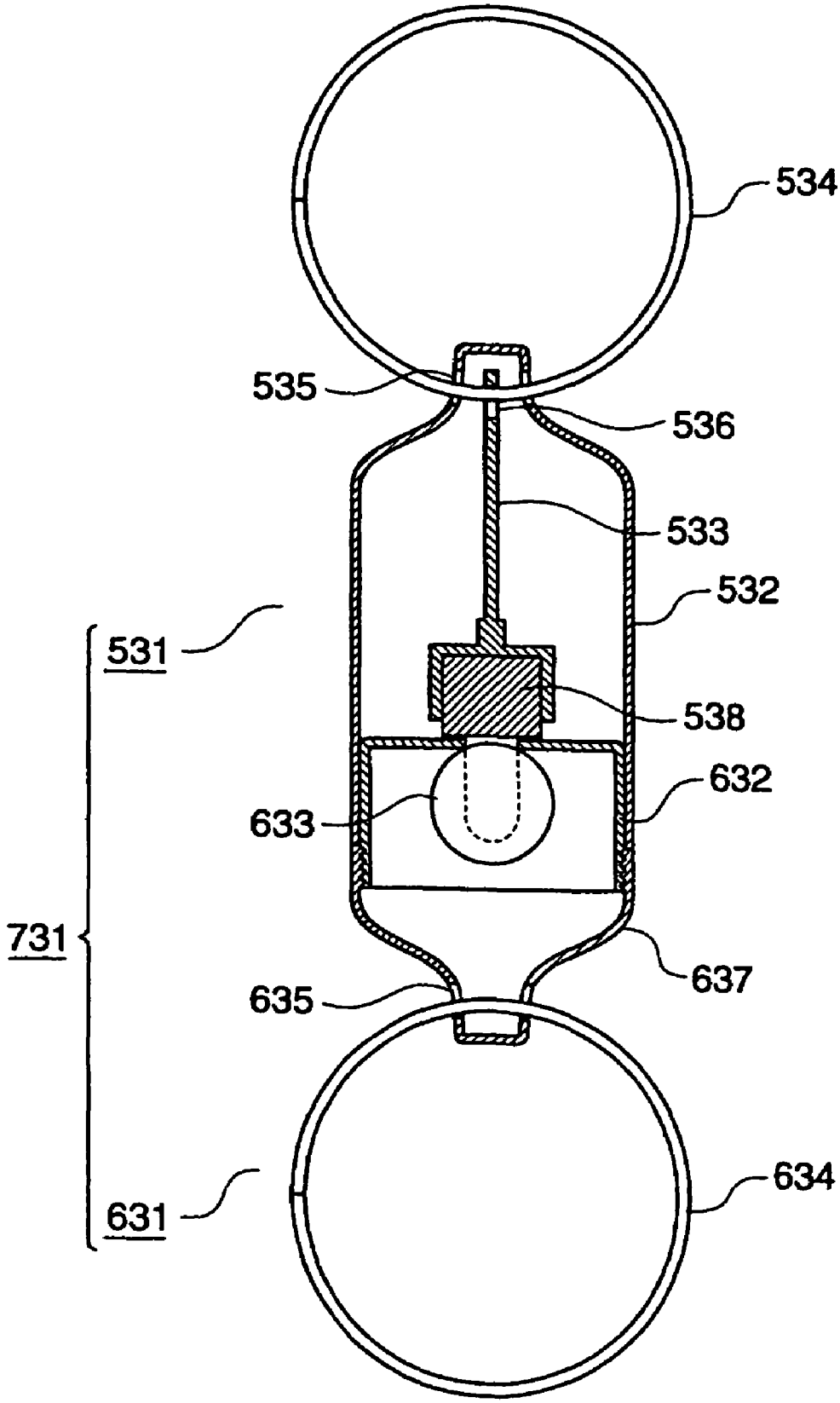

【Fig. 1 4 A】
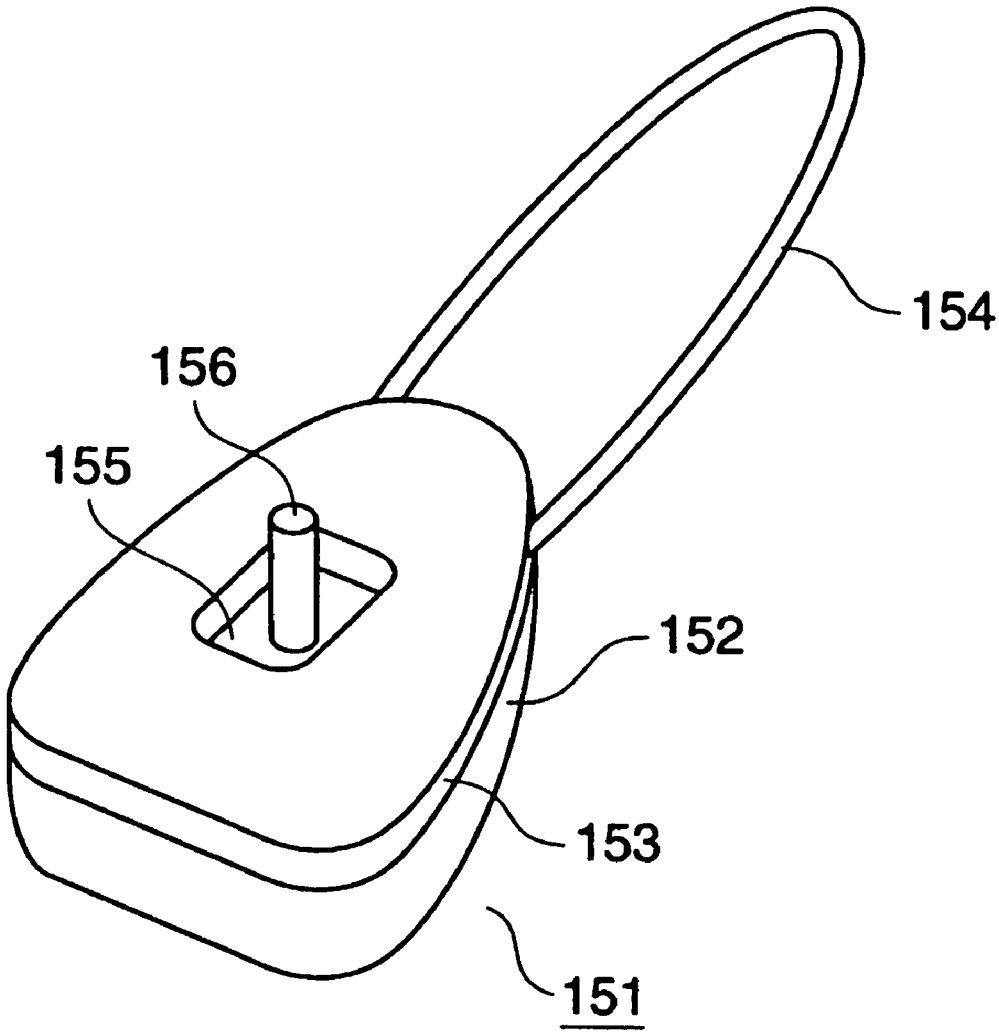

【Fig. 1 4 B】
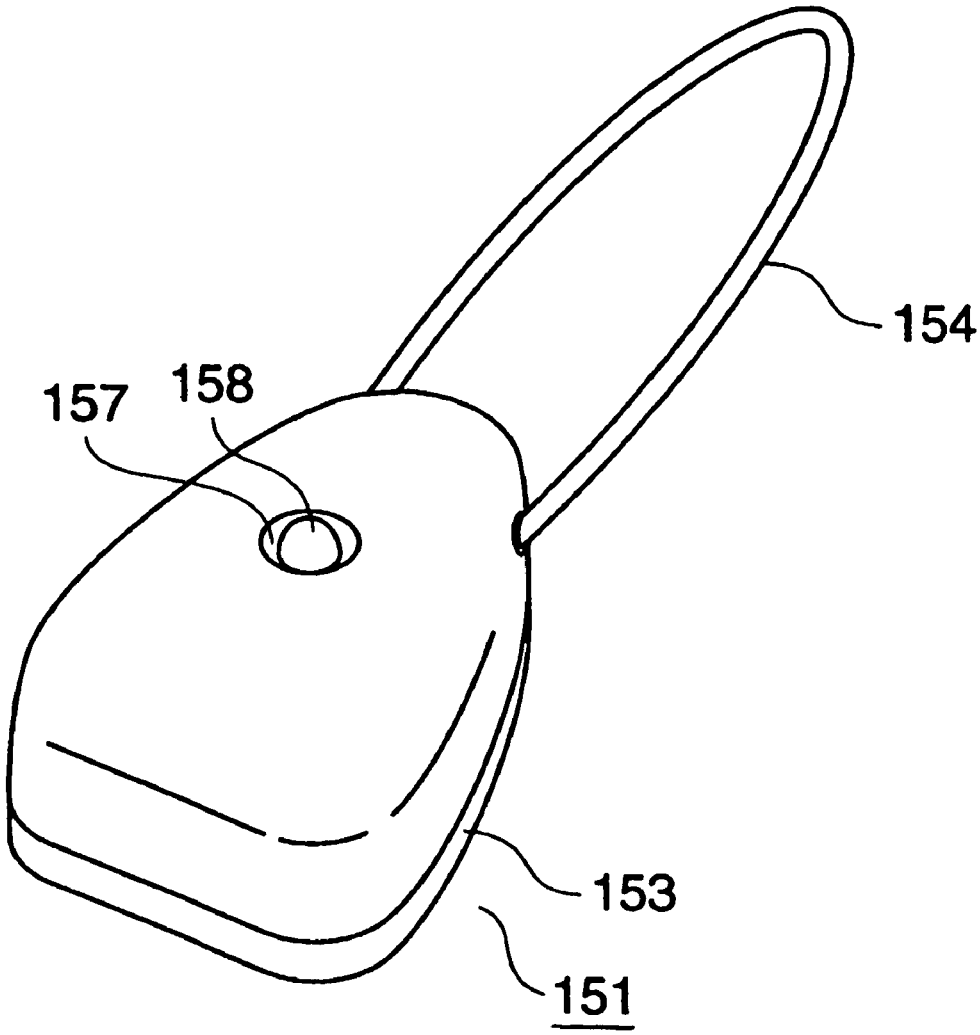

【Fig. 1 4 C】
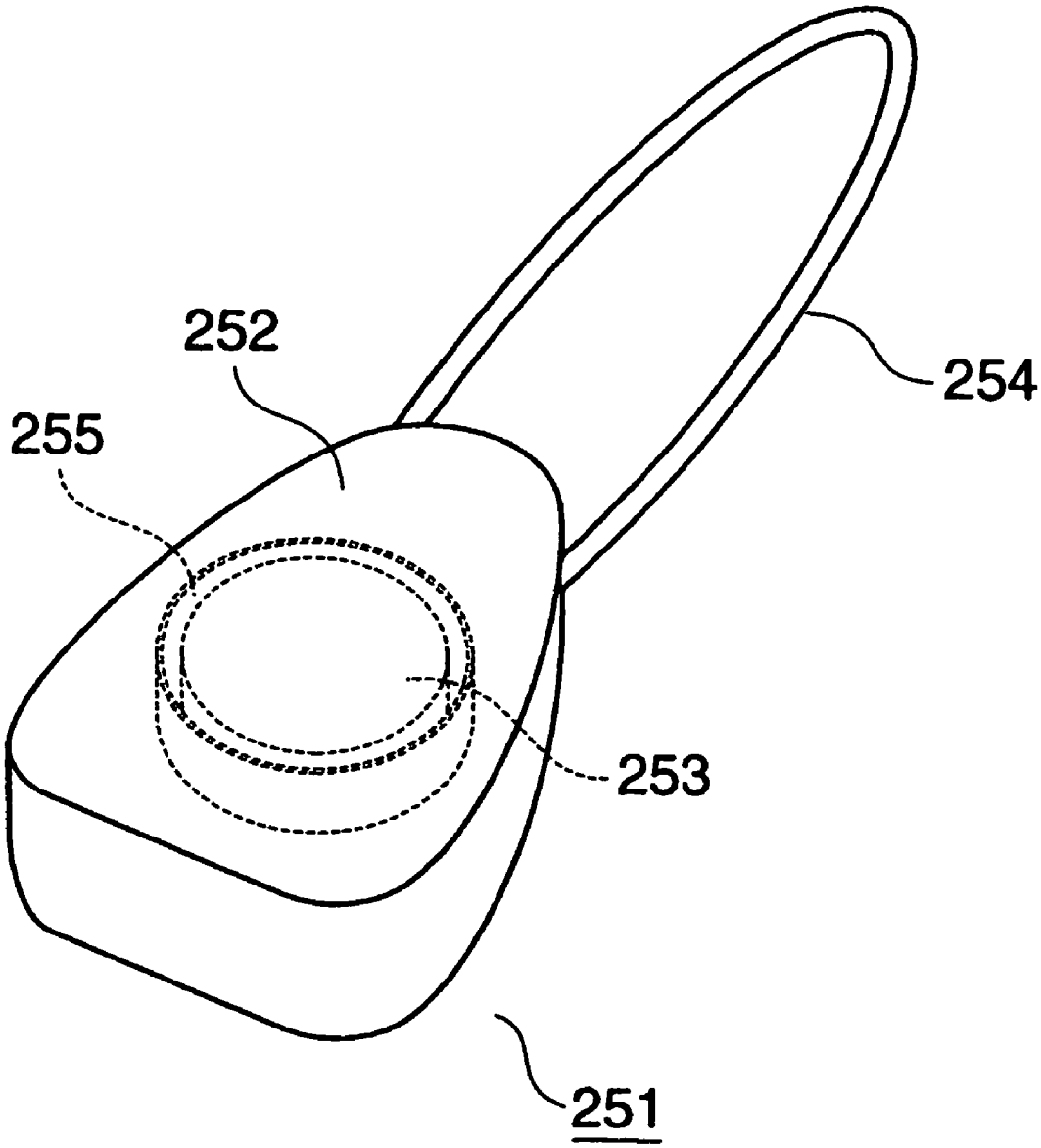

【Fig. 1 4 D】
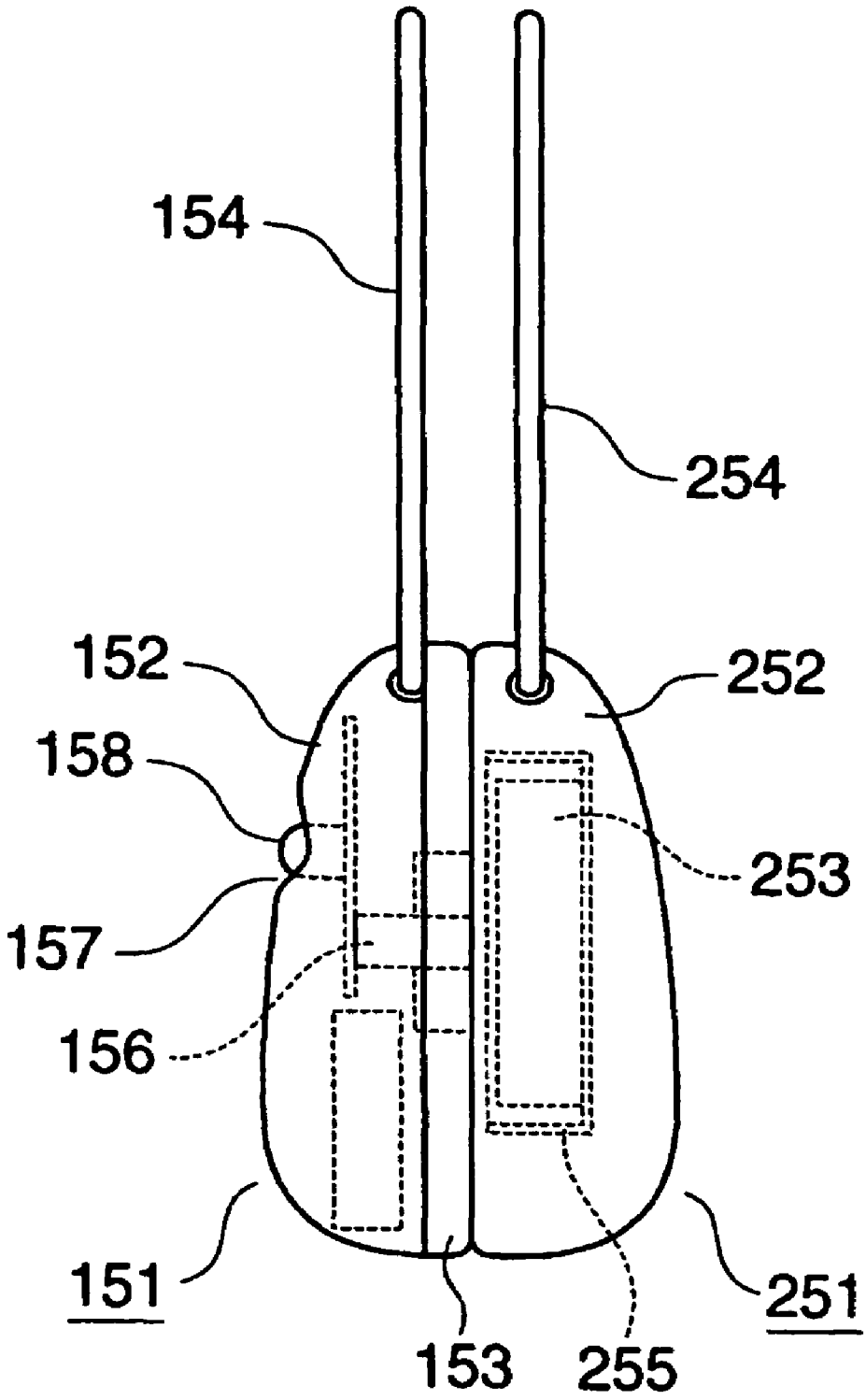

【Fig. 1 5 A】
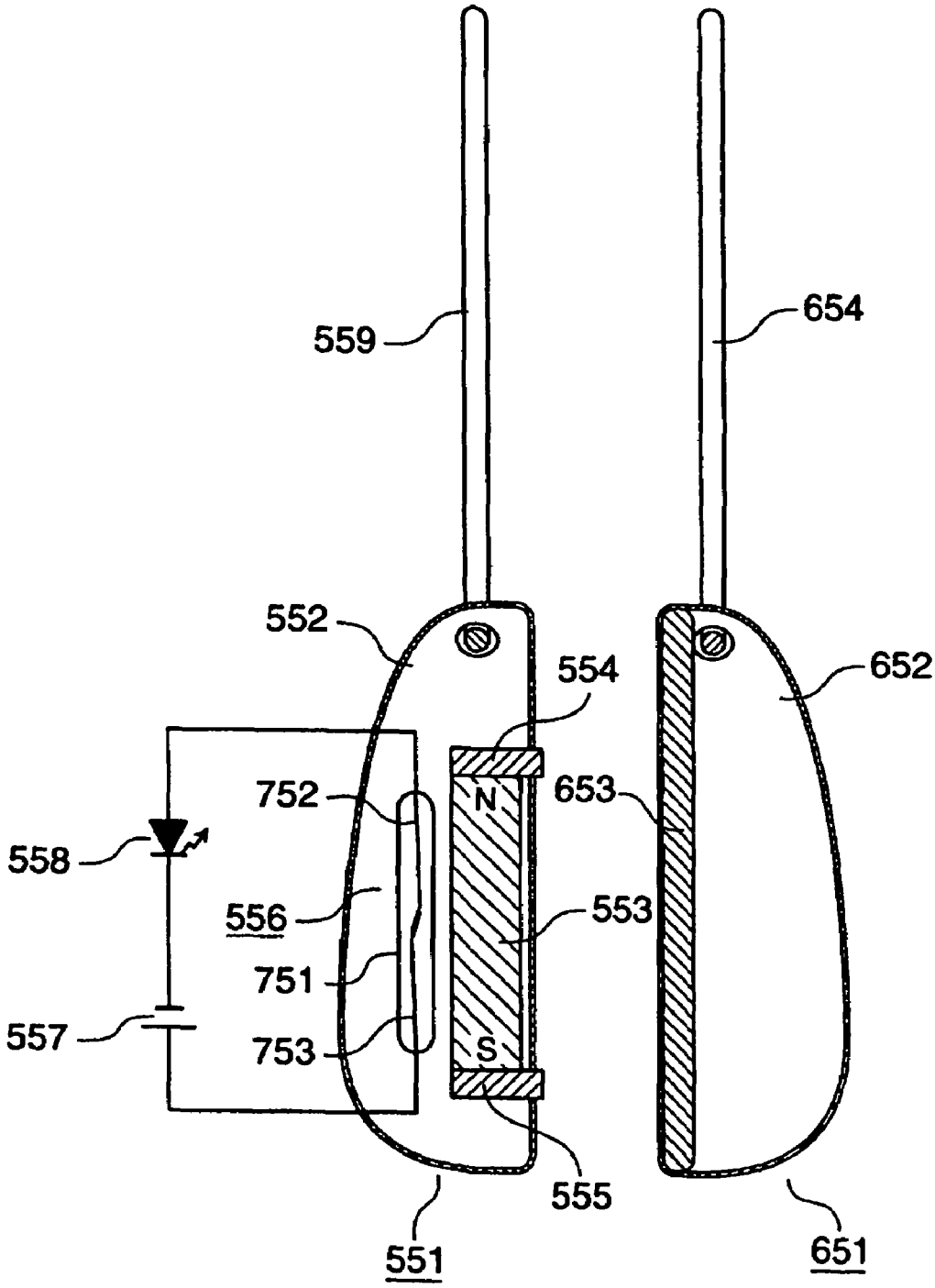

【Fig. 1 5 B】
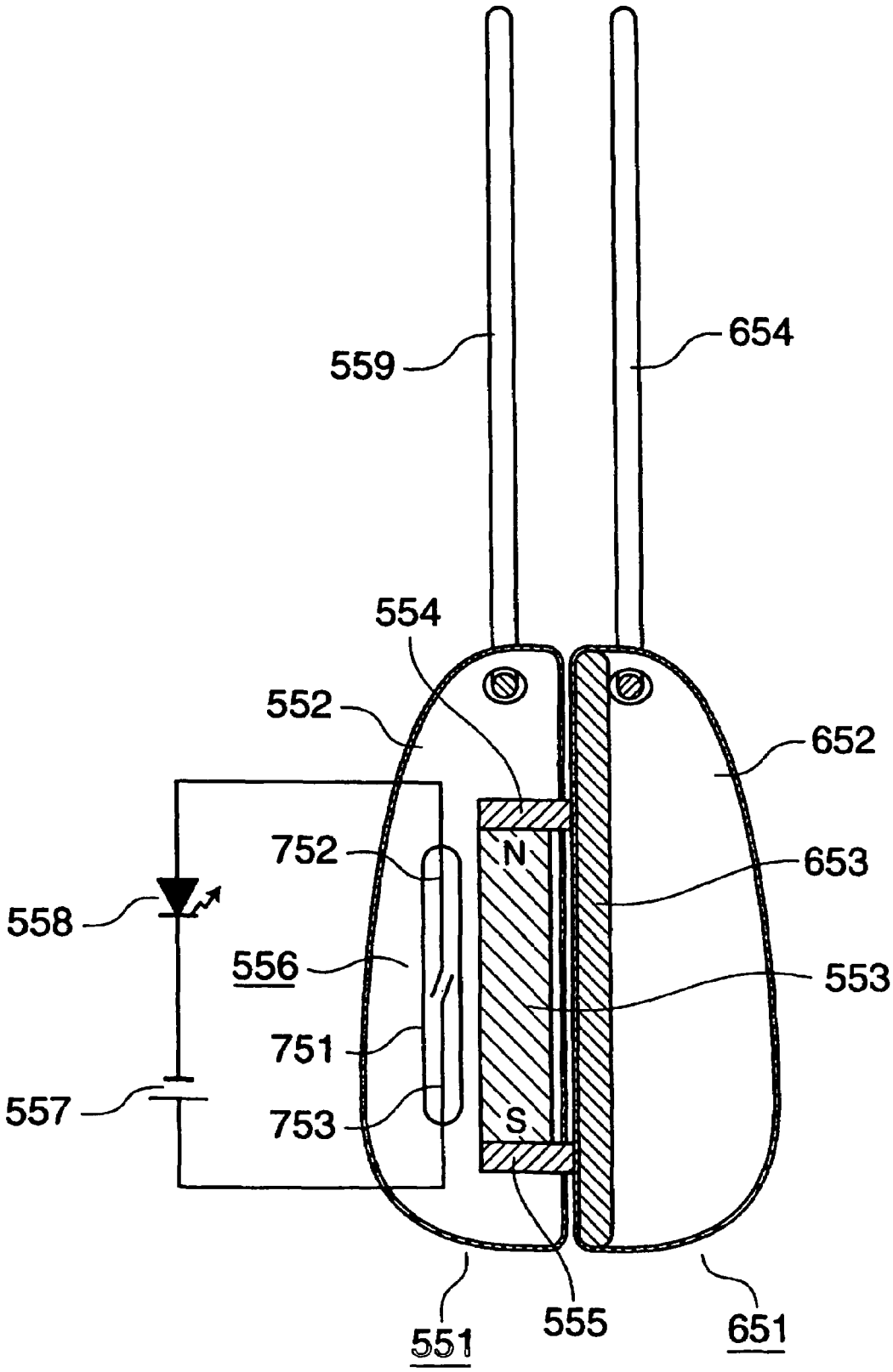

【Fig. 16A】
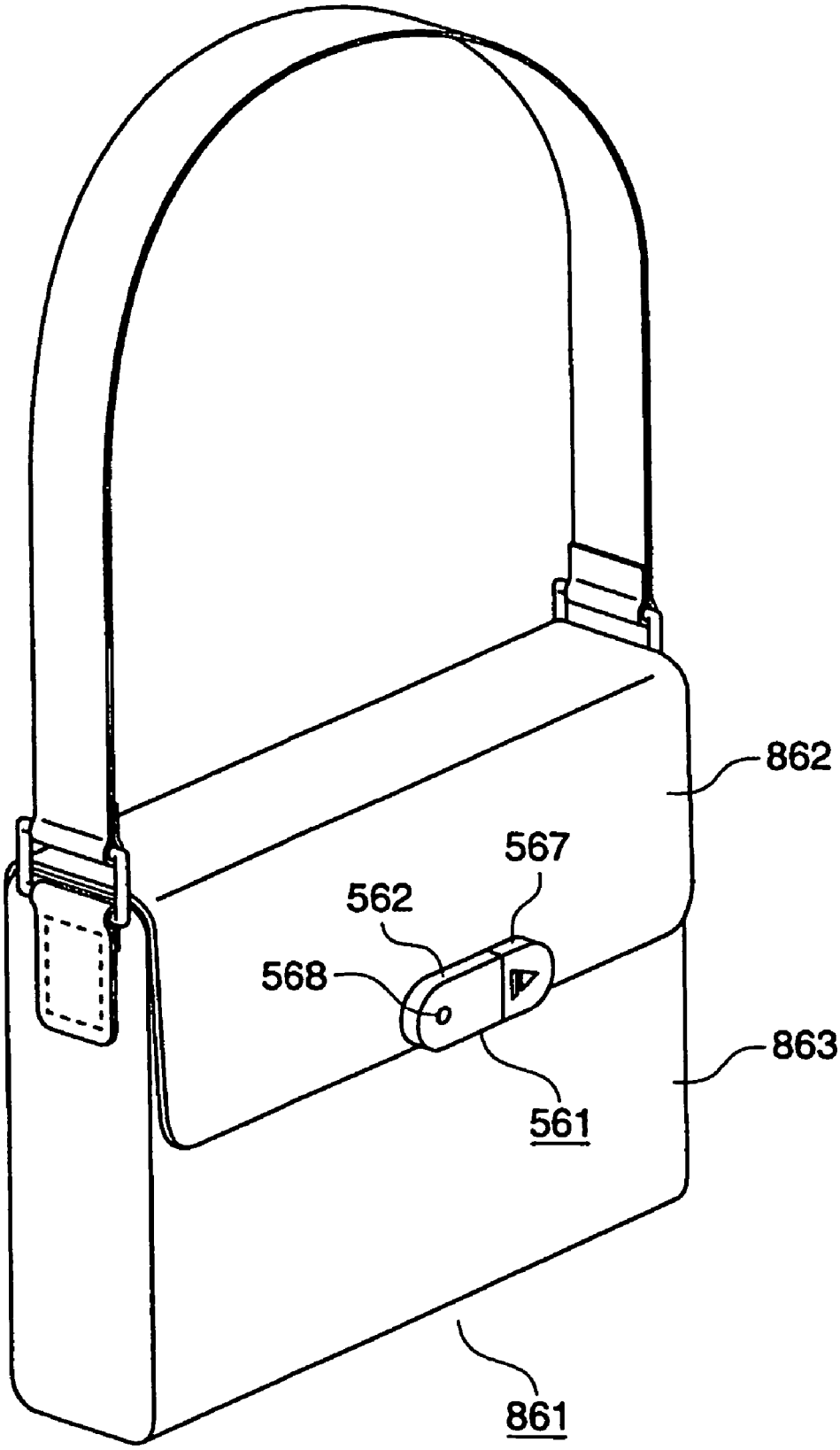

【Fig. 16B】
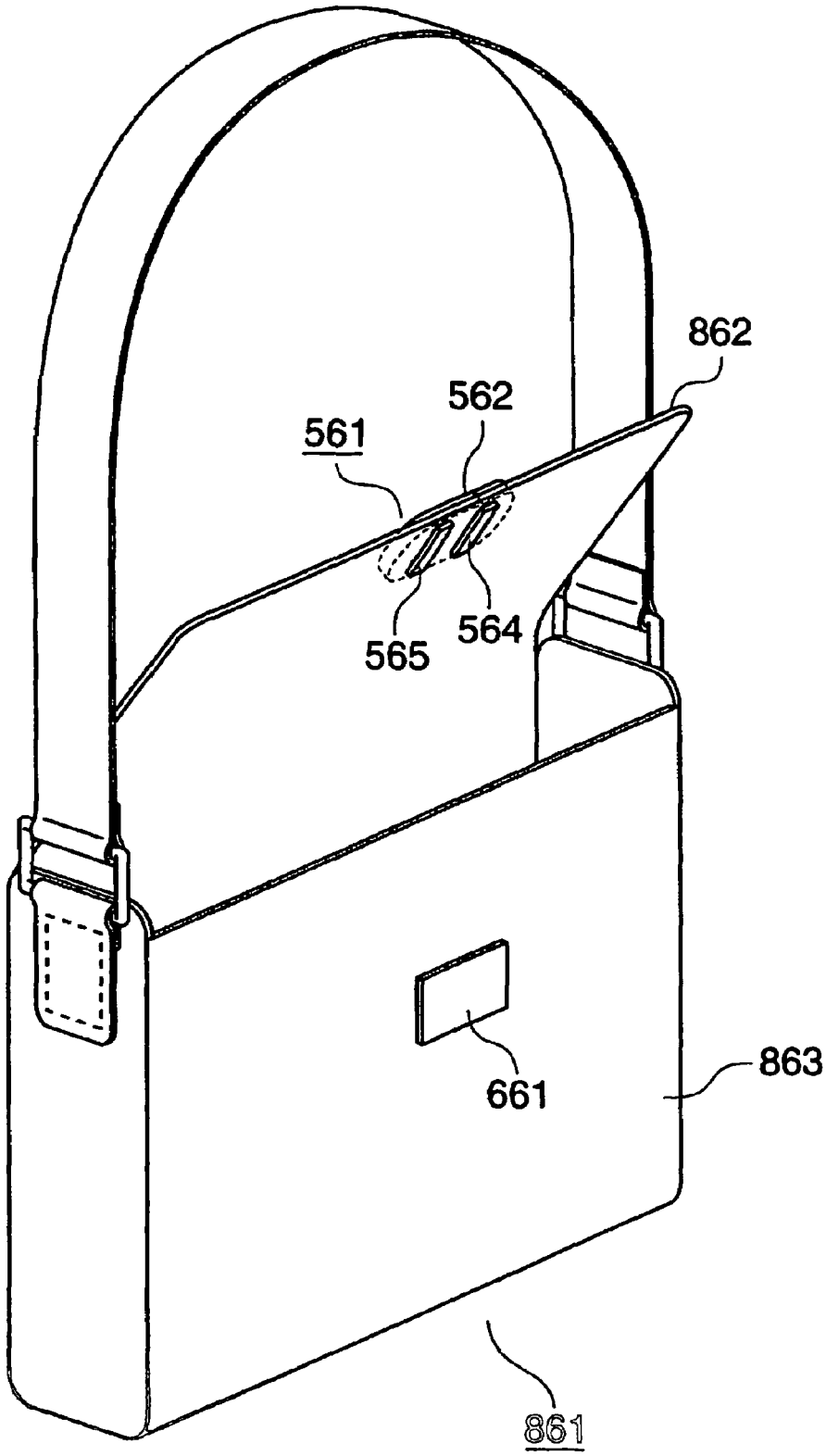

【Fig. 17】
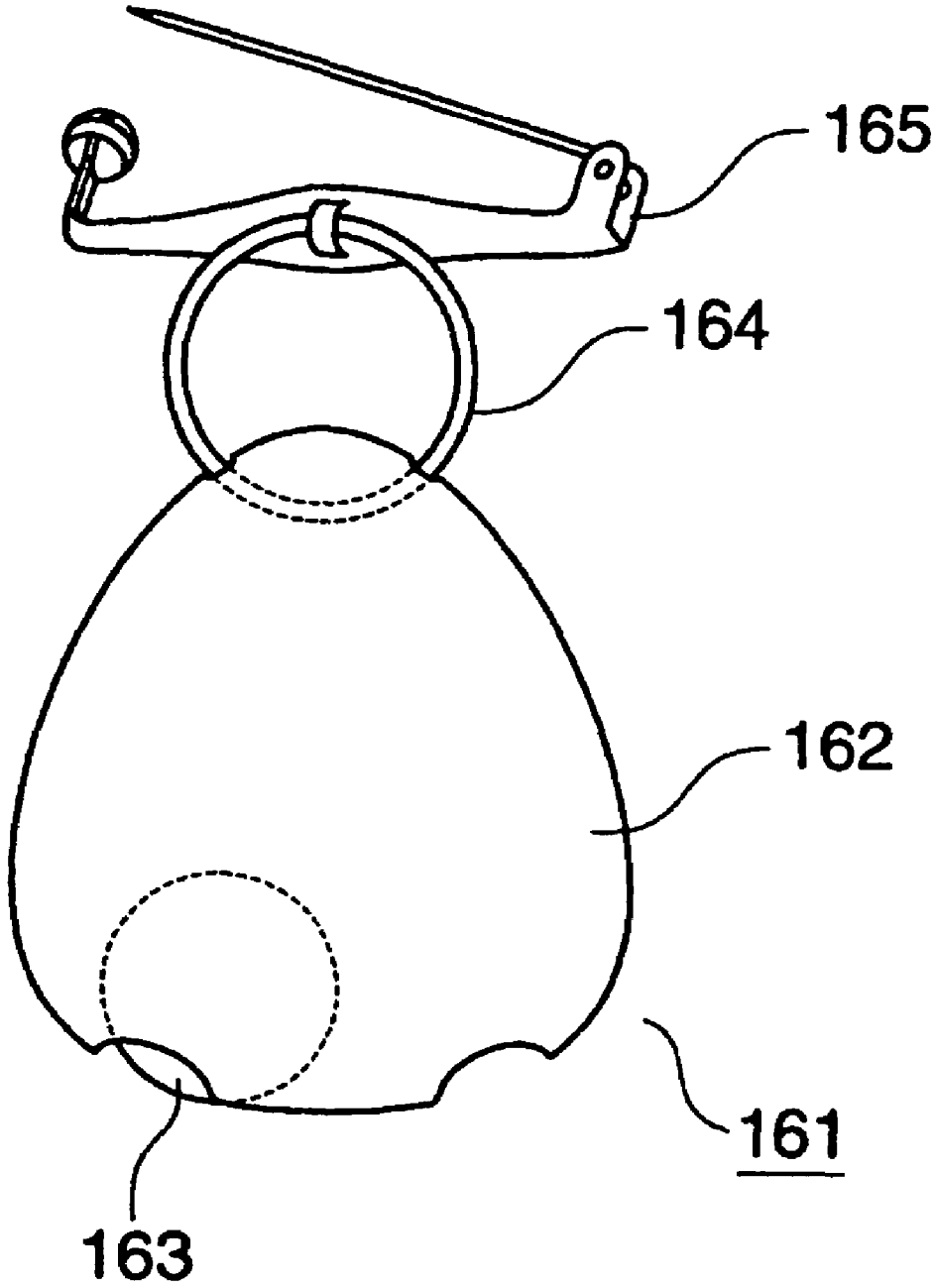

【Fig. 1 8】
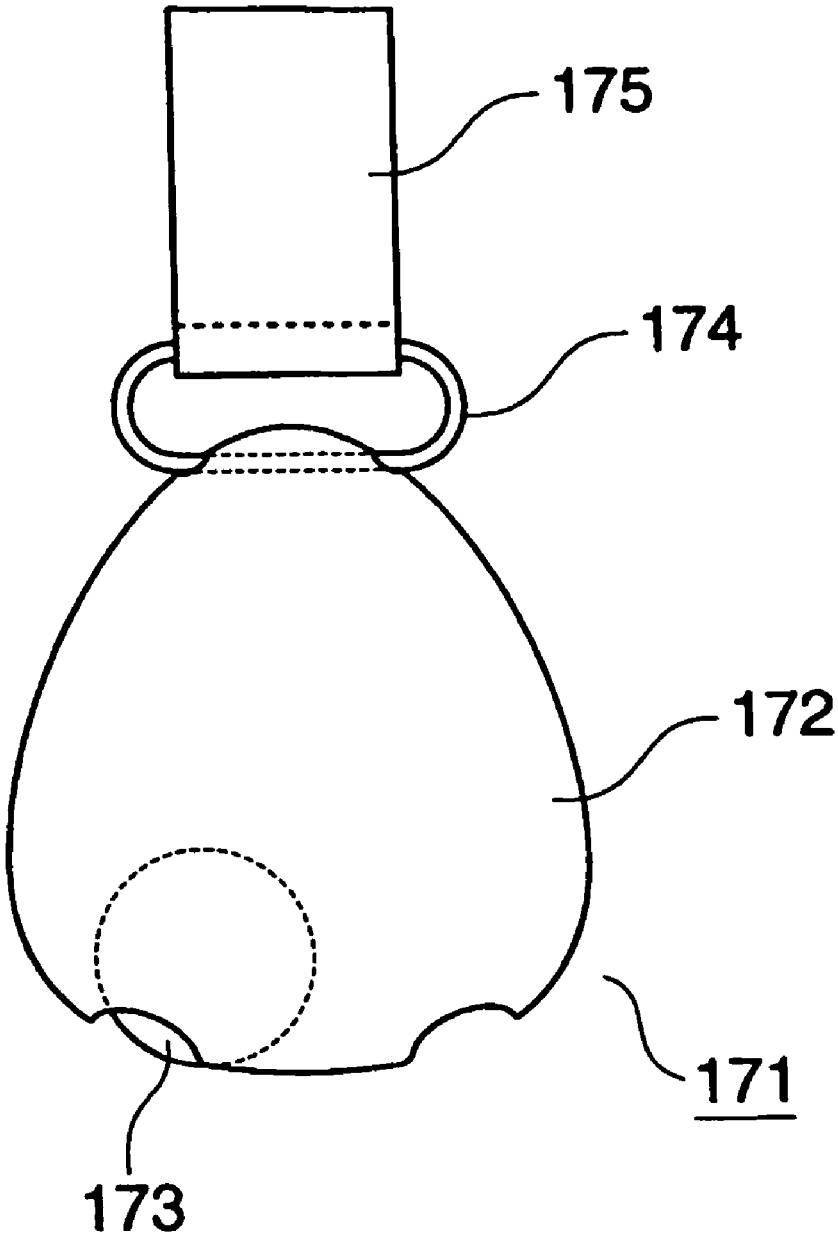

【Fig. 19】
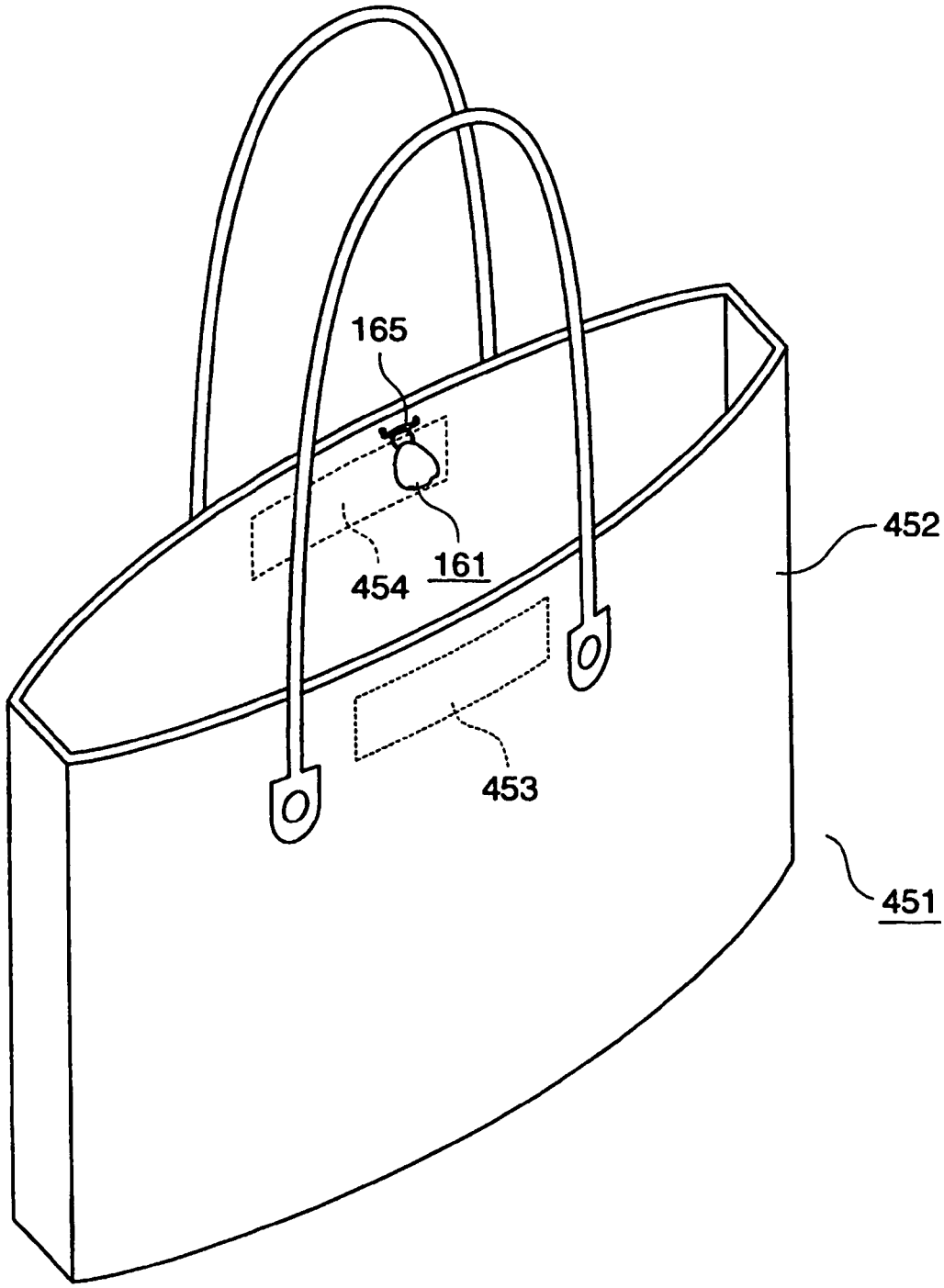

【Fig. 20A】
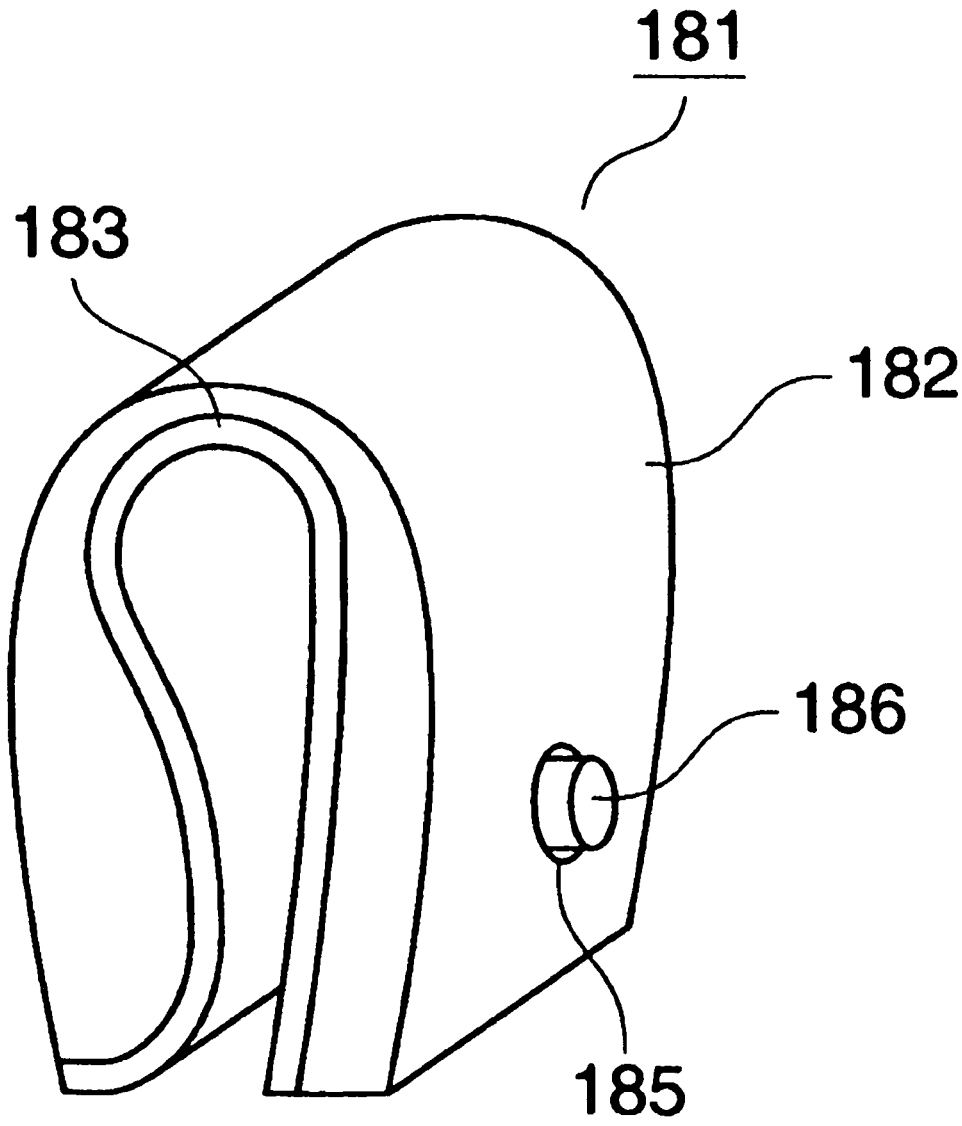

【Fig. 20B】
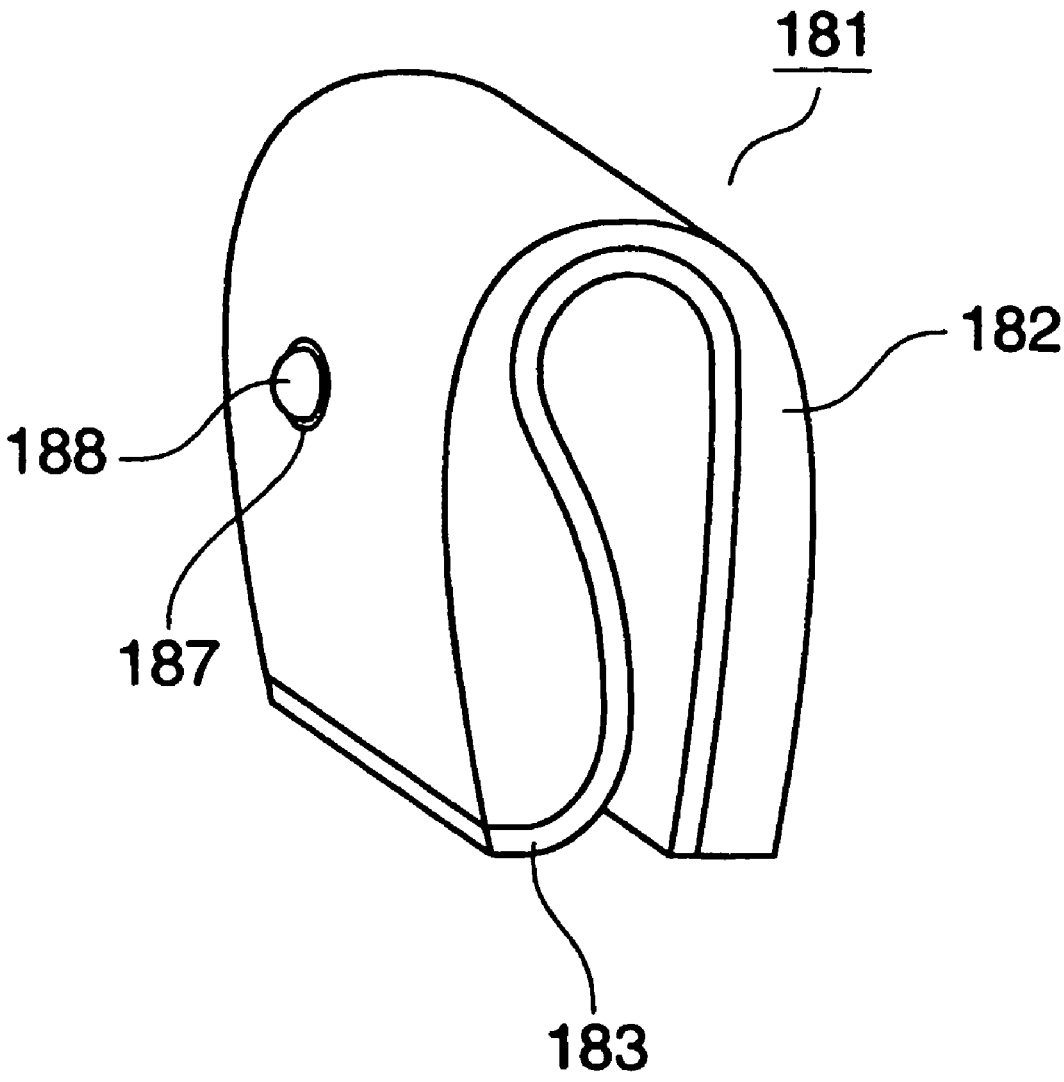

【Fig. 2 1】
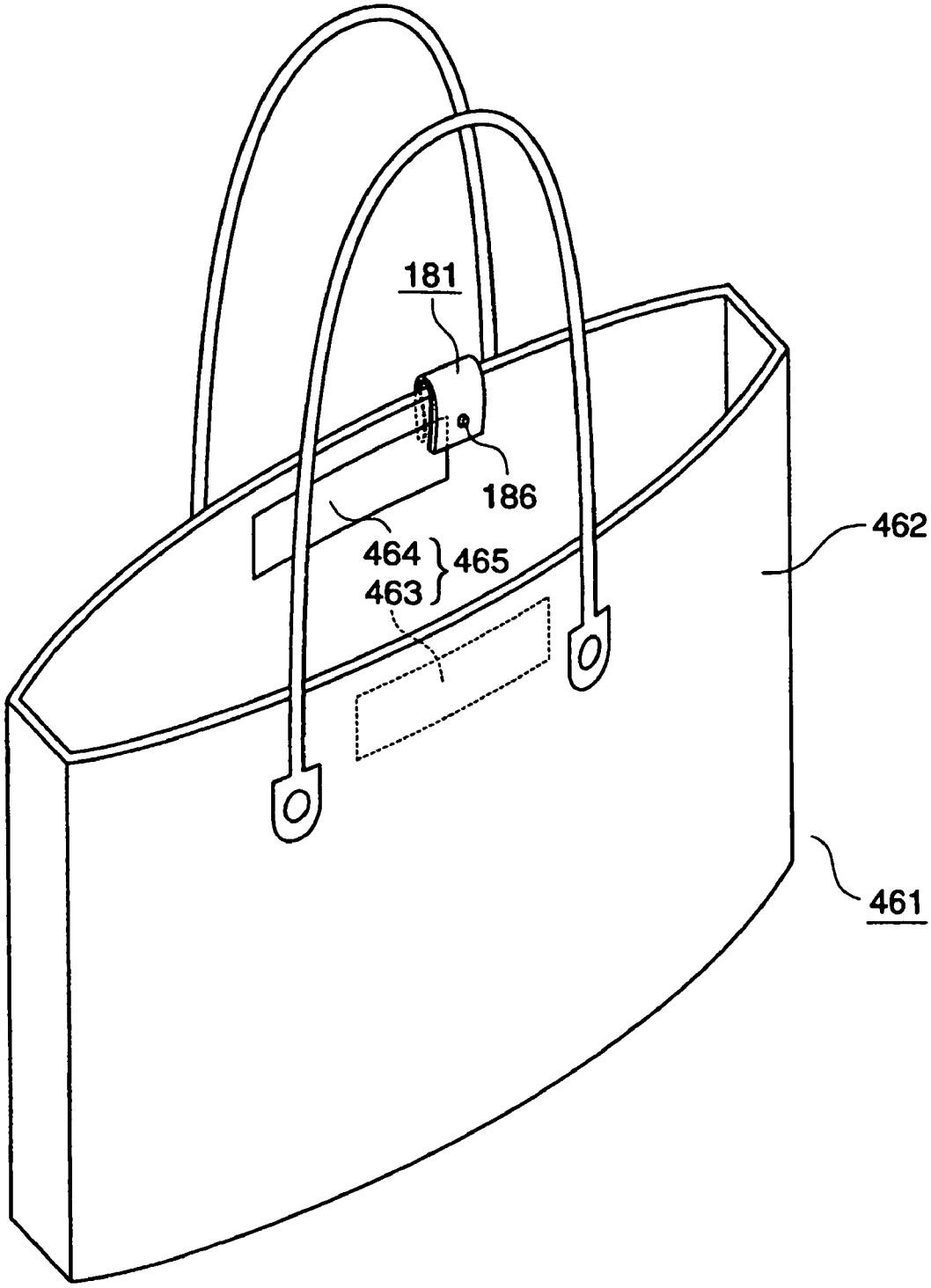

ALERT APPARATUS FOR USE WITH FASTENERS

The present invention relates to alert apparatus for use with fastener apparatus and fasteners, and in particular relates to alert apparatus for use with fasteners on wearable and portable items, said apparatus being helpful in alerting a user that a fastener has not been closed or fastener parts have not been connected.

Every year new designs for clothing and bags are presented. Fasteners are incorporated in many places in such clothing and bags. In today's lifestyle, the number of small articles carried around, such as wallets, ID cases, keys, cellular phones, laptop computers, PDAs, personal organizers, and cards used to access a variety of services has been increasing, as has the number of pockets attached to clothing, bags and the like.

In addition, a variety of holders and straps such as key holders, neck straps and wrist straps have come to be in wide use in order to prevent small articles carried around from being lost or dropped. Fasteners are used in such wearable items in a variety of forms and, therefore, the number of fasteners used for such clothing, wearable items, bags and other portable items has increased accordingly. There are, of course, various types of fasteners. As a result, many cases occur wherein a user forgets to close a fastener or connects fastener parts.

In the case wherein a fastener is mistakenly left open or unconnected, a user may give the impression of being sloppy or careless, a user may become more susceptible to being pickpocketed, which may be the cause of losing an article from a pocket or from a bag, or may be the cause of forgetting to attach an article to a fastener. In particular, such a problem frequently occurs in regard to a backpack, or the like, having many fasteners that are not easily viewable by the user when the user is wearing the backpack. A device does not exist which can alert a user that he or she has mistakenly left a fastener in the open or unconnected condition whilst he or she is, for example, wearing a backpack, carrying a bag/portable item, or wearing clothing including fasteners.

An object of the present invention is to provide an alert apparatus for use with fastener equipment, which is helpful in alerting a user that a fastener has not been closed or fastener parts have not been connected.

Here in the present specification the word "fastener" includes slide fasteners such as zippers, surface fasteners, buttons, hooks, catches and fasteners that use belts or straps. Furthermore, in the present specification wearable and portable items (particularly, clothing and bags) having an opening that is stable when in the closed condition due to the effects of a part involved in the opening and closing of the opening, such as a spring-loaded hinge, are also regarded as wearable and portable items that are closed by means of a fastener.

Though a "fastener" can be used as a wearable or portable item in itself in the case where the fastener forms, for example, a key holder or a fashion accessory, in most cases a "fastener" is utilized by being incorporated in a wearable or portable item that has other components. In such a wearable or portable item, there are portions that interlock a fastener concerning opening and closing of the fastener or separation and connection of fastener parts. Alternately, there are portions which are required for the attachment of fastener parts. In the present specification, such portions including the fastener are collectively referred to as a "fastener-including system."

Here, each "fastener" incorporated in a "fastener-including system" is preferably formed of two or less parts, excluding the attachment means to the "fastener-including system," which can be connected to each other. That is to say, even in the case wherein each of these parts is made up of two or more parts, they are organically assembled in order to be incorporated in a "fastener-including system." Thus, a slide fastener may be regarded as one part irrelevant of the number of sliders.

In the present specification, when "fastener equipment" is incorporated in a "fastener" or a "fastener-including system," the total of the number of parts of the "fastener" and the "fastener equipment" per one "fastener" preferably does not normally exceed four. Typically, this number of four is the sum of two fastener parts and two fastener equipment parts. Here, each part is organically assembled to become one unit as described above.

According to the present invention, preferably the "fastener equipment" is at least partially integrated with the "fastener" and, therefore, the total number of the parts is preferably no greater than three. In the case wherein the "fastener equipment" and the "fastener" are provided with an electronic device, or the like, formed of a large number of parts, for example, they may be integrated into four or less parts (preferably, three or less parts) using a housing or the like in order to be attached to a "fastener-including system." The "fastener equipment" defined in the present specification preferably does not allow the total number of the parts to exceed four. As described above, the maximum number of the parts of a "fastener" is preferably two.

The term "wearable items" includes all items that are literally wearable, such as key holders, neck straps and wrist straps, in addition to all types of "clothing" and fashion accessories. Furthermore, the term "portable items" refers to all items that are literally portable, including "bags". In the case wherein any portable item can be attached to a "wearable item" or another portable item such as a "bag" by means of a fastener or holder, such a portable item is a "portable item including a fastener" stated in the present specification. Furthermore, "wearable items" and "portable items" include items that are worn by animals or that are attachable to a bicycle, a cart and the like.

In addition, the word "bag" is a general name for a portable container such as a handbag, a purse, a shoulder bag, a clutch bag, a tote bag, a schoolbag, a suitcase, a pouch, a trunk, a sack, a backpack, a daypack, a rucksack, a duffel bag, a satchel, a portfolio, a briefcase, an attaché case and a computer case.

According to one aspect of the present invention there is provided alert apparatus for providing an alert indication directed to a user thereof; the apparatus being incorporated into or attached to fastener equipment for securing an item, wherein said apparatus comprises—first and second elements, which are moveable together and apart, the item being in a secure position when the first and second elements are together; wherein at least one of the elements is arranged to provide an alert indication directed to the user, said alert indication being suppressed when the first and second elements are at or adjacent one another.

Here, an "alert indication" is a signal for alerting, or indicating to, the user of a wearable or portable item having a fastener or fastener equipment, according to the present invention, that he or she has mistakenly left the fastener open or unconnected.

This indication or signal alerts a user who is wearing, or is carrying, such an item that the fastener is open or the fastener parts have not been connected. This indication or signal, however, differs from, for example, an alarm signal which is annoying to the user such that the user will normally want to quickly turn off such an alarm signal. That is to say, this indication or signal does not make the user feel uncomfortable even in the case that the signal continues for an extended period of time. This indication or signal will neither disturb the user nor bystanders in proximity to the signal source even though the signal clearly gains the attention of the user.

Conveniently, at least one of said elements includes a bell having a clapper or ball for providing said alert indication. In this way, the alert indication is only emitted when the user moves or the item he/she is carrying is moved. Here, the word "bell" indicates any type of instrument that emits a sound when a plurality of members thereof strike each other, such as a chime or a gong. In addition, the word "bell" in the present specification includes any device not having a power supply that emits sound when moved. Contrarily, an electronic device that emits sound with the aid of a power supply is not included in the definition of the bell of the present specification.

In general the sound should be within a range of from approximately 20 dB to 60 dB. In this regard a continuous sound exceeding 60 dB, for example, may be used as the ringing sound of a telephone. This is significantly louder than the level of the alert indication of the present invention. In addition, burglar alarms, theft alarms, personal alarms, and the like, normally emit sounds at a level of at least approximately 80 dB and such alarms emit, of course, completely different types of signals from that of the present invention.

Conveniently, movement of said clapper or ball is suppressed when the first and second elements are at or adjacent one another. In this way, the operating condition of the clapper or ball is different when the first and second elements are at or adjacent one another, preventing them from hitting the bell and producing an alert indication.

Conveniently, the fastener equipment is for securing an aperture in an item closed, and said first and second elements are moveable together for closing the aperture and moveable apart for opening the aperture. In this way, the first and second elements are at or adjacent each other when the aperture is closed. Contrarily, the first and second elements are separated from each other when the aperture is open. Accordingly, an alert indication is only produced when the aperture is open, for example if a bag or pocket on an item of clothing is left open.

Alternatively, the fastener equipment is for securing first and second members together, and said first and second elements are moveable together for attaching said first and second members and moveable apart for detaching said first and second members. In this way, the first and second elements are at or adjacent each other when the first and second members are attached. Contrarily, the first and second elements are separated from each other when the first and second members are separated. Accordingly, an alert indication is only produced when the first and second members are separated, for example if a key is detached from a key ring or a dog collar is detached from a leash.

Conveniently, at least one of said elements has magnetic means for suppressing said alert indication by means of magnetic force. For example, one of the elements may include a material that is attracted to a magnet while the other may be or include a magnet, or both the first and second elements may each include a magnet. In this way, the elements do not have to be in physical connection with one another for the alert indication to be suppressed. Indeed, the elements can be adjacent or near one another for the magnetic force to act. Advantageously this allow the elements to be disposed, for example, either side of a piece of material, such as a side of a bag. Additionally, it is not necessary for a user to apply force in order to connect the elements together, nor is it necessary to precisely position the first and second elements, since the magnetic force can act in all directions.

Alternatively, at least one of said elements has mechanical means for suppressing said alert indication by means of mechanical action. In this way, a simple mechanical action upon the first and second elements being moved together can be used to suppress the alert indication.

Alternatively, one of said elements includes an electronic device operable to emit light, sound, vibration or any combination thereof for providing said alert indication. In this case, it is preferable for such an electronic device to be provided with a motion sensor so that it emits a signal only when it is moved like the above described bell.

Conveniently, both said elements are arranged to provide an alert indication. In this case, the first and second elements, when moved together, act on each other to suppress an alert indication. Accordingly, when the two elements are at or adjacent one another neither element emits an alert indication. When the two elements are separated from each other, both emit a alert indication. In this way, a louder alert indication can be produced without requiring a large increase in the size of the first and second elements.

Conveniently, said elements can be connected together by means of a magnetic force. In this way, a magnetic force may be used to both connect the elements together and suppress the emission of an alert indication. Accordingly, the alert apparatus can have a simple design, and hence be cheap to manufacture.

Conveniently, said elements can be connected together by means of a surface fastener or a buckle. In this way, the elements can be securely connected to one another and can be integrated into the fastener equipment, for example in a mechanical clip, buckle, velcro fastener and the like.

Conveniently, at least one of said elements is connected to a slider of a slide fastener that is incorporated in a wearable or portable item.

Conveniently, said first element is connected to a first slider, and said second element is connected to a second slider. Thus, the first and second elements make at or adjacent one another only when both slide fasteners are closed.

Alternatively, said first element is connected to a slider of a slide fastener that is incorporated in a wearable or portable item, and said second element is disposed on said wearable or portable item in a fixed position relative to said item. For example, alert apparatus according to the present invention can incorporated into one or more slide fasteners in a wearable or portable item. In this case, for example, each of the sliders of the slide fasteners can have a first element connected to it, and at least one second element is provided at a fixed position on the wearable or portable item. Accordingly, the wearable or portable item can be formed so that the closing of any of the slide fasteners allows its respective first element to move to at or adjacent the second element.

Conveniently, said slide fastener is a zip fastener.

Conveniently, said item is a portable item or a wearable item. In this way, the alert apparatus can be incorporated into an item of clothing, a bag, a briefcase or other portable item to provide an alert indication when the item is left unsecure, for example, if a bag or pocket on an item of clothing is accidentally left open.

According to a further aspect of the present invention, there is provided alert apparatus for providing an alert indication directed to a user thereof; the apparatus being incorporated into or attached to fastener equipment for closing an aperture in an item, wherein said apparatus comprises—first and second elements, which are moveable together for closing said aperture and apart for opening said aperture; wherein at least one of the elements is arranged to provide an alert indication directed to the user, said alert indication being suppressed when the first and second elements are at or adjacent one another.

According to a further aspect of the present invention, there is provided alert apparatus for providing an alert indication directed to a user thereof for incorporation into or attachment to fastener equipment for securing an item, wherein said apparatus comprises—first and second elements, which are moveable together and apart, the item being in a secure position when the first and second elements are together when incorporated in or attached to the fastener equipment; wherein at least one of the elements is arranged to provide an alert indication directed to the user, said alert indication being suppressed when the first and second elements are at or adjacent one another.

At least one of the elements may be attachable to a commercially manufactured fastener in a wearable or portable item. In such a case, at least one of the elements may be provided with a loop or an attachment mechanism so as to be attachable to a fastener part or to the cloth, or may be provided with a flap that is attached or adhered to the cloth by means of sewing with thread or with adhesive.

Here, the word "loop" indicates a portion of a cord, ribbon, etc., folded or doubled upon itself so as to leave an opening or a curved piece or ring of metal, plastic, wood, or the like. Furthermore, the loop may be provided with a mechanism wherein a portion thereof can be opened and closed, such as snap hooks and spring-loaded rings.

The word "cloth" indicates textiles, fabrics, woven cloth, non-woven cloth, leather, synthetic leather and other material in sheet form.

The attachment mechanism may be or include a safety pin, a pin of the type used on the back of badges, a screw, a rivet, a clip, or the like. Moreover, the flap that is attached or adhered to cloth by means of sewing with thread or with adhesive may be a band or a strap that forms a portion of clothing or a bag. The first and second elements may be respectively attached to, for example, the first and second sides of an opening that face each other in an item. Thus, separation and movement to be at or adjacent are the same as opening and closing of the fastener.

The cloth with a fastener may furthermore have a cover for the opening, or a band (or strap) that crosses over the opening, wherein the first end of the cover or band is attached to the first side of the opening. In such a case, one of the elements may be attached to the second side of the opening while the other element may be attached to the second end of the cover or the band.

Alternately, in the cloth with a fastener, the fastener may be a slide fastener that is attached to the periphery of the cloth surrounding the opening. Typically, one of the elements is attached to the slider of this slide fastener while the other element is attached to the cloth surrounding the opening.

The alert apparatus according to the present invention can be attached to commercially available fasteners, wearable or portable items, or can be included as components of fasteners, wearable or portable items at the time of the manufacture of fasteners, wearable or portable items. The open and closed or separated and attached states of the fastener are distinguished from each other according to the existence, or non-existence, of an alert indication as described above. Therefore, according to the present invention it becomes possible for the user to easily recognize the open or closed and separated or connected state of the fastener of the clothing/wearable item that he or she is wearing or of the bag/portable item that he or she is carrying.

In particular, the user is alerted when the fastener is open or unconnected so that the fastener is prevented from mistakenly being left open or unconnected. In addition, pickpocketing can be prevented because an alert indication is emitted at the moment when the fastener, which was in the closed or connected condition, is opened or separated. Furthermore, the fastener equipment according to the present invention can be used as a fashion accessory that emits an alert indication. The above described working effects gained according to the present invention become more significant in the case where the both the elements simultaneously functions to emit an alert indication.

In addition, it is easy to simplify the structure of the source of the alert indication, for example, forming one of the elements as a bell, when the other element can be connected it by means of magnetic force according to the present invention. This is because the first and second elements may be made of (a) magnet(s) (and iron). Furthermore, in this case it is not necessary for the user to apply force in order to connect the elements together, nor is it necessary to precisely position the first and second elements. In addition, the user simply pulls the first and second elements away each other in order to separate them.

On the other hand, effects are gained wherein the opening and closing of the fastener, or the separation and connection of the fastener parts, as well as the separation and connection of the first and second elements, are simultaneously carried out without fail when the first and second elements form the fastener for a wearable or portable item. In this case the effects are, of course, gained wherein the overall structure is simplified in comparison with the case wherein the means for allowing the first and second elements to be connected or attached together is formed of members separate from those of the fastener.

The invention will now be described, by way of illustration only, with reference to the accompanying drawings in which:

FIG. 1A shows a bell of the fastener equipment according to the first embodiment of the present invention;

FIG. 1B shows a silencer of the fastener equipment according to the first embodiment of the present invention;

FIG. 2A shows a slide fastener, to which the fastener equipment is attached, in an open condition according to the second embodiment of the present invention;

FIG. 2B shows the slide fastener, to which the fastener equipment is attached, in a closed condition according to the second embodiment of the present invention;

FIG. 3 shows a backpack provided with a plurality of pieces of fastener equipment according to the third embodiment of the present invention;

FIG. 4 shows a briefcase provided with a plurality of pieces of fastener equipment according to the fourth embodiment of the present invention;

FIG. 5A shows a bell of the fastener equipment according to the fifth embodiment of the present invention;

FIG. 5B shows the bell of the fastener equipment according to the fifth embodiment of the present invention being attached to a slider made of metal of a commercially available fastener;

FIG. 5C shows the condition wherein a slider of a commercially available fastener has been passed through a rubber ring for attachment of the fastener equipment according to the fifth embodiment of the present invention;

FIG. 5D shows the condition wherein the bell of the fastener equipment according to the fifth embodiment of the present invention has been attached to the slider of a commercially available fastener;

FIG. 6A is a perspective view showing a bell of the fastener equipment according to the sixth embodiment of the present invention;

FIG. 6B is an exploded view showing all parts of the bell of the fastener equipment according to the sixth embodiment of the present invention;

FIG. 7A shows a slide fastener, to which the fastener equipment is attached, in an open condition according to the seventh embodiment of the present invention;

FIG. 7B shows the slide fastener, to which the fastener equipment is attached, in a closed condition according to the seventh embodiment of the present invention;

FIG. 8A is a perspective view of a handbag provided with fastener equipment according to the eighth embodiment of the present invention;

FIG. 8B is a cross sectional view along line 8B-8B of FIG. 8A of the handbag provided with the fastener equipment according to the eighth embodiment of the present invention;

FIG. 9A is a perspective view of a daypack provided with the fastener equipment according to the ninth embodiment of the present invention in the condition wherein the cover of the daypack is open;

FIG. 9B is a cross sectional view along line 9B-9B of FIG. 9A of the daypack provided with the fastener equipment according to the ninth embodiment of the present invention;

FIG. 9C is a cross sectional view of the daypack provided with the fastener equipment according to the ninth embodiment of the present invention in the condition wherein the cover of the daypack is closed;

FIG. 10A is a perspective view of a travel bag provided with the fastener equipment according to the tenth embodiment of the present invention in the condition wherein the slide fastener of the travel bag is being closed;

FIG. 10B is a cross sectional view along line 10B-10B of FIG. 10A of a portion of the travel bag provided with the fastener equipment according to the tenth embodiment of the present invention;

FIG. 10C is a cross sectional view of the portion of the travel bag provided with the fastener equipment according to the tenth embodiment of the present invention in the condition wherein the slide fastener of the travel bag is closed;

FIG. 11A is a perspective view showing a bell and a silencer that form a buckle according to the eleventh embodiment of the present invention in the condition wherein the silencer is separated from the bell;

FIG. 11B is a cross sectional view along line 11B-11B of FIG. 11A of the buckle according to the eleventh embodiment of the present invention;

FIG. 11C is a cross sectional view of the buckle according to the eleventh embodiment of the present invention in the condition wherein the silencer is connected to the bell;

FIG. 12 shows a neck strap according to the twelfth embodiment of the present invention;

FIG. 13A is a perspective view showing a bell and a silencer that form a buckle according to the thirteenth embodiment of the present invention in the condition wherein the bell and the silencer are separated from each other;

FIG. 13B is an exploded view showing all of the components of the bell and the silencer that form the buckle according to the thirteenth embodiment of the present invention;

FIG. 13C is a cross sectional view along line 13C-13C of FIG. 13A of the buckle according to the thirteenth embodiment of the present invention;

FIG. 13D is a cross sectional view showing the bell and the silencer that form the buckle according to the thirteenth embodiment of the present invention in the condition wherein the bell and the silencer are connected to each other;

FIG. 14A is a perspective view of an electronic device of the fastener equipment according to the fourteenth embodiment of the present invention as viewed from one side;

FIG. 14B is a perspective view of the electronic device of the fastener equipment according to the fourteenth embodiment of the present invention as viewed from the side opposite to that of FIG. 14A;

FIG. 14C is a perspective view of a signal modifier of the fastener equipment according to the fourteenth embodiment of the present invention;

FIG. 14D is a side view of the electronic device and signal modifier of the fastener equipment according to the fourteenth embodiment of the present invention in the condition wherein the electronic device and signal modifier are in contact with each other;

FIG. 15A is a schematic cross-sectional view of an electronic device and a signal modifier of the fastener equipment according to the fifteenth embodiment of the present invention, wherein the electronic device and the signal modifier are separated from each other;

FIG. 15B is a schematic cross-sectional view of the electronic device and the signal modifier of the fastener equipment according to the fifteenth embodiment of the present invention, wherein the electronic device and the signal modifier are connected to each other;

FIG. 16A shows a handbag with fastener equipment according to the sixteenth embodiment of the present invention wherein the cover of the handbag is closed;

FIG. 16B shows the handbag with fastener equipment according to the sixteenth embodiment of the present invention wherein the cover of the handbag is open;

FIG. 17 shows a bell of the fastener equipment according to the seventeenth embodiment of the present invention;

FIG. 18 shows a bell of the fastener equipment according to the eighteenth embodiment of the present invention;

FIG. 19 shows a handbag provided with the bell of the fastener equipment according to the nineteenth embodiment of the present invention;

FIG. 20A is a perspective view of an electronic device of the fastener equipment according to the twentieth embodiment of the present invention as viewed from one side;

FIG. 20B is a perspective view of the electronic device of the fastener equipment according to the twentieth embodiment of the present invention as viewed from the side opposite to that of FIG. 20A; and FIG. 21 shows a handbag provided with the electronic device of the fastener equipment according to the twenty-first embodiment of the present invention.

In the accompanying drawings, the reference numerals refer the following:

| | |
|---|---|
| 101, 111, 121, 132, 161, 171, 501, 521, 531, 631 | bells |
| 102, 112, 122, 162, 172, 502, 522, 532 | bodies of bells |
| 103, 113, 123, 163, 173, 503, 633 | balls of bells |
| 104, 144, 154, 204, 244, 254, 383, 559, 654 | cords |
| 105, 505, 636 | slits |
| 114, 124, 134, 164, 174 | metal rings |
| 115, 506 | hooks |
| 118 | rubber ring |
| 133 | stub |
| 135, 234, 423, 724 | straps |
| 136, 155, 185, 374, 507, 508, 525, | holes |

-continued

| | |
|---|---|
| 526, 528, 535, 536, 625, 635 | |
| 141 | chime |
| 142 | metal pipes |
| 151, 181, 551, 561 | electronic devices |
| 152, 182, 252, 552, 562, 652 | housings |
| 153, 661, 653 | soft iron plates |
| 156, 186, 233, 623 | protrusions |
| 157, 187 | recesses |
| 158, 188, 558, 568 | LEDs |
| 165 | safety pin |
| 175 | flap |
| 201, 231, 621 | silencers |
| 202, 622 | bodies of silencers |
| 203, 253, 553 | ferrite magnets |
| 205, 255, 554, 555, 564, 565 | yokes |
| 211, 453 | magnet sheets |
| 221 | neodymium magnet |
| 242, 373, 384, 443, 444, 703, 705 | tabs |
| 251, 651 | signal modifiers |
| 301, 311, 321, 331, 341, 351, 361, 371, 381, 391, 701 | slide fasteners |
| 302, 303, 312, 322, 372, 382, 392, 702, 704 | sliders |
| 304, 434, 527, 537, 706 | openings |
| 343, 465 | surface fasteners |
| 401 | backpack |
| 402, 432, 442, 452, 462 | container portions |
| 403, 404 | pockets |
| 411 | brief case |
| 421 | shoulder bag |
| 422, 863 | bag bodies |
| 431 | daypack |
| 433, 862 | covers |
| 441 | travel bag |
| 451, 461, 861 | handbags |
| 454 | iron sheet |
| 504, 524, 534, 624, 634, 725 | double-wound rings |
| 523, 533 | tongues |
| 556 | reed switch |
| 751 | glass tube |
| 752, 753 | contact blades |
| 821 | cellular phone |
| 822 | key |

In the following the preferred embodiments of the present invention are described in detail in reference to the drawings.

FIGS. 1A and 1B, respectively, show the components of the fastener equipment according to the first embodiment of the present invention. In reference to FIG. 1A, a bell 101 is formed of a body 102, having a slit 105 on the bottom side, and a ball 103. Ball 103 freely rolls about within body 102 causing sound to be emitted from bell 101 due to the movement of bell 101. The width of slit 105 is sufficiently small in comparison with the size of ball 103 such that ball 103 is not greatly hindered in its movement by slit 105. Ball 103 does not, of course, fall through slit 105. In addition, body 102 and ball 103 are both made of soft iron. Holes are created in the upper portion of body 102 for a cord 104 in loop form that is passed through the holes. Thereby, bell 101 is attachable to a fastener-including system (for example, a slider of a slide fastener).

In reference to FIG. 1B, a silencer 201 that can be connected to bell 101 is formed of a body 202 and a ferrite magnet 203. This body 202 of silencer 201 is made of plastic and has a shape similar to that of body 102 of bell 101. Silencer 201 can be connected to bell 101 of FIG. 1A because of ferrite magnet 203 in columnar form contained in body 202. Here, the side and the bottom of ferrite magnet 203 are covered with a yoke 205 made of iron in a cap form so that ferrite magnet 203 has a strong magnetic force at the top surface of ferrite magnet 203. This top surface is located at a position very close to the surface of one side of body 202.

Body 102 and ball 103 are both attracted to magnet 203 so that bell 101 does not emit sound even when being moved in the condition wherein silencer 201 is connected to bell 101. Holes are created in body 202 for a cord 204 in loop form that is passed through the holes in the same manner as in the above described body 102. Thereby, silencer 201 is attachable to a fastener-including system (for example, a slider of a slide fastener) in the same manner as in the above described bell 101.

Bell 101 and silencer 201 formed as described above are utilized by being appropriately attached to a fastener-including system. In this system, bell 101 can emit sound when the fastener is open or the fastener parts are separated from each other. Contrarily, bell 101 and silencer 201 are connected to each other making no sound when the fastener is closed or the fastener parts are connected to each other. An example of such a system is the below described slide fastener according to the second embodiment.

The shapes of body 102 of bell 101 and body 202 of silencer 201 are not particularly limited but, rather, may be formed according to the desired design. It is not necessary for body 102 and body 202 to both have a similar shape.

Slit 105 for emitting sound is provided in body 102 of bell 101, and the shape of slit 105, as well as the position wherein slit 105 is provided, is not particularly limited. A plurality of slits may, of course, be provided or a hole having a shape or pattern different from a slit may be provided instead of slit 105. That is to say, slit 105 may be designed so that bell 101 emits the desired sound. Slit 105 may be provided on a side of body 102, taking into consideration that ball 103 is strongly attracted to silencer 202 through slit 105.

Though ball 103 of bell 101 is approximately spherical, the shape thereof is not particularly limited. Ball 103 may be of a cylindrical shape, in the shape of a die, or of any other shape. It is preferable for ball 103 to have a shape that approximates a sphere so that ball 103 can easily roll around inside of body 102. In addition, ball 103 may be suspended using a string or may be in the form of a tongue of which one end is attached to the inside of body 102 so as to be moveable like a pendulum.

Magnet 203 is not limited to a ferrite magnet as long as it is a permanent magnet. A rare earth magnet, such as a samarium magnet, a neodymium magnet, or the like, which has a magnetic force stronger than that of a ferrite magnet is preferably used. The dimensions and shapes of magnet 203 and yoke 205 are a matter of design as long as silencer 201 attracts bell 101 with a force exceeding a specific strength. Yoke 205 is not essential.

In the case wherein, for example, a neodymium magnet is used without a yoke, the structure of silencer 201 is simplified so that manufacture is made easy. Furthermore, the usage of a neodymium magnet makes it easy to concentrate the magnetic field in a small region so as to limit unnecessary spread of the magnetic field. The usage of such a magnet makes it easy to form a silencer that attracts bell 101 to either side of body 202. A plurality of magnets, instead of one magnet 203, may, of course, be provided with silencer 201.

Body 102 and ball 103 of bell 101 may be made of other materials that are attracted to a magnet. Soft iron is used in this first embodiment so as to prevent body 102 and ball 103 from becoming magnetized after a long period of usage. Bell 101 does not, of course, function in the case wherein body 102 and ball 103 are magnetized.

Alternately, either body 102 or ball 103 may be made of a material that is attracted to a magnet. Body 102, alone, for example, may be attracted to silencer 201 while ball 103 is not attracted to silencer 201. Even if bell 101 still emits sound, the quality of the sound from bell 101 changes considerably when body 102 of bell 101 is, alone, connected to silencer 201.

Furthermore, it is possible to use a magnet to form either body 102 or ball 103 of bell 101 and to use soft iron or a magnet to form silencer 201. Here, it is more preferable for both body 102 and ball 103 to be attracted to a magnet because sound can be prevented without fail when silencer 201 is connected to bell 101.

Cords 104 and 204 may be replaced with metal rings, straps having loops on each end, or the like. In addition, either bell 101 or silencer 201 may be attachable to a portion of clothing or bags other than a slider of a slide fastener, that is to say, may be attachable to cloth. Both bell 101 and silencer 201 may be attachable, in particular, to a part of a fastener that is not a slide fastener or to cloth so as to be used in connection with the opening and closing of such a fastener.

Thus, at least one of cords 104 and 204 may be replaced with a member provided with a safety pin, a pin of the type used on the back of badges, a screw, a rivet, a clip, or the like. Alternately, at least one of cords 104 and 204 may be replaced with a member provided with a flap that can be sewn or adhered to cloth of clothing, bags, or the like.

FIGS. 2A and 2B show a slide fastener 301 according to the second embodiment of the present invention. The above described fastener equipment components shown in FIGS. 1A and 1B, respectively, are attached to this slide fastener 301.

Slide fastener 301 is provided with two sliders 302 and 303. FIG. 2A shows slide fastener 301 in the open condition wherein sliders 302 and 303 are separated from each other so as to create an opening 304. In contrast to this FIG. 2B shows slide fastener 301 in the closed condition wherein sliders 302 and 303 are in close proximity to each other.

Bell 101 is attached to slider 302 by means of a cord 104 and silencer 201 is attached to slider 303 by means of a cord 204. Here, it should be noted that bell 101 and silencer 201 are designed so that they can be utilized as pull tabs of slide fastener 301. Alternately, a pull tab, or pull tabs, for opening and closing slide fastener 301 may be provided to one of, or both of, sliders 302 and 303 of slide fastener 301, in addition to bell 101 and silencer 201.

At the time that slide fastener 301 is in the open condition, as shown in FIG. 2A, bell 101 is in the condition wherein it emits sound whenever it is jarred. On the other hand, when slide fastener 301 is in the closed condition, as shown in FIG. 2B, bell 101 is connected to silencer 201 due to the effect of magnet 203 and does not emit sound even when bell 101 is jarred.

Slide fastener 301 in the above described configuration is attached to clothing, bags, or the like. In the case wherein slide fastener 301 has mistakenly been left open, bell 101 emits sound when it is jarred due to the movement of the human body or to transport, so that a person wearing the clothing or the carrier of the bag becomes aware that slide fastener 301 has been left open. Certain modifications of the fastener equipment according to the above described first embodiment are, of course, applicable to this second embodiment.

FIG. 3 shows a backpack 401 provided with a plurality of pieces of the fastener equipment according to the third embodiment of the present invention. Backpack 401 is provided with a container portion 402 and, furthermore, has two pockets 403 and 404 on the front side, which is the side opposite to the side having straps for attachment to the body, of backpack 401. Slide fasteners 301, 311 and 321 are attached to container portion 402, pockets 403 and 404, respectively.

Slide fastener 301 can be opened and closed using two sliders 302 and 303 in the same manner as described in reference to FIGS. 2A and 2B wherein bell 101 as shown in FIG. 1A is attached to slider 302 and silencer 201 as shown in FIG. 1B is attached to slider 303. In FIG. 3 slide fastener 301 is closed so that bell 101 and silencer 201 are connected to each other.

On the other hand, slide fasteners 311 and 321 each have only one slider attached. That is to say, slider 312 is attached to slide fastener 311 and slider 322 is attached to slide fastener 321. Here, another bell 101 as shown in FIG. 1A is attached to slider 312 and another silencer 201 as shown in FIG. 1B is attached to slider 322.

When slide fasteners 311 and 321 are closed, sliders 312 and 322 are both moved towards the middle of the front side of backpack 401 provided with pockets 403 and 404. Accordingly, bell 101 and silencer 201 are connected to each other when slide fasteners 311 and 321 are both closed. FIG. 3 shows the condition wherein bell 101 of slide fastener 311 and silencer 201 of slide fastener 321 are connected to each other, as is described above. When either slide fastener 311 or slide fastener 321 is in the open condition however bell 101 and silencer 201 are separated from each other.

One of the two bells 101 emits sound at the time when backpack 401 having such a configuration is carried in the case wherein any of container portion 402, pocket 403 and pocket 404 has been mistakenly left open. Thereby, slide fasteners 301, 311 and 321 can be prevented from mistakenly being left open. Certain modifications of the fastener equipment according to the above described first embodiment are, of course, applicable to this third embodiment.

FIG. 4 shows a briefcase 411 provided with a plurality of pieces of the fastener equipment according to the fourth embodiment of the present invention. Briefcase 411 is provided with four container portions having slide fasteners 31, 341, 351 and 361 attached to the container portions. All of these slide fasteners are of a type having only one slider and each slider has a bell 101, having a configuration identical to that of bell 101 as described above in reference to FIG. 1A, attached thereto.

This briefcase 411 has a configuration wherein the four bells 101 are approximately in alignment with each other and are located at positions approximately the same distance from the bottom of briefcase 411 when slide fasteners 331, 341, 351 and 361 are all closed so that these bells 101 are stationed against a magnet 211 in sheet form. Here, magnet 211 in sheet form has been sewn into briefcase 411 so as to be located between the exterior material and the interior material of the briefcase.

Each bell 101 attached to each of slide fasteners 331, 341, 351 and 361 is attracted to magnet 211 and, thus, does not emit sound when the slide fastener, to which the bell is attached, is closed (in FIG. 4 slide fasteners 331, 351 and 361 are closed).

In contrast to this, each bell 101 attached to each of slide fasteners 331, 341, 351 and 361 emits sound when briefcase 411 is carried in the condition wherein the slide fastener to which the bell is attached is open (in FIG. 4 slide fastener 341 is open). Thereby, slide fasteners 331, 341, 351 and 361 can be prevented from mistakenly being left open.

Commercially available magnets in sheet form may be utilized as the above described magnet 211 and a magnet having a strong magnetic force, even if the magnet is thin, is preferable. In addition, all of the four bells 101 can be connected to one sheet magnet 211 in the present embodiment. This simplifies the manufacturing process. Briefcase 411 may be provided with a plural number of magnets that may be located in any desired position as necessary for each specific design.

Almost all of the modifications of the above described bell 101 according to the first embodiment are applicable to the structures of bells 101 of this fourth embodiment. It is possible, for example, to use a material that is not attracted to a magnet to form body 102 of bell 101 and to form ball 103 of a magnet. In this case, sheet magnet 211 can be replaced with an iron sheet. In addition, it is not necessary for all bells 101 to have the same dimensions or shapes.

Here, any of the first to fourth embodiments of the present invention has bell 101 as a component. Cord 104 that passes through the holes in the upper portion of body 102 of bell 101 forms a loop and, thereby, bell 101 is attachable to a slider of a slide fastener. In the following an example of a bell having a loop of a type different from the above is shown.

FIG. 5A shows a bell 111, which is a component of the fastener equipment according to the fifth embodiment of the present invention. The form of the upper portion of body 112 of bell 111, in which a hole is created, differs from that of body 102 of the above described bell 101 according to the first to fourth embodiments. Body 112 of bell 111, however, has substantially the same material and functions as body 102 of bell 101. In addition, ball 113 of bell 111 has exactly the same functions as ball 103 of bell 101.

A hook 115 made of metal forming a loop is attached to body 112 of bell 111 via a metal ring 114. A part of the loop of this hook 115 is moveable and this moveable part 116 interlocks with a protrusion 117 that protrudes to the outside from hook 115. That is to say, moveable part 116 is moved towards the inside of the loop so that a portion of the loop is opened, as shown in FIG. 5B, when protrusion 117 is pressed down. Subsequently, moveable part 116 returns to its original position so that hook 115 again forms a loop due to the action of an elastic body incorporated in hook 115 when the force pressing down protrusion 117 is removed.

Again in reference to FIG. 5B, a pull tab 373 made of metal wherein a hole 374 is created at one end is attached to a slider 372 of a commercially available slide fastener 371. Hook 115 can be engaged with hole 374 when the loop of hook 115 is opened by pressing down protrusion 117 as described above. Then, bell 111 is attached to pull tab 373 when the force used to press down protrusion 117 is removed in the engaged condition.

In addition, in reference to FIGS. 5C and 5D, a pull tab 384 made of plastic is attached to a slider 382 of a commercially available slide fastener 381 via a cord 383. A rubber ring 118 of which the inner periphery is smaller than the outer periphery of this pull tab 384 is prepared in order to attach bell 111 to slider 382 of this slide fastener 381.

Initially, rubber ring 118 having elasticity is extended so that pull tab 384 can be passed through rubber ring 118. FIG. 5C shows the condition wherein rubber ring 118 is attached to slider 382, as described above. Then, the center portions of each side of rubber ring 118 are held close together while hook 115 is operated in the same manner as in the case of FIG. 5B so that bell 111 is attached to slider 382, as shown in FIG. 5D.

It is, of course, possible to directly attach hook 115 to cord 383 of slider 382 in slide fastener 381. However, bell 111 is attached to one side of cord 383, which is not aesthetically pleasing. In addition, hook 115 attached in such a manner easily shifts to a position where hook 115 makes contact with pull tab 384 and, therefore, hook 115 acts as a hindrance to pull tab 384 in regard to the opening and closing operation of slide fastener 381. It should be noted that such a problem does not easily occur in the case wherein bell 111 is attached to slider 382, as shown in FIG. 5D.

As described above, bell 111 according to this fifth embodiment can generally be attached to a fastener-including system. Typically, bell 111 can easily be attached to a pull tab made of metal of a commercially available slide fastener and, in addition, can be attached to a pull tab made of a combination of a cord and a piece of plastic. Furthermore, bell 111 attached as described above does not hinder the functioning of the pull tab provided with the commercially available slide fastener.

Fastener equipment is formed according to the present invention of a pair made up of a bell and a silencer, provided with the same type of hook as the above described bell 111, in the same manner as in the above described first to third embodiments. In addition, it is possible to change or modify bell 111 of this fifth embodiment in exactly the same manner as the above described bell 101 of the first embodiment.

FIGS. 6A and 6B show a bell 501, which is a component of the fastener equipment according to the sixth embodiment of the present invention. FIG. 6A is a perspective view of bell 501 and FIG. 6B is an exploded view showing all of the parts of bell 501. The fastener equipment according to the sixth embodiment is formed of a pair of bells 501, each of which is the same as bell 501 shown in FIGS. 6A and 6B.

In reference to FIGS. 6A and 6B, bell 501 is formed of a body 502 having a slit 505 on the bottom side and of a ball 503. Ball 503 can freely roll around inside of body 502 and bell 501 emits sound due to the movement of bell 501. Body 502 is cast from an alloy of silver, copper and zinc, which is not attracted to a magnet, while ball 503 is a neodymium magnet in columnar form. A hole 507 that leads to the inside of body 502 is created in the top of body 502 and the diameter of this hole 507 is slightly greater than the diameter of ball 503. That is to say, ball 503 can be put into, or taken out of, body 502 through hole 507.

Holes 508 are created on both sides of the upper portion of body 502 and a double-wound ring 504 is passed through the two holes 508. In this condition, ball 503 cannot pass through hole 507. Furthermore, this double-wound ring 504 is also passed through hook 506 so as to connect body 502 to hook 506. Here, double-wound ring 504 and hook 506 are made of phosphor bronze that has elasticity and that is not attracted to a magnet.

The two end portions of hook 506 overlap each other where there is a break 509 in hook 506, which is ordinarily closed so that the entirety of hook 506 forms a loop. Break 509 is opened, however, when an appropriate force is applied to hook 506, having elasticity, so that hook 506 becomes connectable to another loop. As a result, bell 501 becomes attachable to a fastener-including system. Typically, bell 501 becomes attachable to a pull tab of a commercially available slide fastener in the same manner as bell 111 according to the above described fifth embodiment.

Two bells 501 which are the same as bell 501 structured as described above are combined so that the fastener equipment according to the sixth embodiment is formed. This fastener equipment can be utilized by being appropriately attached to a fastener-including system in the same manner as the above described fastener equipment according to the first embodiment. In this system, two bells 501 can both make a sound when the fastener is open or the fastener parts are separated from each other. Contrarily, two bells 501 are connected to each other making no sound when the fastener is closed or the fastener parts are connected to each other. An example of such a system is the below described slide fastener according to the seventh embodiment.

In the fastener equipment according to the sixth embodiment, each of the two bells 501 functions as a signal source and simultaneously as a silencer for the opponent bell 501. Balls 503 are stationary and no alert signal is emitted in the condition where bells 501 are connected to each other. Contrarily, when bells 501 are separated from each other, alert signals are emitted from the two bells 501, providing advantages that alert signals can be heard clearly.

There is a risk wherein balls 503 of bells 501, which are magnets, may inadvertently attract iron sand, small pieces of iron, or the like, while the above described fastener equipment according to the sixth embodiment is being utilized. A ball 503 can be taken out of body 502 after removing double-wound ring 504 from body 502 in order to remove such foreign particles that have been attracted to ball 503.

The form and design of body 502 and of slit 505 can be modified in the same manner as of body 102 and of slit 105 of bell 101 according to the above described first embodiment. Body 502 may be made of any material that is not attracted to a magnet and that can form a bell. Metals and alloys such as silver, copper, brass, bronze, and the like, can be cited as preferable materials for body 502.

Ball 503 may be a neodymium magnet, as described above, or may be any other permanent magnet, and the form thereof can be modified in the same manner as of ball 103 of bell 101 according to the above described first embodiment. In addition, it is not necessary for corresponding components of the two bells 501 to have the same form, design or dimensions, nor is it necessary that they be made of the same materials. It is possible for one of the balls 503 of the two bells 501 to be a magnet and for the other to be made of a material, such as soft iron, that is attracted to a magnet. It becomes easier to gain fastener equipment such that the bells are connected to each other without fail in the case wherein the two balls 503 are magnets because the magnetic force is strengthened.

In addition, double-wound ring 504 and hook 506 can be appropriately modified, and an appropriate attachment mechanism can be used for bell 501 according to this sixth embodiment. Here, at least, the attachment mechanism, such as double-wound ring 504, that makes direct contact with body 502 must be made of a material that is not attracted to a magnet. It is also preferable for hook 506, of which the possibility of making contact with body 502 is relatively low, to be made of a material that is not attracted to a magnet in order to prevent improper operation.

It is possible to replace any, or all, of bells 101 with bell 501 in the above described second to fourth embodiments in the case wherein the attachment mechanisms can freely be used. In addition, it is also possible to replace both bell(s) 101 and silencer(s) 201 with bells 501 in the second and third embodiments.

FIGS. 7A and 7B show a slide fastener 701 according to the seventh embodiment of the present invention. This slide fastener 701 has two sliders 702 and 704, and can be opened or closed by moving the two sliders 702 and 704 away from each other or close to each other in the same manner as the above described slide fastener 301 according to the second embodiment. In order to facilitate the opening and closing of slide fastener 701, pull tabs 703 and 705 are attached to sliders 702 and 704, respectively.

The above described components of the fastener equipment according to the sixth embodiment are attached to slide fastener 701. That is to say, bell 501 is attached by means of hook 506 to each of pull tabs 703 and 705 of sliders 702 and 704 of slide fastener 701.

Thus, as shown in FIG. 7A, the two bells 501 are hung from sliders 702 and 704 via pull tabs 703 and 705 when slide fastener 701 is open creating an opening 706. The two balls 503 of the two bells 501, respectively, roll around inside of the bells and both bells 501 emit sound when an object to which slide fastener 701 is attached is moved in the condition wherein slide fastener 701 is open.

The two balls 503 of the two bells 501 are attracted to each other by magnetic force so that the two bells 501 make contact with each other when slide fastener 701 is closed, as shown in FIG. 7B. The two balls 503 do not roll around in this condition and the two balls 503 remain stationary in a position opposite to each other and, therefore, neither of the two bells 501 emits sound when the object to which slide fastener 701 is attached is moved.

Slide fastener 701 having the above described configuration is utilized by being attached to an opening of clothing, of a bag, or the like, in the same manner as the above described slide fastener 301 according to the second embodiment. Modifications of the above described fastener equipment according to the sixth embodiment can appropriately be applied to this seventh embodiment.

FIGS. 8A and 8 B show a shoulder bag 421 provided with fastener equipment according to the eighth embodiment of the present invention. FIG. 8A shows a perspective view of shoulder bag 421 and FIG. 8B shows a cross sectional view of this shoulder bag 421 along line 8B-8B of FIG. 8A.

One end of a strap (or band) 423 is attached to the back side of a bag body 422 while the other end of this strap 423 has a bell 121 attached thereto via a metal ring 124. Here, it should be noted that bell 121 is very sensitive to motion. Bell 121 is formed with a ball 123 contained inside of a body 122 of bell 121 so that ball 123 can roll freely inside of bell 121 and emit sound when bell 121 is jarred in the condition wherein the opening in the upper portion of bag body 422 is open. In addition, a neodymium magnet 221 is attached to the front side of bag body 422 while body 122 and ball 123 are made of soft iron so that bell 121 can be attracted to magnet 221.

Shoulder bag 421 is configured so that the opening of bag body 422 is closed by moving bell 121 close enough to magnet 221 such that bell 121 becomes held by magnet 221. Shoulder bag 421 shown in FIGS. 8A and 8B is in the closed condition as described above. Bell body 122 is provided with a protrusion while magnet 221 is provided with a recess so that they may be engaged with each other as shown in FIG. 8B and, thereby, bell 121 and magnet 221 are held in a fixed position.

When shoulder bag 421 is carried in the condition wherein the opening is not closed such that bell 121 is separated from magnet 221 and is loose, bell 121 is jarred and emits sound. In contrast to this, when shoulder bag 421 is carried in the condition wherein bell 121 is held by magnet 221 and the opening of shoulder bag 421 is closed, bell 121 does not emit sound. This mechanism alerts the user that she has mistakenly left shoulder bag 421 in the open condition.

The same modifications as in the above described first embodiment are possible in regard to the fastener equipment in the eighth embodiment. Also in the eighth embodiment, even though bell 121 is attached to an end of strap 423, this portion of the configuration is not essential to the present invention and bell 121 may be attached to bag body 422 while magnet 221 may be attached to the end of strap 423. Here, it is not necessary for magnet 221 to have a one-piece structure with a recess but, rather, the recess may be created by combining a magnet with other members. Alternately, magnet 221 may be provided with a protrusion while a recess may be provided in body 122 of bell 121.

Furthermore in the eighth embodiment, though the fastener equipment for alerting the user that shoulder bag 421 has been left open and the fastener for closing shoulder bag 421 are integrated with each other, it is possible for shoulder bag 421 to have a fastener that is separate from bell 121 and magnet 221 which still work in conjunction with the fastener.

Additionally, the above described sixth embodiment can also be applied to this eighth embodiment. Bell body 122 may, for example, be formed of metal that is not attracted to a magnet, while ball 123 may be formed of a magnet. In this case it is also possible to provide, instead of magnet 221, a bell wherein the body is formed of a metal that is not attracted to a magnet and wherein the ball is made of a magnet in the same manner as stated directly above. The fastener equipment according to this eighth embodiment is, of course, applicable to clothing, bags, and the like, in addition to shoulder bags.

FIGS. 9A to 9C show a daypack 431 provided with fastener equipment according to the ninth embodiment of the present invention. FIG. 9A shows a perspective view of daypack 431 when a cover 433 is in the open condition. FIG. 9B shows a cross sectional view of daypack 431 along line 9B-9B of FIG. 9A and FIG. 9C shows the same cross section of daypack 431 when cover 433 is in the closed condition.

Daypack 431 is formed so that articles can be inserted into and removed from a container portion 432 via an opening 434, as can be seen with reference to FIGS. 9A to 9C. It is possible to open and close this opening 434 by sliding a fastener 435 so as to loosen or tighten a cord 436. Here, it should be noted that cord 436 has been tightened when the container portion 432 of daypack 431 is in the condition wherein a considerable number of articles are contained therein so that container portion 432 has become rounded in FIGS. 9A to 9C. A detailed view of these articles has, however, been omitted from FIGS. 9A to 9C.

A bell 132 made of metal is loosely attached to a metal ring 34 that is, in turn, loosely attached to a strap 135 sewn to cover 433. Furthermore, a stud 133 made of metal is attached to cover 433. Bell 132 is hollow and has an opening on its bottom side. Accordingly bell 132 can easily be jarred when cover 433 is in the open condition, as shown in FIGS. 9A and 9B, so that bell 132 and stud 133 strike each other making a sound.

A silencer 231 that can be connected to bell 132 is attached to container portion 432 via strap 234. This silencer 231 is made of an elastic material, such as metal or plastic, and is formed so that protrusions 233 provided on the two sides of silencer 231 can be pressed inward.

Here strap 234 and silencer 231 are integrated in a manner wherein the length of strap 234 between container portion 432 and silencer 231 is adjustable. That is to say, when using daypack 431 the user may adjust strap 234 to become longer when a great number of articles are put in container portion 432 and, contrarily, may adjust strap 234 to become shorter when only a small number of articles is put in container portion 432.

The user presses cover 433 down against container portion 432 and inserts silencer 231 into bell 132 from the bottom in order to close cover 433 of opening 434 in daypack 431 having the above described configuration. At this time protrusions 233 on both sides of silencer 231 are pressed inwardly so that silencer 231 slides into bell 132. When protrusions 233 reach to holes 136, which are provided on both sides of bell 132, protrusions 233 revert to their original form so that silencer 231 and bell 132 engage with each other.

On the other hand, bell 132 and silencer 231 are moved away from each other while the two protrusions 233 are pinched from the sides in order to open cover 433. That is to say, silencer 231 and bell 132 form a buckle.

FIG. 9C shows cover 433 in the closed condition wherein silencer 231 and bell 132 are engaged with each other. It should be noted that in this condition, bell 132 is pressed against container portion 432 due to tension from straps 135 and 234, which are located above and below bell 132. Furthermore, stud 133 is sandwiched between bell 132 and container portion 432 so that it is in a fixed position. Accordingly, bell 132 does not emit sound in the condition wherein cover 433 is closed.

The above described mechanism alerts the user that he or she has mistakenly left cover 433 of daypack 431 in the open condition. The fastener equipment according to this ninth embodiment is, of course, applicable to clothing, bags, and the like, in addition to daypacks.

FIGS. 10A to 10C show a travel bag 441 having fastener equipment according to the tenth embodiment of the present invention. FIG. 10A is a perspective view of this travel bag 441 wherein a slide fastener 391 is in the process of being closed. FIG. 10B is a cross sectional view of a portion of this travel bag 441 along line 10B-10B of FIG. 10A. Furthermore, FIG. 10C is a cross sectional view of a portion of travel bag 441 wherein slide fastener 391 is in the closed condition.

A slide fastener 391 attached to the upper portion of this bag 441 allows for the opening and closing of a container portion 442. A pull tab 242 is attached to a slider 392 of slide fastener 391 via a cord 244. It should be noted that a sheet of one type (cloth having hooks) 243 of a surface fastener 343 is attached to one side of this pull tab 242. In addition, a tab 443 is attached to one end of slide fastener 391 and another tab 444 is attached to the other end of slide fastener 391 of bag 441 in order to ease the opening and closing of bag 441.

A chime 141 formed of two metal pipes 142 is attached to tab 443 via a cord 144, wherein tab 443 is located at the end of slide fastener 391, to which slider 392 is close to when slide fastener 391 is closed. When bag 441 is moved in the open condition as shown in FIGS. 10A and 10B, the two pipes 142 of chime 141 strike each other and emit sound. It should also be noted that two sheets of the other type (cloth having pile) 143 of surface fastener 343 are wrapped around the upper portions of pipes 142.

The user pulls tab 242 so as to move slider 392 into the vicinity of tab 443 when the user closes bag 441. Afterwards, tab 242 is released from the hand of the user and tab 242 falls downward toward the side of bag 441 so as to make contact with chime 141. Then, as shown in FIG. 10C, sheet 243, of surface fastener 343, attached to one side of tab 242 is connected to sheets 143, of surface fastener 343, which are wrapped around the upper portions of pipes 142. Even when chime 141 is moved in this condition, the two pipes 142 do not strike each other and chime 141 does not emit sound.

Due to the above described configuration of bag 441, slide fastener 391 of bag 441 can be prevented from mistakenly being left open.

Here, surface fastener 343, as commercially available, is made of a combination of cloth wherein the surface layer is formed of a plurality of loops of plastic fiber as well as of cloth wherein the surface layer is formed of a plurality of plastic hooks. Velcro is the most well known of such surface fastener fabrics.

In addition, though tab 242 is attached to slider 392 and chime 141 is attached to tab 443 in this tenth embodiment, the positional relationship of these components can easily be changed. Chime 141, around which sheets 143 of the surface fastener 343 are wrapped, may, for example, be attached to slider 392 so that chime 141 can be used as a tab, while the surface area of tab 443 may be increased so that sheet 243 of surface fastener 343 can be attached to tab 443.

In addition, a signal source, which may have a variety of structures, can be made connectable to a signal modifier by using a surface fastener, as described in the tenth embodiment. Furthermore, the fastener equipment according to the tenth embodiment is also applicable to fasteners other than slide fasteners, as well as to clothing and bags other than travel bags.

FIGS. 11A to 11C show a buckle 721 according to the eleventh embodiment of the present invention. This buckle 721 is formed of a bell 521 and a silencer 621, which can be connected to and separated from each other. FIG. 11A is a perspective view showing buckle 721 wherein bell 521 and silencer 621 are separated from each other. FIG. 11B is a cross sectional view along line 11B-11B of FIG. 11A. Furthermore, FIG. 11C is a cross sectional view of buckle 721 when bell 521 and silencer 621 are connected to each other.

In reference to FIGS. 11A to 11C, all components of buckle 721 are made of metal such as stainless steel. Bell 521 is a hanging bell in which the body 522 is hollow having an opening 527 on the bottom side. The edge of opening 527 is circular and the sidewall of the lower portion of body 522 is cylindrical starting from the edge. Two opposing holes 528 are created in the lower portion of body 522. A tongue (clapper) 523 is provided inside body 522.

Two opposing holes 525 are created in the upper portion of body 522 for a double-wound ring 524 that is passed through holes 525. A longitudinal hole 526 is created in the upper portion of tongue 523 for double-wound ring 524 that is passed through hole 526. Thus, as shown in FIGS. 11A and 11B, body 522 of bell 521 and tongue 523 are both hung from double-wound ring 524 when double-wound ring 524 is held in the condition where silencer 621 is not connected to bell 21. When bell 521 is moved in this condition, tongue 523 swings inside body 522 so that tongue 523 and body 522 strike each other making a sound. Here, it should be noted that the lower portion of tongue 523 is enlarged so as to be made heavier and, thus, is helpful in enforcing the swing.

A brim 627 is provided around the body 622 of silencer 621. The portion of body 622 above brim 627 is columnar so that the portion can be inserted into body 522 of bell 521 from opening 527. That is to say, the inner surface of body 522 and the outer surface of the sidewall of body 622 slide together until brim 627 is received by the edge of opening 527. Here, it should be noted that two round protrusions 623 are provided on the side of body 622. These protrusions 623 are positioned opposite to each other relative to the center axis of body 622. Each protrusion 623 is movable and has the structure where the rear end is contained within body 622 preventing the protrusion from slipping out from body 622.

As shown in FIGS. 11B and 11C, a coil spring 628 is contained between two protrusions 623 within body 622. Two protrusions 623 and coil spring 628 are aligned in a manner where the both ends of coil spring 628 always push the respective protrusions 623 from behind. Thus, these protrusions 623 slide into body 622 perpendicular to the center axis of body 622 when an external force is applied. However, these protrusions 623 protrude to the sides of body 622 as long as such a force is not applied.

When body 622 of silencer 621 is inserted into body 522 of bell 521, two protrusions 623 and two holes 528 are all aligned in a predetermined position. At this position, these protrusions 623 protrude respectively to the outside so as to be engaged with these holes 528. At this time, the edge of opening 527 is received by brim 627. This is the condition where bell 521 and silencer 621 are connected to each other.

As shown in FIG. 11C, tongue 523 is supported by the top surface 626 of body 622 and does not swing or strike bell 521 in the condition where bell 521 and silencer 621 are connected to each other. Furthermore, opening 527 of bell 521 is closed by silencer 621 and, therefore, bell 521 does not make a sound in whatever manner buckle 721 is moved. In addition, two opponent holes 625 are created in the portion of body 622 beneath brim 627 for a double-wound ring 624 that is passed through holes 625.

In order to connect silencer 621 to bell 521, silencer 621 may be held with one hand with two protrusions 623 being pressed and, then, bell 521 may be put over silencer 621 in this condition with the other hand. Thus, two protrusions 623 are pressed by the inner surface of body 522 of bell 521 and stay inside of body 622. Then, bell 521 and silencer 621 are made to slide together to the position where protrusions 623 engage in holes 528.

Contrarily, when bell 521 and silencer 621, which have been connected to each other, are separated, silencer 621 is held with one hand with two protrusions 623 being pressed and bell 521 is pulled away from silencer 621 with the other hand.

It is possible for the above described buckle 721 to be replaced with the fastener equipment or the buckle used in the handbag and the backpack according to the eighth and ninth embodiments. In addition to this, buckle 721 can, of course, be utilized as a fastener or fastener equipment of a variety of types of bags and clothing.

Buckle 721 can be utilized as, for example, a key holder. Double-wound ring 524 is attached to clothes such as a belt loop of pants and keys are attached to double-wound ring 624. When a key is utilized silencer 621 is separated from bell 521 and, then, bell 521 makes a sound when the user moves in this condition. Accordingly, after the keys have been used, they can be returned to buckle 721 preventing them from being forgotten. Another example of buckle 721 being utilized is described below as the twelfth embodiment.

Buckle 721 is formed as described above while a variety of modifications are, of course, possible. First, the shape of buckle 721 is not necessarily limited to a columnar-based formation as described above. Secondly, both or one of double-wound rings may be replaced with other attachment means. Furthermore, it is possible to replace the engagement mechanism between the protrusions and the holes with another well known buckle mechanism.

In addition, in order to further reduce the vibration of tongue 523 when silencer 621 is connected to bell 521, an elastic material such as rubber or brush may be adhered to the top surface 626 of silencer 621. Alternately, it is possible to introduce a mechanism wherein tongue 523 is attracted to silencer 621 through magnetic force. For example, tongue 523 may be made of soft iron and a magnet in sheet form may be adhered to top surface 626.

FIG. 12 shows a neck strap 720 according to the twelfth embodiment of the present invention. This neck strap 720 is formed of the above described buckle 721 according to the eleventh embodiment, a band 722 made of leather, a strap 724 and a loop string 726. Band 722 is folded three-fold with a rivet 723 binding the center and, thereby, two loops are formed on the two sides of rivet 723. Strap 724 is passed through one of the loops and double-wound ring 524 for hanging buckle 721 is passed through the other loop. Loop string 726 is attached to double-wound ring 624 of buckle 721 via a small double-wound ring 725.

A cellular phone 821 may be attached to neck strap 720 that is formed as described above by using loop string 726. Alternately, a key 822 may be attached to neck strap 720 via double-wound ring 725.

The user hangs neck strap 720 around his or her neck and, thereby, can carry around cellular phone 821 or key 822. Then, it is possible to unclip buckle 721 at the time when using cellular phone 821 or key 822. Thus, bell 521 and silencer 621 are separated from each other resulting in bell 521 hung from the neck with strap 724 via band 722 and double-wound ring 524. When the user moves in this condition, bell 521 makes a sound and, therefore, it is prevented for the user from forgetting to clip buckle 721 after finishing using cellular phone 821 or key 822.

Things that are attached to neck strap 720 are not limited to cellular phone 821 and key 822, but rather, a variety of items such as a wallet, a coin case, a passport holder, a camera, binoculars, writing materials, an electronic dictionary, a watch, a musical reproduction apparatus, a pill case, a flask, a water bottle, a compass, a portable ashtray, a camping knife and a mosquito repellent are potentially attached to neck strap 720 in accordance with the application. In addition, it is possible to replace strap 724 with other types of straps such as a wrist strap and a waist strap.

It is possible to attach buckle 721 to a leash for a pet or for a child according to another application of buckle 721. An example wherein buckle 721 is attached to a leash for a dog is described in the following. Double-wound ring 524 of bell 521 is directly or indirectly attached to the collar of the dog while double-wound ring 624 of silencer 621 is attached to the end of the leash. In order to achieve this, for example, strap 724 is substituted with the collar of the dog while cellular phone 821 or key 822 is replaced with the leash in neck strap 720 shown in FIG. 12.

As described above, in the case wherein the collar of the dog and the leash are connected with buckle 721, the dog is connected to the leash in the condition where buckle 721 is clipped. When buckle 721 is unclipped, the dog is released from the leash with bell 521 hung from the collar and, therefore, bell 521 makes a sound due to the movement of the dog. Thus, the user gets reminded that the dog is released from the leash whenever the sound of bell 521 is heard. Alternately, it becomes easy to confirm the whereabouts of the dog that has been released by the sound of bell 521. As a result, the user does not forget that the dog is unleashed.

FIGS. 13A to 13D show a buckle 731 according to the thirteenth embodiment of the present invention. This buckle 731 is formed of a bell 531 and a silencer 631, which can be connected to, or separated from, each other. FIG. 13A is a perspective view of buckle 731, wherein bell 531 and silencer 631 are separated from each other. FIG. 13B is an exploded view of buckle 731, showing all of the components of bell 531 and silencer 631, respectively. FIG. 13C is a cross sectional view along line 13C-13C of FIG. 13A. Furthermore, FIG. 13D is a cross sectional view of buckle 731 when bell 531 and silencer 631 are connected to each other.

In reference to FIGS. 13A to 13D, all of the components of buckle 731 are made of metal which is not attracted to a magnet except weight 538, which is a columnar magnet, of the tongue (clapper) 533 of bell 531 and the ball 633, which is a spherical magnet, of bell 631.

Bell 531 is a hanging bell, of which the body 532 is hollow having an opening 537 on the bottom side. The edge of opening 537 is circular and the sidewall of the lower part of body 532 is cylindrical starting from the edge. Tongue 533 is provided inside body 532. The metal part that forms tongue 533 has a shape wherein a cylinder with a lid is connected to one end of a rod. Furthermore, tongue 533 is provided with weight 538 made of a columnar neodymium magnet tightly inserted in the cylinder of the above described metal part.

Two opposing holes 535 are created in the upper portion of body 532 for a double-wound ring 534 that is passed through holes 535. A longitudinal hole 536 is created in the upper portion of tongue 533 for double-wound ring 534 which is also passed through hole 536. Thus, as shown in FIGS. 13A and 13C, body 532 and tongue 533 of bell 531 are both hung from double-wound ring 534 when double-wound ring 534 is held in the condition where bell 531 is separated from bell 631. When bell 531 is moved in this condition, tongue 533 swings inside body 532 so that the two hit each other making a sound. At this time, it should be noted that weight 538 is helpful in enforcing the swing of tongue 533.

The body of bell 631 is formed of two parts, an upper part 632 and a lower part 637. Upper part 632 is hollow having a sidewall in cylindrical form and the external surface of the lower portion of the sidewall is threaded. In addition, the top portion of upper part 632 is covered with a circular plate which is divided in half by slit 636. Slit 636 extends to upper portions of the sidewall of upper part 632.

Lower part 637 is in the shape of a bowl with a cylindrical leg attached to the bottom, wherein the top portion starting from the surrounding of the opening is in short cylindrical form. The inner surface of this short cylindrical wall is also threaded. Thus, the external wall of the lower portion of upper part 632 and the internal wall of the upper portion of lower part 633 are screwed together so as to form the body of bell 631. The body of bell 631, which is hollow, contains ball 633 made of a spherical neodymium magnet. Here, the top portion of lower part 637 forms a brim surrounding the side of bell 631. In addition, two opposing holes 635 are created in the cylindrical leg of lower part 637 for a double-wound ring 634 that is passed through holes 635.

The body of bell 631 is hung from double-wound ring 634 when double-wound ring 634 is held. When bell 631 is moved in this condition, ball 633 rolls around and hits the internal wall of the body of bell 631, making a sound.

Upper part 632 of bell 631 can be inserted into body 532 of bell 531 from opening 537 until the top portion of lower part 637 of bell 631 is received by the edge of opening 537 of bell 531. That is to say, the inner surface of body 532 and the outer surface of body 632 slide together so that bell 531 and bell 631 are connected to each other.

At this time, as shown in FIG. 13D, weight 538 and ball 633, which are both made of magnets, are attracted to each other. In this condition, tongue 533 of bell 531 and ball 633 of bell 631 are both stationary and, therefore, neither bell can make a sound. That is to say, it should be noted that these bells 531 and 631 function as silencers for the opponent bells.

In order to separate bells 531 and 631, which were connected to each other, one bell may be pulled away from the other with force greater than the magnetic force between weight 538 and ball 633. In the condition wherein the two bells 531 and 631 are separated from each other, either bell will make a sound when movement is made.

It is possible to utilize the above described buckle 731 in the same manner as the above described buckle 721, and the fastener equipment or buckle used in the handbag and backpack according to the eighth and ninth embodiments can be replaced with buckle 731. It is, of course, possible to utilize buckle 731 as a fastener or fastener equipment for various types of bags and clothing in addition to the above description.

Furthermore, buckle 731 can be utilized as a key holder and it is also possible to utilize buckle 731 in neck strap 720 according to the twelfth embodiment by replacing buckle 721 with buckle 731. In addition, it is possible to utilize buckle 731 instead of a well-known type of buckle.

There is a risk wherein ball 633 of bell 631, which is a magnet, may inadvertently attract iron sand, small pieces of iron, or the like, while buckle 731 is being utilized. Ball 633 can be taken out of bell 631 by unscrewing upper body 632 from lower body 637 in order to remove such foreign particles that have been attracted to ball 633.

Though buckle 731 is formed as described above, a variety of modifications are, of course, possible. First, it is not necessary to limit the shape of buckle 731 to have a cylinder-based formation. Secondly, one of or both of the double-wound rings may be replaced with another attachment means.

In addition, neither weight 538 nor ball 632 needs to be a neodymium magnet, but rather, one or both of them may be replaced with other types of magnets, such as samarium and ferrite. Either weight 538 or ball 633 may be formed of soft iron. That is to say, weight 538 and ball 633 may be formed of a combination of materials that are attracted to each other by means of magnetic force. Furthermore, the cylindrical portion with the lid of tongue 533 may be formed of soft iron with a slight gap vis-à-vis weight 538. Thus, a yoke can be provided with the magnet that forms weight 538 so that magnetic force is enhanced on the bottom surface of weight 538.

Furthermore, both of the two bells 531 and 631 may be bells having a tongue or may be bells having a ball, though one of them has a tongue and the other has a ball according to the thirteenth embodiment. A variety of modifications are, of course, possible for the shapes of the tongue and of the ball.

FIGS. 14A to 14D show the components of fastener equipment according to the fourteenth embodiment of the present invention. FIGS. 14A and 14B are perspective views of an electronic device 151 as seen from the front and from the rear. FIG. 14C is a perspective view of a signal modifier 251. In addition, FIG. 14D is a side view of electronic device 151 and signal modifier 251 in the condition wherein they are in contact with each other, back to back.

In reference to FIGS. 14A and 14B, an electronic device 151 is formed of a housing 152 made of plastic and a soft iron plate 153 having a hole 155 in the center attached to each other. An LED (light emitting diode) 158 is provided in a recess 157 of housing 152 on one side of electronic device 151. A protrusion 156, which passes through hole 155, is provided on the other side of electronic device 151.

This protrusion 156 can be pressed down into housing 152 up to, at least, the position wherein the top of protrusion 156 is level with the surface of soft iron plate 153. Here, the top of this protrusion 156 sticks out of soft iron plate 153 when no external force is applied to protrusion 156.

A switch that interlocks with this protrusion 156, a circuit board on which LED 158 is mounted and a battery are contained inside of housing 152. Thus, when protrusion 156 is not pressed down, the switch is turned on and LED 158 produces either constant light or blinking light. On the other hand, when protrusion 156 is pressed down, the switch is turned off and LED 158 is turned off. This electronic device 151 is provided with a cord 154 so that electronic device 151 can be attached to a fastener-including system (for example, a slider of a slide fastener).

In reference to FIG. 14C, a signal modifier 251 that can be connected to electronic device 151 is formed of a housing 252 made of plastic and a ferrite magnet 253 contained in this housing 252. The side and the bottom of this ferrite magnet 253 are surrounded by a yoke 255 in a cap form so that a strong magnetic force occurs at the top surface of ferrite magnet 253.

When such a signal modifier 251 is moved to a position close to electronic device 151, signal modifier 251 and electronic device 151 are attracted to each other due to the magnetic force so as to make contact with each other back to back as shown in FIG. 14D. In this condition protrusion 156 has been pressed down so as to turn off LED 158. Here, signal modifier 251 is also provided with a cord 254 so that signal modifier 251 can be attached to a fastener-including system (for example, a slider of a slide fastener).

Electronic device 151 and signal modifier 251 configured as described above can be utilized as fastener equipment in the same manner as bell 101 and silencer 201 of FIGS. 1A and 1B. It is assumed that electronic device 151 and signal modifier 251 are attached to slide fastener 301, shown in FIGS. 2A and 2B, in place of bell 101 and silencer 201. LED 158 remains turned off as long as slide fastener 301 is in the closed condition while LED 158 emits constant light or blinking light when slide fastener 301 is in the open condition. Thus, slide fastener 301 is prevented from mistakenly being left open.

Here, electronic device 151 having such a configuration remains in the ON condition where LED 158 keeps producing constant light or blinking light even in the case wherein electronic device 151 is in an unmoving, stable condition, unlike bell 101 which emits sound only when it is moved. A motion sensor may further be provided to electronic device 151 in order to allow LED 158 to stay in the OFF condition in the case when the user is unconcerned in regard to the state of the fastener.

Alternatively, it is possible to provide electronic device 151 with a timer so that LED 158 emits constant light, or blinking light, for a certain period of time. In addition, electronic device 151 may be provided with a buzzer that emits sound, or with a vibration unit, in place of LED 158. Alternately, electronic device 151 may be provided with any combination of a motion sensor, a timer, an LED, a buzzer and a vibration unit.

Furthermore, cords 154 and 254, provided with electronic device 151 and signal modifier 251, respectively, can be replaced by other means for attachment in the same manner as can cords 104 and 204 of bell 101 and silencer 201 in FIGS. 1A and 1B. That is to say, at least one of cords 154 and 254 may be replaced with a member provided with a safety pin, a badge-type pin, a screw, a rivet, a clip, a flap, or the like, so that electronic device 151 and/or signal modifier 251 can be attached to a fastener or to cloth.

In addition, it is also possible to combine two electronic devices, which are signal sources, in the same manner as bells 501 according to the above described sixth embodiment. In this case, each of the electronic devices mutually functions as a signal modifier. Each of the two electronic devices may emit a different type of signal from the other.

As described above, the switch of electronic device 151 is formed such that electronic device 151 is turned on when protrusion 156 is not pressed and electronic device 151 is turned off when protrusion 156 is pressed. Many commercially available switches, however, have a structure wherein an internal connection is made when a protrusion is pressed and such a connection is not made when the protrusion is not pressed. In order to use such a commercially available switch an inverter circuit may be inserted between the switch and the circuit that allows the LED to emit constant light or blinking light. Thus, the LED is turned off when the switch is turned on and the LED is turned on when the switch is turned off.

Alternately, it is possible to use a reed switch, which is turned on and off in accordance with the presence or absence of magnetic force, instead of a switch that is mechanically turned on and off. That is to say, protrusion 156, the switch that interlocks with protrusion 156 and soft iron plate 153, may be removed. A reed switch may be provided in place of the removed switch inside of housing 152 on the side wherein soft iron plate 153 was located. Furthermore, the circuit is formed such that the LED is turned on when the reed switch is turned off while the LED is turned off when the reed switch is turned on, by using an inverter circuit as described above.

Thus, the reed switch is turned off, allowing the LED to emit constant or blinking light, when electronic device 151 and signal modifier 251 are located at a certain distance away from each other. The reed switch reacts to the magnetic lines of force of ferrite magnet 253 so as to turn on, allowing the LED to turn off, when electronic device 151 and signal modifier 251 make contact with each other. In this case, electronic device 151 and signal modifier 251 are not connected to each other and the LED may not remain in the off condition. Therefore, a means for connection, such as a surface fastener, may be attached to electronic device 151 and to signal modifier 251.

FIGS. 15A and 15B show components of the fastener equipment, according to the fifteenth embodiment of the present invention, having a structure wherein a reed switch and a magnetic catch are used together. Such a structure wherein a reed switch and a magnetic catch are used together is well-known in, for example, safety devices provided in the doors of electrical apparatuses that utilize high voltage FIGS. 15A and 15B are schematic cross sectional diagrams of an electronic device 551 and a signal modifier 651 including circuit diagrams. FIG. 15A shows electronic device 551 and signal modifier 651 in the condition wherein they are separated from each other while FIG. 15B shows electronic device 551 and signal modifier 651 in the condition wherein they are connected to each other.

In reference to FIGS. 15A and 15B, electronic device 551 is formed of a ferrite magnet 553 and a reed switch 556 contained in a housing 552, which is made of plastic. A yoke 554 is provided on the N pole side of ferrite magnet 553 and a yoke 555 is provided on the S pole side of ferrite magnet 553. In addition, reed switch 556 is formed of a glass tube 751 containing an inert gas and contact blades 752 and 753, which are made of magnetic material. Contact blades 752 and 753 make contact with each other inside this glass tube 751.

Reed switch 556, together with a battery 557 and an LED 558, forms a circuit as shown in the figures. Here, though battery 557 and LED 558 are contained inside housing 552, it should be noted that for simplicity they are represented by circuit symbols in FIGS. 15A and 15B. Furthermore, this electronic device 551 is provided with a cord 559 so as to be attachable to a fastener-including system in the same manner as the above described electronic device 151 according to the fourteenth embodiment of the present invention.

On the other hand, signal modifier 651 is formed of a housing 652 made of plastic and of a soft iron plate 653 adhered to housing 652. In addition, this signal modifier 651 is also provided with a cord 654 so as to be attachable to a fastener-including system in the same manner as the above described signal modifier 251 according to the fourteenth embodiment of the present invention.

Magnetic flux that emanates from yoke 554 on the N pole side of ferrite magnet 553 and that is directed towards yoke 555 on the S pole side of ferrite magnet 553 passes through the inside of reed switch 556 when electronic device 551 and signal modifier 651, having the above described configurations, are in the condition wherein they are separated from each other, as shown in FIG. 15A. As a result, contact blades 752 and 753 make contact with each other so that reed switch 556 is turned on and LED 558 emits light.

On the other hand, yoke 554 and yoke 555 are connected through soft iron plate 653 in the condition wherein electronic device 551 and signal modifier 651 are connected to each other, as shown in FIG. 15B, so that the magnet flux of ferrite magnet 553 emanates from the N pole, passes through yoke 554, soft iron plate 653 as well as yoke 555, and returns to the S pole. Thus, the magnetic flux does not pass through reed switch 556 so that contact blades 752 and 753 stay at positions separated from each other. As a result, reed switch 556 is turned off and LED 558 does not emit light.

The fastener equipment according to the fifteenth embodiment of the present invention, formed of electronic device 551 and signal modifier 651 as described above, can be utilized in the same manner as the above described fastener equipment according to the first, sixth and fourteenth embodiments of the present invention. In addition, the fastener equipment according to the fifteenth embodiment of the present invention can be utilized in the same manner as the fastener equipment according the first to fourteenth embodiments and its modifications in the case wherein an appropriate attachment structure is adopted in place of cords 559 and 654.

In particular, the fastener equipment according to the fifteenth embodiment has a magnetic catch structure with an attractive force strong enough to be used as a fastener. Accordingly, fastener equipment having a signal source can easily be integrated with a fastener that utilizes magnetic force, as described in the eighth and thirteenth embodiments, in the case wherein the fastener equipment according to the fifteenth embodiment is used.

Electronic device 551 may be provided with a buzzer that emits sound, or with a vibration unit, in place of LED 558 in the same manner as in the above described electronic device 151 according to the fourteenth embodiment of the present invention. In addition, like the above described electronic device 151, it is preferable for electronic device 551 to be provided with a motion sensor so that it emits a signal only when it is moved. Alternately, electronic device 551 may be provided with any combination of a motion sensor, a timer, an LED, a buzzer and a vibration unit.

FIGS. 16A and 16B show a handbag 861 provided with the fastener equipment according to the sixteenth embodiment of the present invention. FIGS. 16A and 16B are both perspective views of handbag 861 wherein FIG. 16A shows a cover 862 of handbag 861 in the closed condition and FIG. 16B shows cover 862 of handbag 861 in the open condition.

In reference to FIGS. 16A and 16B, an electronic device 561 is attached to cover 862 of handbag 861. A ferrite magnet and a reed switch are provided inside of housing 562 of this electronic device 561 so as to form the same switching mechanism and electrical circuit as in the above described electronic device 551 according to the fifteenth embodiment.

Housing 562 is made of plastic, has an opening for exposing an LED 568 and has a battery compartment cover 567. In addition, yokes 564 and 565 of the ferrite magnet of electronic device 561, which correspond to yokes 554 and 555 of ferrite magnet 553 of electronic device 551, are exposed from the rear surface of cover 862. On the other hand, a soft iron plate 661 is attached to the body 863 of handbag 61. The surface of soft iron plate 661 is treated with an anti-corrosive.

Yokes 564 and 565 are connected to soft iron plate 661 by means of magnetic force in the case wherein handbag 861 formed as described above is in the closed condition, as shown in FIG. 16A. At this time, the reed switch within electronic device 561 is turned off in the same manner as in the above described case of FIG. 15B and, therefore, LED 568 does not emit light. Contrarily, when handbag 861 is in the open condition as shown in FIG. 16B, the reed switch is turned on as in the above described case of FIG. 15A and, therefore, LED 568 emits light. Thus, the user of handbag 861 is alerted to the fact that cover 862 of handbag 861 has been left open.

Electronic device 561 may be provided with a buzzer that emits sound, or with a vibration unit, in place of LED 568 in the same manner as in the above described electronic devices 151 and 551 according to the fourteenth and fifteenth embodiments of the present invention. In particular, like the above described electronic devices 151 and 551, it is preferable for electronic device 561 to be provided with a motion sensor so that it emits a signal only when it is moved. Alternately, electronic device 561 may be provided with any combination of a motion sensor, a timer, an LED, a buzzer and a vibration unit.

FIG. 17 shows a bell 161 of the fastener equipment according to the seventeenth embodiment of the present invention. Body 162 and ball 163 of bell 161 shown in FIG. 17 are identical to body 102 and ball 103 of bell 101 of FIG. 1A. Bell 161 is equipped with a safety pin 165 via a metal ring 164. As a result, it becomes very easy to attach bell 161 to cloth.

On the other hand, FIG. 18 shows a bell 171 of the fastener equipment according to the eighteenth embodiment of the present invention. Body 172 and ball 173 of bell 171 shown in FIG. 18 are also identical to body 102 and ball 103 of bell 101 of FIG. 1A. A flap 175 is attached to bell 171 via a metal ring 174. Bell 171 can easily be attached to cloth via flap 175 by means of sewing or by using adhesive.

Silencers that have the same working effects as silencer 201, shown in FIG. 1B can, of course, be used together with the above described bells 161 and 171 according to the seventeenth and eighteenth embodiments. These bells can also be used alone when independently attached to clothing and bags with a fastener including a magnet, of which an example is shown in the following nineteenth embodiment.

FIG. 19 shows a handbag 451 according to the nineteenth embodiment. The above described bell 161 according to the seventeenth embodiment is attached to this handbag 451. Handbag 451 has an opening in the upper portion of a container portion 452. A sheet magnet 453 and an iron sheet 454, respectively, are attached to the sides facing each other across the opening. This opening is closed when sheet magnet 453 and an iron sheet 454 are moved in close proximity to each other so as to attract each other. Here, sheet magnet 453 and iron sheet 454 are not visible from the outside because they are located between the exterior material and the interior material of handbag 451.

Bell 161 is attached by means of safety pin 165 to a position that overlaps iron sheet 454 of handbag 451. Thus, when the opening of handbag 451 is closed, sheet magnet 453 attracts bell 161 and bell 161 does not emit sound. As a result, the opening of handbag 451 can be prevented from mistakenly being left open. Here, though bell 161 is attached to the inside of handbag 451 in FIG. 19, bell 161 may be attached to the outside of handbag 451 and gain the same effects in the case wherein the magnetic force of sheet magnet 453 is sufficiently strong. Furthermore, it is possible to attach the above described bell 171 according to the eighteenth embodiment, instead of bell 161, to handbag 451.

FIGS. 20A and 20B show an electronic device 181 of the fastener equipment according to the twentieth embodiment of the present invention. FIGS. 20A and 20B are perspective views of electronic device 181 seen from two different sides.

Electronic device 181 is formed of a housing 182, made of a comparatively flexible plastic, and an elastic metal plate 183 attached to each other. Metal plate 183 has a cross section in an R-shape and works as a clip so that an article in sheet form can be held in the center of metal plate 183. Thereby, it becomes possible to attach electronic device 181 to the periphery of the opening of a bag, to the periphery of a cover, or the like. An LED 188 is provided in a recess 187 of housing 182 on one side of electronic device 181. A protrusion 186 that passes through a hole 185 is provided on the other side of electronic device 181.

It is possible to press this protrusion 186 down into housing 182 to, at least, the level wherein the top of protrusion 186 is flush with the surface of housing 182. Here, the top of this protrusion 186 protrudes from housing 182 when no force is applied to protrusion 186.

A switch that interlocks with this protrusion 186, a circuit board on which LED 188 is mounted and a battery are contained inside of housing 182. Thus, the switch is turned on when protrusion 186 is not pressed so that LED 188 emits continuous light or blinking light, while the switch is turned off when protrusion 186 is pressed so that LED 188 is turned off. Electronic device 181 configured as described above is attached to clothing or to a bag as fastener equipment. Here, an example is shown in the following according to the twenty-first embodiment wherein electronic device 181 is attached to a handbag 461.

Electronic device 181, according to the twentieth embodiment, may further be provided with a sensor for detecting movement, a timer or both of these in the same manner as the above described electronic devices 151, 551 and 561 according to the fourteenth to sixteenth embodiments; or may be provided with, in place of LED 188, a buzzer for emitting sound, a vibrator for conveying vibration or a combination of two or more of: an LED, a buzzer and a vibrator.

FIG. 21 shows a handbag 461 according to the twenty-first embodiment of the present invention. Handbag 461 has an opening at the top of a container portion 462. A sheet 463 of one type and a sheet 464 of the other type, respectively, of a surface fastener 465 are attached to the opposing sides of handbag 461 separated by the opening. Thereby, this opening is opened and closed by means of surface fastener 465. Here, surface fastener 465 is formed of a combination of sheet 463, having a surface layer formed of a great number of piles (loops) of plastic fibers, and sheet 464, having a surface layer formed of a great number of plastic hooks.

Electronic device 181 is attached to handbag 461 as described above in the vicinity of sheet 464 of surface fastener 465. Electronic device 181 is attached to handbag 461 by inserting one side of handbag 461 into the center of metal plate 183, so that protrusion 186 is positioned within the opening of handbag 461. Thus, the side of handbag 461 facing electronic device 181 pressed down protrusion 186 so as to turn off LED 188 when the opening of handbag 461 is closed. On the other hand, LED 188 emits constant or blinking light when the opening is opened and protrusion 186 is not pressed down. Thereby, the opening of handbag 461 can be prevented from mistakenly being left open.

Here, though surface fastener 465 is used to open and close the opening of handbag 461, as shown in FIG. 21, it is possible to attach electronic device 181, according to the thirteenth embodiment, to clothing or to a bag having a surface fastener utilizing a magnetic sheet, such as of bag 451 of FIG. 13C.

Though the present invention is described above by citing the first to twenty-first embodiments and several modifications of these, the present invention is not limited to these embodiments or modifications. It is clear to those skilled in the art that the first to twenty-first embodiments, as well as the modifications thereof, can be further modified or can be appropriately combined so as to create another embodiment based on the descriptions in the present specification. The scope of the present invention is defined by the appended claims and is intended to include inventions equivalent to descriptions in the claims as well as all embodiments and modifications within the scope.

The invention claimed is:

1. An alert apparatus for providing an alert indication directed to a user thereof; the apparatus being incorporated into or attached to fastener equipment for securing an item, wherein said apparatus comprises:

first and second elements of said fastener equipment, which are moveable together and apart, the item being in a secure position when the first and second elements are together, wherein one of the said elements includes a bell having a clapper or ball for providing an alert indication directed to the user, only when the element is being moved;

wherein movement of said clapper or ball is suppressed by a suppressor when the first and second elements are at or are moved to positions adjacent one another thereby suppressing the alert indication.

2. The alert apparatus according to claim 1, wherein the fastener equipment is for securing an aperture in an item closed, and said first and second elements are moveable together for closing the aperture and moveable apart for opening the aperture.

3. The alert apparatus according to claim 1, wherein the fastener equipment is for securing first and second members together, and said first and second elements are moveable together for attaching said first and second members and moveable apart for detaching said first and second members.

4. The alert apparatus according to claim 1, wherein one of said elements have magnetic means suppressing said alert indication by means of magnetic force.

5. The alert apparatus according to claim 1, wherein one of said elements have mechanical means for suppressing said alert indication by means of mechanical action.

6. The alert apparatus according to claim 1, wherein both said elements are arranged to provide an alert indication.

7. The alert apparatus according to claim 1, wherein said elements can be connected together by means of magnetic force.

8. The alert apparatus according to claim 1, wherein said elements can be connected together by means of a surface fastener or a buckle.

9. The alert apparatus according to claim 1, wherein one of said elements is connected to a slider of a slide fastener that is incorporated in a wearable or portable item.

10. The alert apparatus according to claim 9, wherein first element is connected to a first slider, and said second element is connected to a second slider.

11. The alert apparatus according to claim 9, wherein said slide fastener is a zip fastener.

12. The alert apparatus according to claim 1, wherein said first element is connected to a slider of a slide fastener that is incorporated in a wearable or portable item, and said second element is disposed on said wearable or portable item in a fixed position relative to said item.

13. The alert apparatus according to claim 1, wherein said item is a portable item or a wearable item.

14. An alert apparatus for providing an alert indication directed to a user thereof; the apparatus being incorporated into or attached to fastener equipment for closing an aperture in an item, wherein said apparatus comprises:

first and second elements of said fastener equipment, which are moveable together for closing said aperture and apart for opening said aperture; wherein one of the elements includes a bell having a clapper or ball for providing an alert indication directed to the user, when the element is moved; wherein movement of said clapper ball is suppressed when the first and second elements are at or are moved to positions adjacent one another thereby suppressing the alert indication.

15. An alert apparatus for providing an alert indication directed to a user thereof; the apparatus being incorporated for incorporation into or attachment to fastener equipment for securing an item, wherein said apparatus comprises:

first and second elements of said fastener equipment, which are moveable together and apart, the item being in a secure position when the first and second elements are together when incorporated or attached to the fastener equipment; wherein at least one of the elements is arranged to provide an alert indication directed to the user, only when the element is being moved, said alert indication being suppressed by a suppressor when the first and second elements are at or are moved to positions adjacent one another.

* * * * *